US005847495A

United States Patent [19]

Yamanobe et al.

[11] Patent Number: 5,847,495

[45] Date of Patent: Dec. 8, 1998

[54] ELECTRON-EMITTING DEVICE AND IMAGE FORMING APPARATUS USING SAME

[75] Inventors: Masato Yamanobe, Machida; Takeo Tsukamoto, Atsugi; Keisuke Yamamoto, Yamato; Yasuhiro Hamamoto, Machida, all of Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 532,869

[22] Filed: Sep. 22, 1995

[30] Foreign Application Priority Data

| | | | |
|---|---|---|---|
| Sep. 22, 1994 | [JP] | Japan | 6-252730 |
| Sep. 29, 1994 | [JP] | Japan | 6-259074 |
| Mar. 29, 1995 | [JP] | Japan | 7-094168 |
| Sep. 21, 1995 | [JP] | Japan | 7-266199 |

[51] Int. Cl.[6] ..... H01J 1/30; H01J 19/24

[52] U.S. Cl. ..... 313/310; 313/355; 313/308; 313/496

[58] Field of Search ..... 313/336, 309, 313/355, 310, 351, 291, 306, 308, 495, 496, 497; 427/49

[56] References Cited

U.S. PATENT DOCUMENTS

| | | | |
|---|---|---|---|
| 4,954,744 | 9/1990 | Suzuki et al. | 313/336 |
| 5,023,110 | 6/1991 | Nomura et al. | 427/49 |
| 5,185,554 | 2/1993 | Nomura et al. | 313/495 |
| 5,285,079 | 2/1994 | Tsukamoto et al. | 257/10 |
| 5,530,314 | 6/1996 | Banno et al. | 313/310 |

FOREIGN PATENT DOCUMENTS

| | | | |
|---|---|---|---|
| 0501785 | 2/1992 | European Pat. Off. | H01J 1/30 |
| 0536732 | 4/1993 | European Pat. Off. | H01J 1/30 |

OTHER PUBLICATIONS

Patent Abstracts of Japan, vol. 018, No. 210 (E–1537), Apr. 14, 1994 and JP–A–06 012997 (Canon Inc.) Jan. 21, 1994.
Patent Abstracts of Japan, vol. 014, No. 573 (E–1015), Dec. 19, 1990 and JP–A–02 247940 (Canon Inc.) Oct. 3, 1990.
Patent Abstracts of Japan, vol. 014, No. 045 (E–0880), Jan. 26, 1990 and JP–A–01 276529 (Canon Inc.) Nov. 7, 1989.
Patent Abstracts of Japan, vol. 014, No. 045 (E–0880), Jan. 26, 1990 and JP–A–01 276528 (Canon Inc.) Nov. 7, 1989.
Radio Engineering and Electronic Physics, The Emission Of Hot Electrons And The Field Emission of Electrons From Tin Oxide, M.I. Elinson, A.G. Zhdan, G.A. Kudintseva, and M.E. Chuguova, vol. 7, Jul. 1965, 1290–6.
Journal of the Vacuum Society of Japan, "Electroforming and Electron Emission of Carbon Thin Films" vol. 26, No. 1, Hisashi Araki, Okikazu Hirabaru, and Teruo Nanawa, pp. 22–29, Sep. 1981.
International Electron Devices, meeting, 1975, Washington, D.C., "Strong Electron Emission From Patterned Tin–Indium Oxide Thin Films", M. Hartwell and C.G. Fonstad, pp. 519–521 (no month).
Journal of Applied Physics, "Physical Properties of Thin Film Field Emission Cathodes with Molybelenum Cones" Dec. 1976, vol. 47, No. 12, pp. 5247–5263.
Journal of Applied Physics, "Operation of Tunnel–Emission Devices" vol. 32, Jan.–Dec., 1961, pp. 646–652.
"Electrical Conduction and Electron Emission of Discontinuous Thin Films", G. Dittmer, pp. 317–328, 1972 (no month).
Dyke et al., Advances in Electronics and Electron Physics, vol. VIII, pp. 89–182, 1956 (no month).

*Primary Examiner*—Nimeshkumar Patel
*Assistant Examiner*—Michael Day
*Attorney, Agent, or Firm*—Fitzpatrick, Cella, Harper & Scinto

[57] ABSTRACT

An electron-emitting device comprises an electroconductive film including an electron-emitting region disposed between a pair of electrodes arranged on a substrate. The electron-emitting region is formed close to the step portion formed by one of the electrodes and the substrate.

48 Claims, 53 Drawing Sheets

SUBSTRATE A

SUBSTRATE B

ELECTRON-EMITTING DEVICE AND IMAGE FORMING APPARATUS USING SAME

BACKGROUND OF THE INVENTION

1. Field of the Invention

This invention relates to an electron-emitting device having a novel structure and also to an electron source and an image forming apparatus comprising such electron-emitting devices.

2. Related Background Art

There have been known two types of electron-emitting device; the thermionic cathode device and the cold cathode device. Cold cathode devices refer to the field emission type (hereinafter referred to as the FE type), the metal/insulation layer/metal type (hereinafter referred to as the MIM type), the surface conduction type, etc. Examples of FE type device include those proposed by W. P. Dyke & W. W. Dolan, "Field emission", Advance in Electron Physics, 8, 89 (1956) and C. A. Spindt, "PHYSICAL Properties of thin-film field emission cathodes with molybdenum cones", J. Appl. Phys., 47, 5248 (1976).

Examples of MIM device are disclosed in papers including C. A. Mead, "Operation of Tunnel-Emission Devices", J. Appl. Phys., 32, 646 (1961).

Examples of surface conduction electron-emitting device include one proposed by M. I. Elinson, Radio Eng. Electron Phys., 10, 1290 (1965).

A surface conduction electron-emitting device is realized by utilizing the phenomenon that electrons are emitted out of a small thin film formed on a substrate when an electric current is forced to flow in parallel with the film surface. While Elinson proposes the use of $SnO_2$ thin film for a device of this type, the use of Au thin film is proposed in [G. Dittmer: "Thin Solid Films", 9, 317 (1972)] whereas the use of $In_2O_3/SnO_2$ and that of carbon thin film are disclosed respectively in [M. Hartwell and C. G. Fonstad: "IEEE Trans. ED Conf.", 519 (1975)] and [H. Araki et al.: "Vacuum", Vol. 26, No. 1, p. 22 (1983)].

FIG. 60 of the accompanying drawings schematically illustrates a typical surface conduction electron-emitting device proposed by M. Hartwell. In FIG. 60, reference numeral 1 denotes a substrate. Reference numeral 3 denotes an electroconductive thin film normally prepared by producing an H-shaped thin metal oxide film by means of sputtering, part of which eventually makes an electron-emitting region 2 when it is subjected to an electrically energizing process referred to as "energization forming" as will be described hereinafter. In FIG. 60, a pair of device electrodes are separated by a length L of 0.5 to 1 [mm] and a width W' is 0.1 [mm].

Conventionally, an electron emitting region 2 is produced in a surface conduction electron-emitting device by subjecting the electroconductive thin film 3 of the device to an electrically energizing process, which is referred to as energization forming. In the energization forming process, a DC voltage or a slowly rising voltage that rises typically at, for instance, a very slow rate of 1V/min. is applied to given opposite ends of the electroconductive thin film 3 to locally destroy, deform or structurally modify the film and produce an electron-emitting region 2 which is electrically highly resistive. Thus, the electron-emitting region 2 is part of the electroconductive thin film 3 that typically contains fissures therein so that electrons may be emitted from the fissures and their neighboring areas. Note that, once subjected to an energization forming process, a surface conduction electron-emitting device comes to emit electrons from its electron emitting region 2 whenever an appropriate voltage is applied to the electroconductive thin film 3 to make an electric current flow through the device.

In an image display apparatus realized by arranging a large number of surface conduction electron-emitting devices of the above described type on a substrate and an anode electrode disposed above the substrate, a voltage is applied to the device electrodes of selected electron-emitting devices to cause their electron-emitting regions to emit electrons, while another voltage is applied to the anode electrode of the apparatus to attract electron beams emitted from the electron-emitting regions of the selected surface conduction electron-emitting devices. Under this condition, electrons emitted from the electron-emitting region of a surface conduction electron-emitting device form an electron beam, which move from the low potential side to the high potential side of the device electrode and, at the same time, toward the anode along a parabolic trajectory that is gradually spread before they finally get to the anode electrode. The trajectory of the electron beam is defined as a function of the potential difference of the voltages applied to the device electrodes of each device, the voltage applied to the anode electrode and the distance between the anode electrode and the electron-emitting devices.

The image display apparatus is further provided with fluorescent members arranged on the anode electrode as so many pixels that emit light as emitted electrons collide with them. With this arrangement, the electron beam is required to have a profile that corresponds to the size of the pixel, or the target of the electron beam, but this requirement is not necessarily met in conventional image display apparatuses particularly in the case of high definition television sets comprising a large number of fine pixels. If such is the case, the electron beam can eventually hit adjacent pixels to produce unwanted colors on the screen to consequently degrade the quality of the display image.

In addition, if the image display apparatus is very flat and has a large display screen that is tens of several inches wide as in the case of a so-called wall televisions set, it may be accompanied by another problem as described below.

The surface conduction electron-emitting devices of such an image display apparatus is typically prepared by way of a patterning process using an aligner comprising a deep UV type light source, if the device electrodes of each surface conduction electron-emitting device is separated from other by less than 2 to 3 $\mu$m, or a regular UV type light source, if the device electrodes are separated by more than 3 $\mu$m, from the viewpoint of the performance of the aligner and the manufacturing yield.

However, any known aligners have a relatively small exposure area that is several inches wide at most if they are of the deep UV type and are intrinsically not suited for a large exposure area because they are of the direct contact exposure type. The exposure area of aligners of the regular UV type does not generously exceed ten inches in the dimension and therefore they are by no means good for the manufacture of large screen apparatuses.

In view of the above identified problem of aligners, the distance separating the device electrodes of each surface conduction electron-emitting device is preferably greater than 3 $\mu$m and more preferably greater than tens of several $\mu$m in an electron source comprising a large number of such surface conduction electron-emitting devices or an image forming apparatus using such an electron source.

On the other hand, as a result of the above described energization forming process, the produced electron-emitting region of the surface conduction electron-emitting device can become swerved particularly when the device electrodes are separated by a large distance to reduce the convergence of the electron beam emitted from there. Then, the energization forming process in the manufacture of surface conduction electron-emitting devices may lose accuracy in terms of the location and the profile of the electron-emitting region to produce devices that operate poorly.

Thus, in an electron source comprising a large number of surface conduction electron-emitting devices having a large distance separating the device electrodes and an image forming apparatus using such an electron source, the electron-emitting devices do not operate uniformly for electron emission to consequently give rise to an uneven distribution of brightness nor the electron beams they emit converge in a desired way. The image displaying performance of such an apparatus is inevitably poor as it can provide only blurred images.

Additionally, in the energization forming process for producing an electron-emitting region in the surface conduction electron-emitting device, each device consumes power normally between tens of several mW to several hundred mW, requiring a huge quantity of power for an electron source comprising a large number of surface conduction electron-emitting devices or an image forming apparatus using such an electron source. Then, in the energization forming process, there occurs a significant drop in the voltage applied to each device to additionally damage the uniformity in the performance of the produced devices. In certain cases, the substrate can be cracked during the energization forming process as a result of such lack of uniformity.

SUMMARY OF THE INVENTION

In view of the above identified problems, it is therefore a first object of the present invention to provide an electron-emitting device that emits electrons at a sufficiently high efficiency and produces a finely defined electron beam and an image forming apparatus comprising such electron-emitting devices and hence capable of producing highly defined, clear and bright images with high quality.

A second object of the present invention is to provide an image forming apparatus having a large display screen that can produce highly defined, clear and bright images even if the device electrodes of each electron-emitting device comprised therein is separated from each other by more than 3 $\mu$m and preferably more than tens of several $\mu$m.

A third object of the present invention is to provide a method of manufacturing an image forming apparatus that can produce finely defined, clear and bright images by using an electron source that comprises a large number of surface conduction electron-emitting devices that are free from the above identified problems.

In short, the present invention is intended to provide a novel surface conduction electron-emitting device that is free from the above identified problems of the prior art and can be used for producing a large and high quality electron source and an image forming apparatus using such an electron source as well as a method of manufacturing the same.

The present invention is also intended to provide an electron source comprising a large number of such surface conduction electron-emitting devices and an image forming apparatus using such an electron source as well as a method of manufacturing the same.

According to an aspect of the invention, there is provided an electron-emitting device comprising an electroconductive film including an electron-emitting region disposed between a pair of electrodes arranged on a substrate, characterized in that said electron-emitting region is formed close to one of a pair of steps produced by said electrodes and said substrate.

According to another aspect of the invention, there is provided an electron source comprising a plurality of electron-emitting devices arranged on a substrate, characterized in that the electron-emitting devices are those as defined above.

According to still another aspect of the invention, there is provided an image forming apparatus comprising an electron source and an image-forming member, characterized in that the electron source is the one as defined above.

According to a further aspect of the invention, there is provided a method of manufacturing an electron-emitting device comprising an electroconductive film including an electron-emitting region disposed between a pair of electrodes arranged on a substrate, said electron-emitting region being formed close to one of a pair of steps produced by said electrodes and said substrate, said method comprising a step of forming an electroconductive film for producing an electron-emitting region, characterized in that a solution containing component elements of said electroconductive film is sprayed through a nozzle in said step.

DETAILED DESCRIPTION OF THE PREFERRED EMBODIMENTS

Figure 1A:
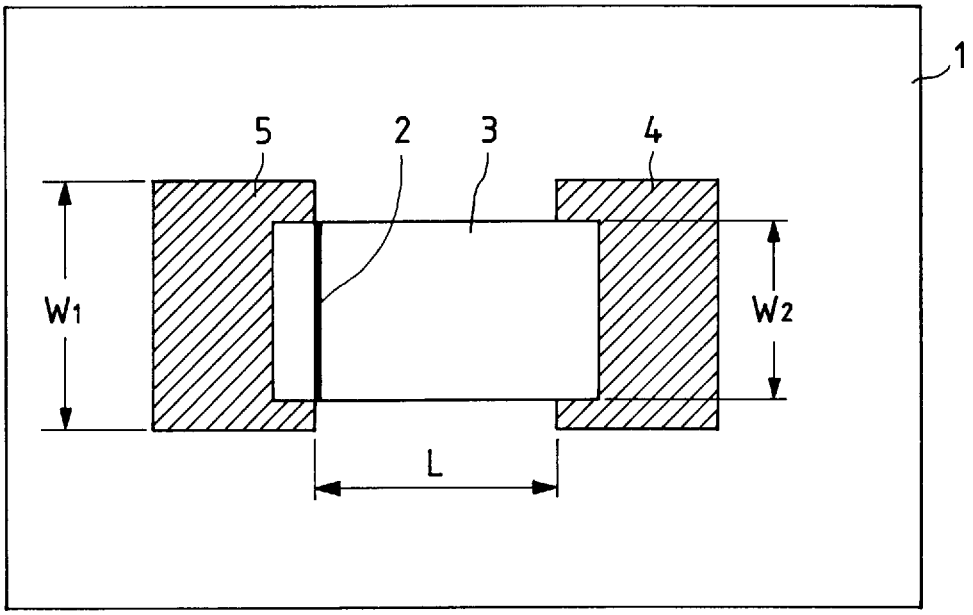
FIGS. 1A and 1B are schematic views of an embodiment of surface conduction electron-emitting device according to the invention, showing a first basic structure.

In a method of manufacturing an electron-emitting device according to the invention, the electroconductive film is made to have an area that poorly covers either one of the step portions formed by a pair of device electrodes at a location close to that step portion, preferably also close to the surface of the substrate so that fissures may be generated preferentially in that area to produce an electron-emitting region. Consequently, the electron-emitting region is located close to the device electrode of that step portion so that the electron beam emitted from the electron-emitting device is directly affected by the electric potential of that device electrode until it gets to the target with improved convergence. The convergence of the electron beam emitted from the electron-emitting region is greately improved if the device electrode located close to the electron-emitting region is held to a low electric potential.

Additionally, since the electron-emitting region is formed along the related device electrode and hence can be well controlled for its location and profile, it is not swerved unlike its counterpart of a conventional device and the electron beam emitted therefrom is similarly convergent as the electron beam emitted from a conventional electron-emitting device having a short distance between the device electrodes.

Still additionally, since an area that poorly covers the related step portion is arranged in the electroconductive thin film to preferentially generate fissures and produce an electron-emitting region there, the level of power required for energization forming is remarkably reduced as compared with a conventional device so that consequently the produced electron-emitting device operates much better than any comparable conventinal devices.

The electron-emitting device can be operated better for electron emission and the electron beam emitted from the device can be controlled better if a control electrode for operating the electron-emitting device is arranged on the device electrodes or close to the device itself. If a control electrode is arranged on the substrate, the trajectory of the electron beam can be made free from distortions attributable to a charged-up state of the substrate.

According to a method of manufacturing an electron-emitting device according to the invention, an electroconductive thin film is formed in an electron-emitting device by spraying a solution containing component elements of the electroconductive film. Such a method is safe and particularly suitable for producing a large display screen. It is preferable that the solution containing component elements of the electroconductive thin film is electrically charged or the device electrodes are held to different electric potentials during the step of spraying the solution in order to produce an area that poorly covers the related step portion so that fissures may be preferentially generated there to produce an electron-emitting region there because, with such an arrangement, the electron-emitting region may be formed along the related device electrode regardless of the profiles of the device electrodes and the electroconductive thin film and the electroconductive thin film may be strongly bonded to the substrate to produce a highly stable electron-emitting device.

Thus, electron-emitting devices manufactured by a method according to the invention are highly uniform particularly in terms of the location and the profile of the electron-emitting region and hence operate uniformly.

An electron source comprising a large number of electron-emitting devices according to the invention also operate uniformly and stably because the electron-emitting devices are manufactured by the above method. Additionally, since the power required for energization forming for the electron-emitting devices is not high, no siginificant voltage drop occurs in the process of energization forming so that consequently, the electron-emitting devices operate even more uniformly and stably.

As the location and the profile of the electron-emitting region can be controlled well if the distance separating the device electrodes is greater than several $\mu$m or several hundred $\mu$m, the electron-emitting region is completely free from the problem of swerving and poor convergence of electron beam and hence electron-emitting devices according to the invention can be manufactured at a high yield.

Consequently, an electron source that can generate highly convergent electron beams can be manufactured at low cost and a high yield.

Additionally, in an image forming apparatus according to the present invention, electron beams are highly converged as they collide with the image-forming member of the apparatus so that it can produce fine and clear images that are free from blurs particularly in terms of color. Since the electron-emitting devices comprised in the apparatus operate uniformly and efficiently, it is suited for a large display screen.

Now, the present invention will be described in greater detail by referring to preferred embodiments of electron-emitting device, of electron source comprising a large number of such electron-emitting devices and of image forming apparatus realized by using such an electron source.

An electron-emitting device according to the invention may have one of three different basic structures and may be manufactured basically with one of two different methods.

Embodiment 1

Figure 1B:
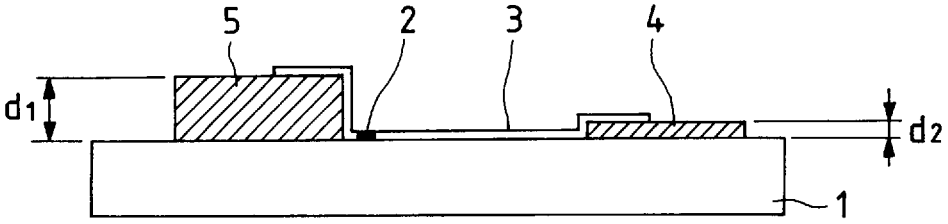

This embodiment is configured to show a first basic structure as schematically illustrated in FIGS. 1A and 1B. Note that, in FIGS. 1A and 1B, reference numerals 1, 2 and 3 respectively denote a substrate, an electron-emitting region and an electroconductive thin film including an electron-emitting region, whereas reference numerals 4 and 5 denote device electrodes.

Materials that can be used for the substrate 1 include quartz glass, glass containing impurities such as Na to a reduced concentration level, soda lime glass, glass substrate realized by forming an $SiO_2$ layer on soda lime glass by means of sputtering, ceramic substances such as alumina as well as Si.

While the oppositely arranged device electrodes 4 and 5 may be made of any highly conducting material, preferred candidate materials include metals such as Ni, Cr, Au, Mo, W, Pt, Ti, Al, Cu and Pd and their alloys, printable conducting materials made of a metal or a metal oxide selected from Pd, Ag, $RuO_2$, Pd—Ag and glass, transparent conducting materials such as $In_2O_3$—$SnO_2$ and semiconductor materials such as polysilicon.

The distance L separating the device electrodes, the length W1 of the device electrodes, the contour of the electroconductive film 3 and other factors for designing a surface conduction electron-emitting device according to the invention may be determined depending on the application of the device.

The distance L separating the device electrodes 4 and 5 is normally between several hundred angstroms and several hundred micrometers, although it is determined as a function of the performance of the aligner and the specific etching technique used in the photolithography process for the purpose of the invention as well as the voltage to be applied to the device electrodes, although a distance between several to several hundred micrometers is preferable because such a distance matches the exposing technique and the printing technique to be used for preparing a large display screen.

While the length W1 and the film thicknesses d1, d2 of the device electrodes 4 and 5 are typically determined as a function of the electric resistances of the electrodes and other factors that may be involved when a large number of such electron-emitting devices are used, the length W1 is preferably between several micrometers and hundreds of several micrometers and the film thicknesses d1, d2 of the device electrodes 2 and 3 are between hundreds of several angstroms and several micrometers.

A surface conduction electron-emitting device according to the invention has an electron-emitting region 2 located close to one of the device electrodes (or the device electrode 5 in FIGS. 1A and 1B). As will be described in greater detail hereinafter, such an electron-emitting region 2 can be formed by differentiating the heights of the step portions of the device electrodes. Such differentiation between the step portions can be achieved by using films having different thicknesses d1 and d2 for the device electrodes 5 and 4 respectively or, alternatively, by forming an insulation layer typically made of $SiO_2$ film under either one of the device electrodes.

The height of the step portion of each of the device electrodes is selected, taking the method of preparing the electroconductive thin film 3 and the morphology of the film 3 into consideration, in such way that the electroconductive thin film 3 shows a relatively high electric resistance and therefore a relatively reduced thickness due to poor step coverage or, if the electroconductive thin film is made of fine particles as will be described hereinafter, a relatively low density of fine particles in an area located close to the step portion of the device electrode having a greater thickness (or the step portion of the device electrode 5 in FIGS. 1A and 1B) if compared with the remaining area of the electroconductive thin film. The step portion of the higher device electrode has a height typically more than five times, preferably more than ten times, as large as the thickness of the electroconductive thin film 3.

The electroconductive thin film 3 is preferably a fine particle film in order to provide excellent electron-emitting characteristics. The thickness of the electroconductive thin film 3 is determined as a function of the electric resistance between the device electrodes 4 and 5 and the parameters for the forming operation that will be described hereinafter as well as other factors and preferably between several and several thousand angstroms, preferably between 10 and 500 angstroms. The electroconductive thin film 4 normally shows a resistance per unit surface area between $10^2$ and $10^7$ $\Omega/cm^2$.

The term a "fine particle film" as used herein refers to a thin film constituted of a large number of fine particles that may be loosely dispersed, tightly arranged or mutually and randomly overlapping (to form an island structure under certain conditions). If a fine particle film is used, the particle size is preferably between several and several hundred angstroms, preferably between 10 and 200 angstroms.

By forming device electrodes having respective step portions whose heights are different from each other, the electroconductive thin film 3 that is prepared in a subsequent step comes to show a good step coverage relative to the device electrode 4 having a low step portion and a poor step coverage relative to the device electrode 5 having a high step portion. Note that the area of the electroconductive thin film 3 that poorly covers the step portion is preferably located close to the surface of the substrate.

The electroconductive thin film 3 is made of a material selected from metals such as Pd, Ru, Ag, Au, Ti, In, Cu, Cr, Fe, Zn, Sn, Ta, W and Pb, oxides such as PdO, $SnO_2$, $In_2O_3$, PbO and $Sb_2O_3$, borides such as $HfB_2$, $ZrB_2$, $LaB_6$, $CeB_6$, $YB_4$ and $GdB_4$, carbides such as TiC, ZrC, HfC, TaC, SiC and WC, nitrides such as TiN, ZrN and HfN, semiconductors such as Si and Ge and carbon.

The electron-emitting region 2 contains fissures and electrons are emitted from these fissures. The electron-emitting region 2 containing such fissures and the fissures themselves are produced as a function of the thickness, the state and the material of the electroconductive thin film 3 and the parameters for carrying out an energization forming process for the electron-emitting region 2.

As described above, an area of the electroconductive thin film 3 is made to poorly covers the step portion of one of the device electrodes having a greater thickness at a position located close to the surface of the substrate by selecting an appropriate technique for preparing the electroconductive thin film in a subsequent step. With this arrangement, fissures can be generated preferentially in that area in the process of energization forming, which will be described hereinafter, to produce an electron-emitting region. As shown in FIGS. 1A and 1B, a substantially linear electron-emitting region 2 is formed along the straight step portion of the device electrode having a greater thickness at a position close to the surface of the substrate, although the location of the electron-emitting region 2 is not limited to that of FIGS. 1A or 1B.

The fissures may contain electroconductive fine particles having a diameter of several to hundreds of several angstroms. The fine particles are part of some or all of the elements constituting the electroconductive thin film 3. Additionally, the electron-emitting region 2 containing fissures and the neighboring areas of the electroconductive thin film 3 may contain carbon and carbon compounds.

Figure 2A:
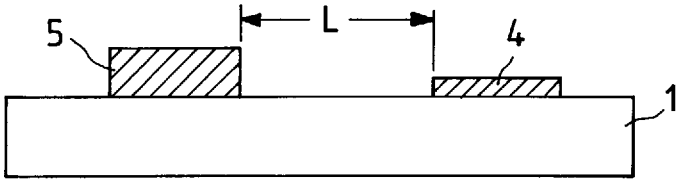
FIGS. 2A through 2C are schematic sectional views of the surface conduction electron-emitting device of FIGS. 1A and 1B in different manufacturing steps.
Figure 2B:
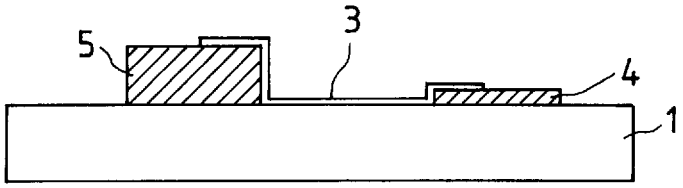
Figure 2C:
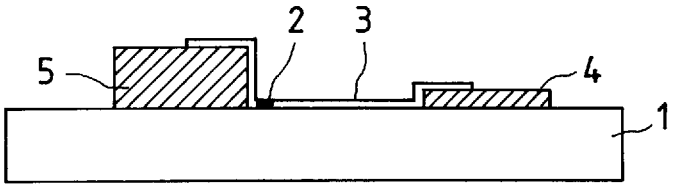

Now, a method of manufacturing a surface conduction electron-emitting device according to the invention and illustrated in FIGS. 1A and 1B will be described by referring to FIGS. 2A through 2C.

1) After thoroughly cleansing a substrate 1 with detergent and pure water, a material is deposited on the substrate 1 by means of vacuum deposition, sputtering or some other appropriate technique for a pair of device electrodes 4 and 5, which are then produced by photolithography. Then, the material of the electrodes is further deposited only on the device electrode 5, masking the other device electrode 4, to make the step portion of the device electrode 5 higher than that of the device electrode 4 (FIG. 2A).

2) An organic metal thin film is formed on the substrate 1 carrying thereon the pair of device electrodes 4 and 5 by applying an organic metal solution and leaving the applied solution for a given period of time. The organic metal solution may contain as a principal ingredient any of the metals listed above for the electroconductive thin film 3. Thereafter, the organic metal thin film is heated, baked and subsequently subjected to a patterning operation, using an appropriate technique such as lift-off or etching, to produce an electroconductive thin film 3 (FIG. 2B). While an organic metal solution is used to produce a thin film in the above description, an electroconductive thin film 3 may alternatively be formed by vacuum deposition, sputtering, chemical vapor phase deposition, dispersed application, dipping, spinner or some other technique.

3) Thereafter, the device electrodes 4 and 5 are subjected to a process referred to as "energization forming". More specifically, the device electrodes 4 and 5 are electrically energized by means of a power source (not shown) until a substantially linear electron emitting region 3 is produced at a position of the electroconductive thin film 3 near the step portion of the device electrode 5 (FIG. 2C) as an area where the electroconductive thin film is structurally modified. In other words, the electron-emitting region 2 is a portion of the electroconductive thin film 3 that is locally destructed, deformed or transformed as a result of energization forming to show a modified structure.

Figure 3A:
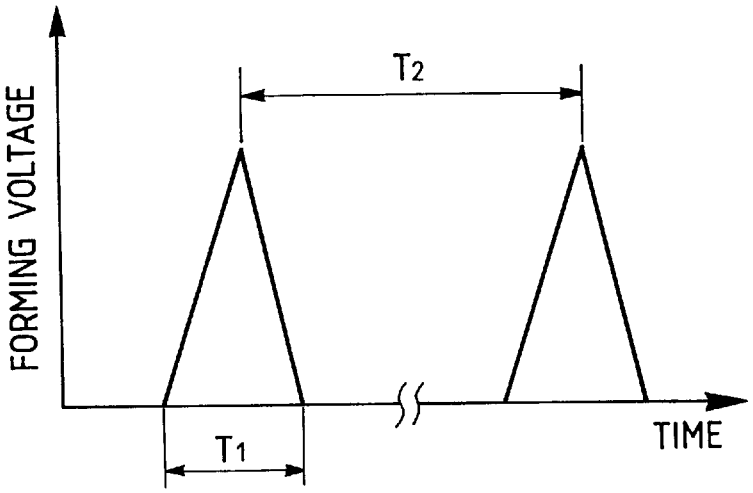
FIGS. 3A and 3B are graphs schematically showing voltage waveforms that can be used for an energization forming process.
Figure 3B:
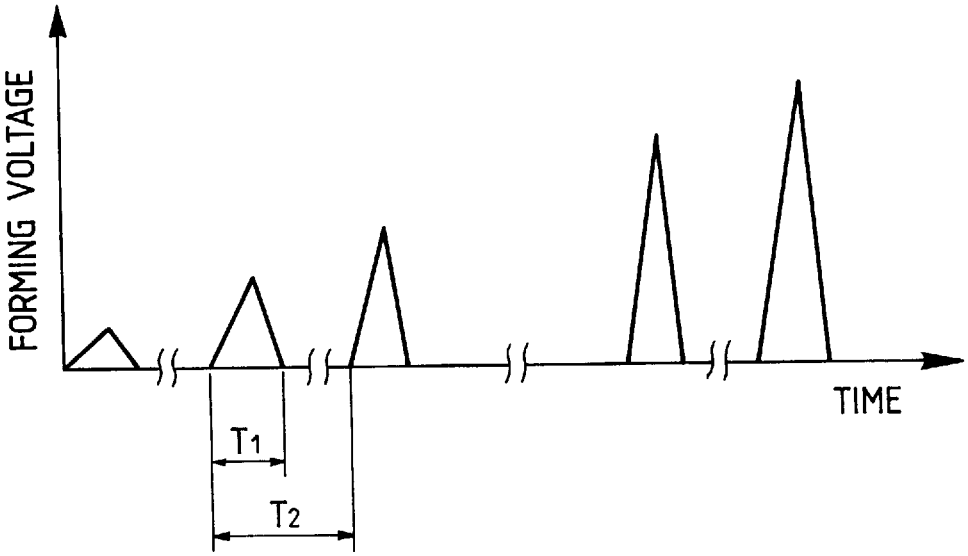

FIGS. 3A and 3B show two different pulse voltages that can be used for energization forming.

The voltage to be used for energization forming preferably has a pulse waveform. A pulse voltage having a constant height or a constant peak voltage may be applied continuously as shown in FIG. 3A or, alternatively, a pulse voltage having an increasing height or an increasing peak voltage may be applied as shown in FIG. 3B.

Firstly, a pulse voltage having a constant height will be described. In FIG. 3A, the pulse voltage has a pulse width T1 and a pulse interval T2, which are typically between 1 μsec. and 10 msec. and between 10 μsec. and 100 msec. respectively. The height of the triangular wave (the peak voltage for the energization forming operation) may be appropriately selected depending on the profile of the surface conduction electron-emitting device. The voltage is typically applied for tens of several minutes in vacuum of an appropriate degree. Note, however, that the pulse waveform is not limited to triangular and a rectangular or some other waveform may alternatively be used.

Now, a pulse voltage having an increasing height will be described. FIG. 3B shows a pulse voltage whose pulse height increases with time. In FIG. 3B, the pulse voltage has an width T1 and a pulse interval T2 that are substantially similar to those of FIG. 3A. The height of the triangular wave (the peak voltage for the energization forming operation) is increased at a rate of, for instance, 0.1V per step. Note again that the pulse waveform is not limited to triangular and a rectangular or some other waveform may alternatively be used.

The energization forming operation will be terminated as appropriately judged by measuring the current running through the device electrodes when a voltage that is sufficiently low and cannot locally destroy or deform the electroconductive thin film 3 is applied to the device during an interval T2 of the pulse voltage. Typically the energization forming operation is terminated when a resistance greater than 1M ohms is observed for the device current running through the electroconductive thin film 3 while applying a voltage of approximately 0.1V to the device electrodes.

4) After the energization forming operation, the device is preferably subjected to an activation process. An activation process is a process to be carried out in order to dramatically change the device current (film current) If and the emission current Ie.

In an activation process, a pulse voltage may be repeatedly applied to the device in a vacuum atmosphere. In this process, a pulse voltage is repeatedly applied as in the case of energization forming in an organic gas containing atmosphere. Such an atmosphere may be produced by utilizing the organic gas remaining in a vacuum chamber after evacuating the chamber by means of an oil diffusion pump or a rotary pump or by sufficiently evacuating a vacuum chamber by means of an ion pump and thereafter introducing the gas of an organic substance into the vacuum. The gas pressure of the organic substance is determined as a function of the profile of the electron-emitting device to be treated, the profile of the vacuum chamber, the type of the organic substance and other factors. The organic substances that can be suitably used for the purpose of the activation process include aliphatic hydrocarbons such as alkanes, alkenes and alkynes, aromatic hydrocarbons, alcohols, aldehydes, ketones, amines, organic acids such as, phenol, carbonic acids and sulfonic acids. Specific examples include saturated hydrocarbons expressed by general formula $C_nH_{2n+2}$ such as methane, ethane and propane, unsaturated hydrocarbons expressed by general formula $C_nH_{2n}$ such as ethylene and propylene, benzene, toluene, methanol, ethanol, formaldehyde, acetaldehyde, acetone, methylethylketone, methylamine, ethylamine, phenol, formic acid, acetic acid and propionic acid. As a result of this process, carbon and carbon compounds contained in the atmosphere are deposited on the device to remarkably change the device current If and the emission current Ic.

The activation process is terminated whenever appropriate, observing the device current If and the emission current Ie. The pulse width, the pulse interval and the pulse wave height are appropriately selected.

For the purpose of the invention, carbon and carbon compounds typically refer to graphite (including so-called highly oriented pyrolytic graphite (HOPG), pyrolitic graphite (PG) and glassy carbon (GC), of which HOPG has a nearly perfect crystal structure of graphite and PG contains crystal grains having a size of about 200 angstroms and has a somewhat disturbed crystal structure, while GC contains crystal grains having a size as small as 20 angstroms and has a crystal structure that is remarkably in disarray) and non-crystalline carbon (including amorphous carbon and a mixture of amorphous carbon and fine crystals of graphite) and the thickness of film formed by deposition is preferably less than 500 angstroms and more preferably less than 300 angstroms.

5) A surface conduction electron-emitting device according to the invention and have gone through the above listed steps is preferably subjected to a stabilizing step. This step is designed to evacuate vacuum container arranged for manufacturing the device to eliminate organic substances therefrom. Preferably, an oil free vacuum apparatus is used to evacuate the vacuum container so that it may not produce any oil that can adversely affect the performance of the electron-emitting device. Specific examples of oil free vacuum apparatus that can be used for the purpose of the invention include a sorption pump and an ion pump.

If an oil diffusion pump of a rotary pump is used to evacuate the container to utilize the organic gas generated from one or more than one ingredients the oil of such a pump in the preceding activation step, the partial pressure of the oil ingredients has to be held as low as possible. The partial pressure of the organic gas within the vacuum container is preferably less than $1\times10^{-8}$ Torr and more preferably less than $1\times10^{-10}$ Torr under the condition where carbon and carbon compounds are no longer deposited on the electron-emitting device. For evacuating the vacuum container, it is preferable that the entire container is heated so that the molecules of the organic substances adsorbed to the inner walls of the container and the electron-emitting device may easily move away therefrom and become removed from the container. The heating operation may preferably be conducted at 80° to 200° C. for more than five hours, although values for these parameters should be appropriately selected depending on the size and shape of the vacuum container, the configuration of the electron-emitting device and other considerations. High temperature is advantageous for causing the adsorbed molecules to move away. While the temperature range of 80° to 200° C. is selected to minimize the possible damage by heat to the electron source to be prepared in the container, a higher temperature may be recommended if the electron source is resistant against heat. It is also necessary to keep the overall pressure in the vacuum container as low as possible. It is preferably less than 1 to $3\times10^{-7}$ Torr and more preferably less than $1\times10^{-8}$.

After completing the stabilizing step, the electron-emitting device is preferably driven in an atmosphere same as that in which said stabilizing process is terminated, although a different atmosphere may also be used. So long as the organic substances are satisfactorily removed, a lower degree of vacuum may be permissible for a stabilized operation of the device.

With the use of such a vacuum condition, any additional deposition of carbon and carbon compounds is effectively prevented to stabilize both the device current If and the emission current Ie.

Embodiment 2

Now, a second basic structure of surface conduction electron-emitting device according to the invention will be described.

Figure 4A:
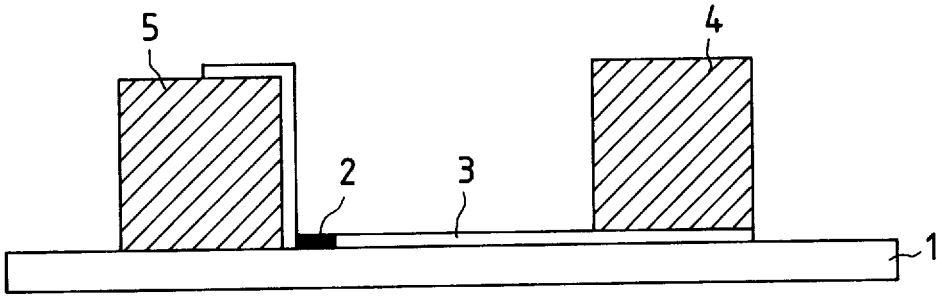
FIGS. 4A and 4B are schematic views of another embodiment of surface conduction electron-emitting device according to the invention, showing a second basic structure.
Figure 4B:
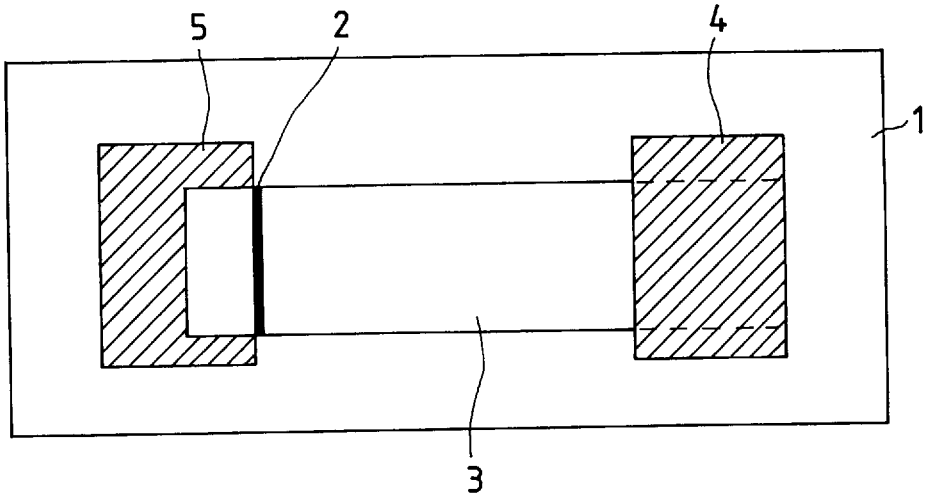

In a surface conduction electron-emitting device having this basic structure as shown in FIGS. 4A and 4B, an electron-emitting region is formed close to either one of a pair of device electrodes 4 and 5 having respective step portions whose heights are equal to each other.

As seen from FIGS. 4A and 4B, an electroconductive thin film 3 is formed on the device electrode 5 and under the other device electrode 4. Thus, a step is produced on the electroconductive thin film only on the device electrode 5 and, consequently, an electron-emitting region 2 is formed at a position close to the device electrode 5 as a result of energization forming.

As described above by referring to the first embodiment, the relationship between the height of the device electrode 5 and the thickness of the electroconductive thin film 3 is preferably such that the device electrode 5 is more than five time, preferably more than ten times, greater than the thickness of the electroconductive thin film 3. The remaining requirements of the configuration of the first embodiment are mostly applicable to the second embodiment.

While the device electrodes 4 and 5 may have different heights, they are preferably equal in the height from the manufacturing point of view.

A method of manufacturing a surface conduction electron-emitting device having a configuration as illustrated in FIGS. 4A and 4B will be described by referring to FIGS. 31A through 31D.

Figure 31A:
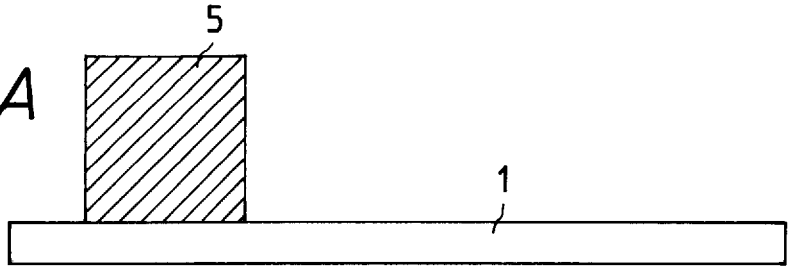
FIGS. 31A through 31D are schematic sectional views of the surface conduction electron-emitting device of Example 5 having the second basic structure, the device being shown in different manufacturing steps.

1) After thoroughly cleansing an insulating substrate 1 with detergent and pure water, a material is deposited thereon by means of vacuum deposition, sputtering or some other appropriate technique for device electrodes, only a device electrode 5 is produced on the insulating substrate 1 by photolithography (FIG. 31A).

Figure 31B:
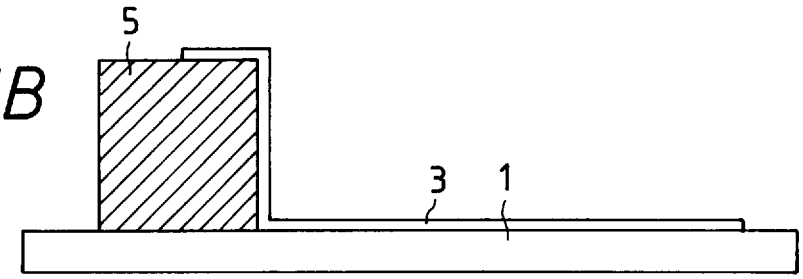

2) An organic metal thin film is formed on the substrate 1 carrying thereon the device electrode 5 by applying an organic metal solution and leaving the applied solution for a given period of time. The organic metal solution may contain as a principal ingredient any of the metals listed above for the electroconductive thin film 3. Thereafter, the organic metal thin film is heated, baked and subsequently subjected to a patterning operation, using an appropriate technique such as lift-off or etching, to produce an electroconductive thin film 3 (FIG. 31B). While an organic metal solution is used to produce a thin film in the above description, an electroconductive thin film 3 may alternatively be formed by vacuum deposition, sputtering, chemical vapor phase deposition, dispersed application, dipping, spinner or some other technique.

Figure 31C:
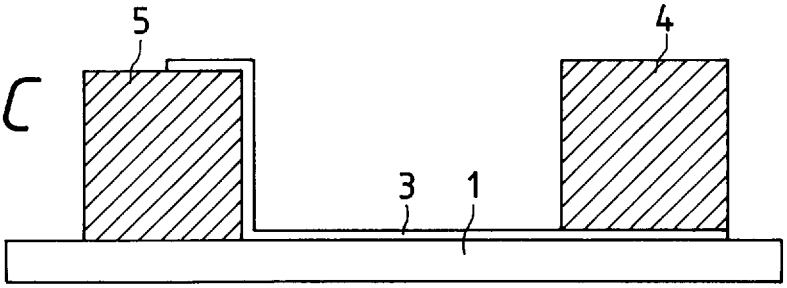

3) Another device electrode 4 is formed on the electroconductive thin film 3 at a position separated from the device electrode 5 (FIG. 31C). The height of the device electrode 4 may be same as or different from that of the device electrode 5.

4) Thereafter, the device electrodes 4 and 5 are subjected to a process referred to as "energization forming". More specifically, the device electrodes 4 and 5 are electrically energized by means of a power source (not shown) until a substantially linear electron-emitting region 3 is produced at a position of the electroconductive thin film 3 near the step portion of the device electrode 5 (FIG. 31D) as an area where the electroconductive thin film is structurally modified. In other words, the electron-emitting region 2 is a portion of the electroconductive thin film 3 that is locally destructed, deformed or transformed as a result of energization forming to show a modified structure.

The subsequent steps are same as those of Embodiment 1 and therefore will not be described here any further.

Embodiment 3

In a surface conduction electron-emitting device according to the invention, an electron-emitting region 2 is formed at a position close to either one of a pair of device electrodes (device electrode 5 in FIGS. 1A and 1B). Such an electron-emitting region can be produced in either one of the first and second manufacturing method according to the invention, which will be described in greater detail hereinafter.

Now, a surface conduction electron-emitting device according to the invention and illustrated in FIGS. 1A and 1B will be described by referring to FIGS. 2A through 2C that shows the device in different manufacturing steps.

1) After thoroughly cleansing a substrate 1 with detergent and pure water, a material is deposited on the substrate 1 by means of vacuum deposition, sputtering or some other appropriate technique for a pair of device electrodes 4 and 5, which are then produced by photolithography. Then, the material of the electrodes is further deposited only on the device electrode 5, masking the other device electrode 4, to make the step portion of the device electrode 5 higher than that of the device electrode 4 (FIG. 2A).

Figure 6A:
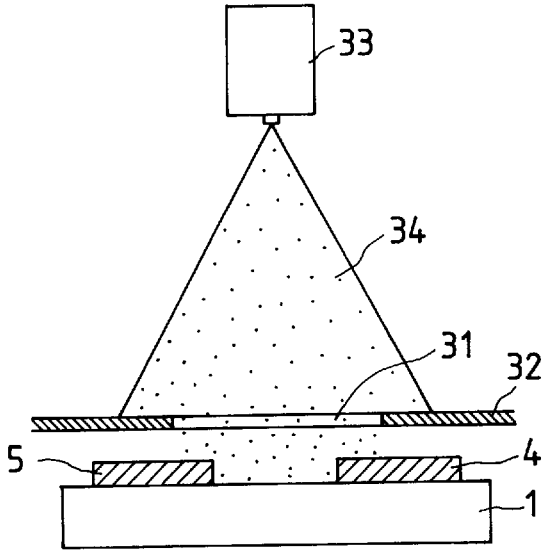
FIG. 6A is a schematic view of a surface conduction electron-emitting device according to the invention, illustrating a first method of manufacturing the same.

2) An organic metal thin film is formed on the insulating substrate by spraying an organic metal solution through a nozzle 33 with a mask member 32 interposed therebetween as shown in FIG. 6A. The organic metal solution contains organic metal compounds of the metals that are principal components of the electroconductive thin film 3 to be formed there. Thereafter, the organic metal thin film is heated and baked to produce a patterned electroconductive thin film 3 (FIG. 2B). Note that the components in FIG. 6A that are same or similar to those of FIGS. 1A and 1B are denoted by the same reference symbols. In FIG. 6A, reference numeral 31 denotes an area where organic metal solution fine particles are applied and reference numeral 34 denotes organic metal solution fine particles.

While the organic metal solution is sprayed with a mask member 32 interposed between the nozzle 33 and the substrate 1 in order to omit an independent patterning step in the above description, an electroconductive thin film 3 may alternatively be formed without such a mask member 32 by using an appropriate photolithography technique such as lift-off or etching.

3) Thereafter, the device electrodes 4 and 5 are subjected to a process referred to as "energization forming". More specifically, the device electrodes 4 and 5 are electrically energized by means of a power source (not shown) until a substantially linear electron-emitting region 3 is produced at a position of the electroconductive thin film 3 near the step portion of the device electrode 5 (FIG. 2C) as an area where the electroconductive thin film is structurally modified. In other words, the electron-emitting region 2 is a portion of the electroconductive thin film 3 that is locally destructed, deformed or transformed as a result of energization forming to show a modified structure.

The steps subsequent to the energization forming step are same as those of Embodiment 1 and therefore will not be described here any further.

As described above, with the first method of manufacturing an electron-emitting device according to the invention, a pair of device electrodes 4 and 5 are so formed that their step portions show different heights and a solution containing component elements of the electroconductive thin film 3 is sprayed onto them through a nozzle.

As the step portions of the device electrodes are formed to show different heights with the first manufacturing method, the electroconductive thin film 3 formed thereafter is made to show a good step coverage for the device electrode 4 having a low step portion and a poor step coverage for the device electrode 5 having a high step portion. Thus, in the above described energization forming step, fissures can be preferentially generated in the poor step coverage area of the electroconductive thin film 3 to produce there an electron-emitting region 2, which is substantially linear and located close to the step portion of the device electrode 5 as shown in FIGS. 1A and 1B.

Figure 43:
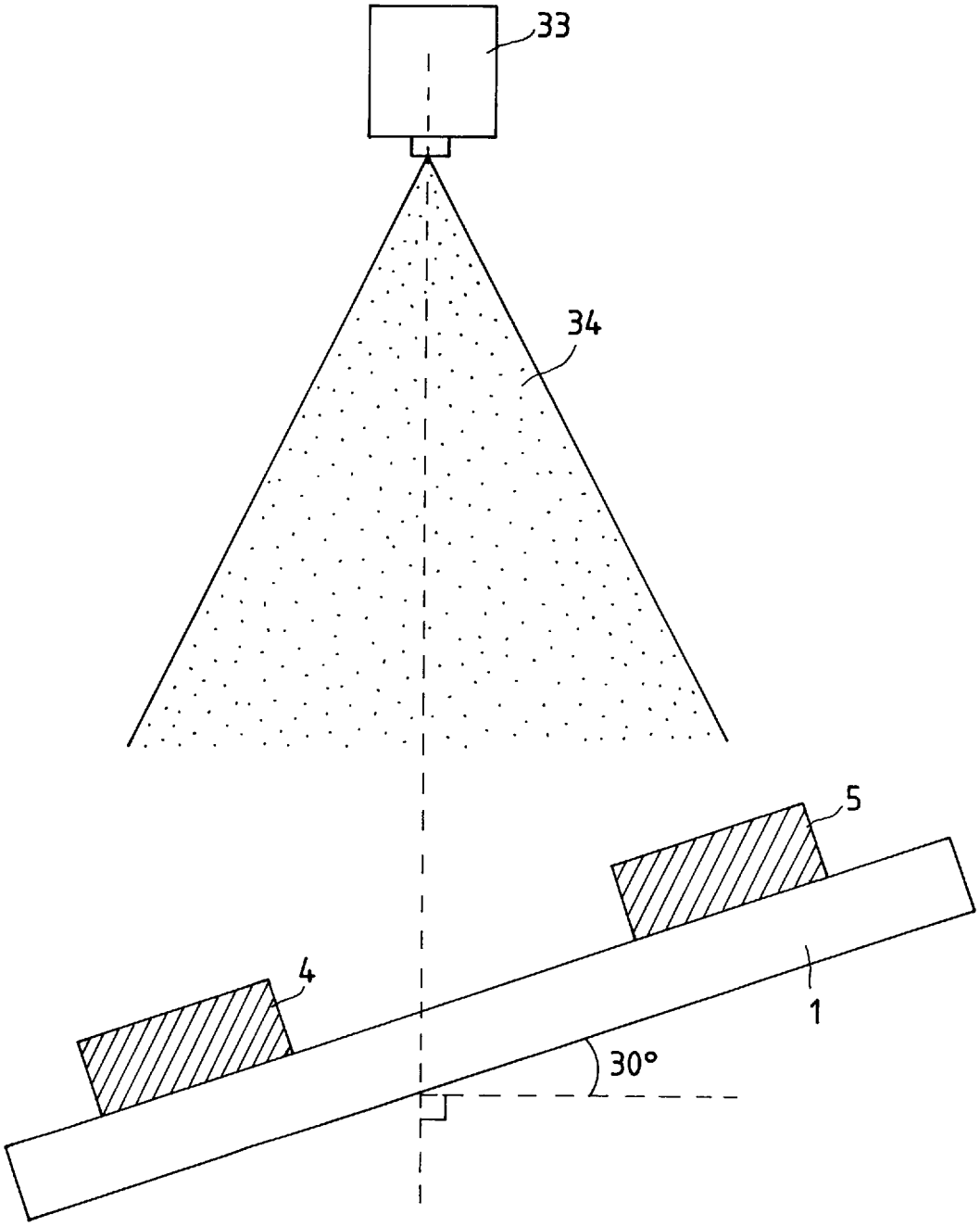
FIG. 43 is a schematic sectional view of the surface conduction electron-emitting device of Example 12 in a manufacturing step.

With the first manufacturing method of the invention, an electroconductive thin film may be formed so as to show a good step coverage for one of the device electrodes and a poor step coverage for the other device electrode by tilting the substrate 1 (or the nozzle 33) of FIG. 6A as shown in FIG. 43 without differentiating the heights of the step portions of the device electrodes 4 and 5 unlike those of the device electrodes 4 and 5 of the electron-emitting device of FIGS. 1A and 1B. Note that the components in FIG. 43 that are similar to those of FIG. 6A are denoted by the same reference symbols.

Thus, with such a manufacturing method, since the electron-emitting device is prepared by means of a process exactly same as that of preparing a device comprising device electrodes whose step portions have different heights, a substantially linear electron-emitting region is formed in the energization forming step at a position close to the step portion of one of the device electrodes without differentiating the heights of the step portions of the device electrodes to consequently reduce the number of steps necessary for preparing the device electrodes and make the method advantageous.

Now, electrostatic spraying to be used for the purpose of the invention will be described by referring to FIG. 6B.

Figure 6B:
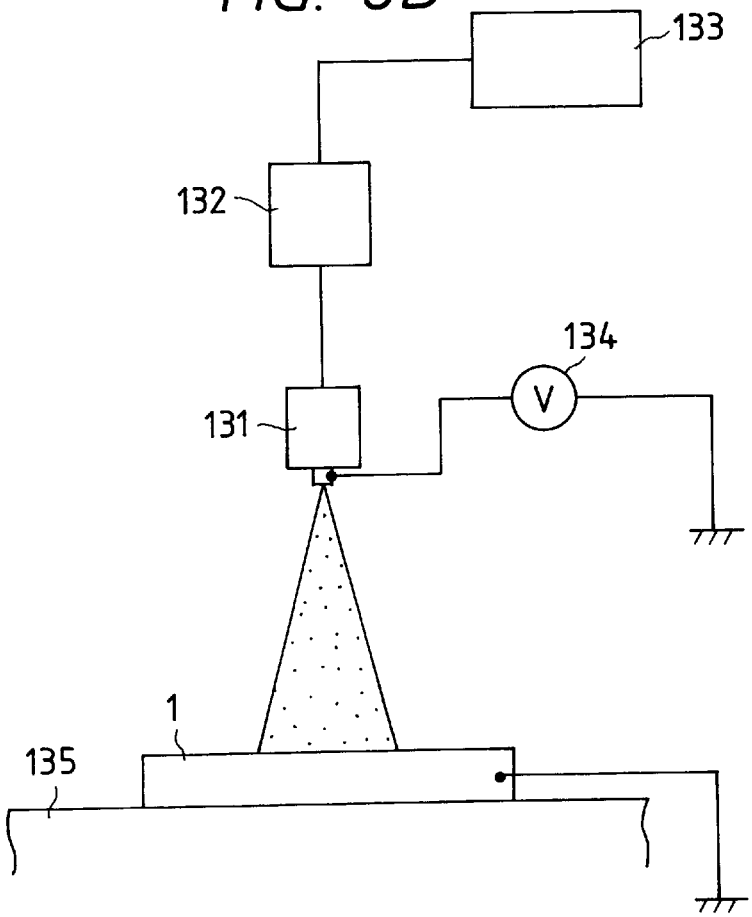
FIG. 6B is a schematic view of a surface conduction electron-emitting device according to the invention, illustrating a second method of manufacturing the same.

FIG. 6B schematically illustrates the principle of electrostatic spraying. An electrostatic spraying system that can be used for the purpose of the invention comprises a nozzle 131 for spraying an organic metal solution, a generator for atomizing an organic metal solution 132, a tank 133 for storing an organic metal solution, a high voltage DC power source for electrically charging fine particles of organic metal atomized in the generator 134 to a level of −10 to −100 kV and a table 135 for carrying a substrate 1. The nozzle 131 can be so operated as to two-dimensionally scan the upper surface of the substrate 1 at a constant rate. The substrate 1 is grounded.

With the above arrangement, negatively charged fine organic metal solution particles are sprayed through the nozzle 131 and move with an accelerated speed until they collide with the grounded substrate 1 and become deposited there to produce an organic metal film that is more cohesive than a film produced by any other spray method.

The electroconductive thin film can be subjected to a patterning operation by means of photolithography as described above by referring to FIG. 6A and, if a mask member 32 as shown in FIG. 6A is used with electrostatic spraying, a highly cohesive, tight and uniform film can be produced by applying a voltage between the nozzle 33 and the mask member 32 to electrically charge fine particles of organic metal solution 34 sprayed from the nozzle 33 to a level of 10 to 100 kV to accelerate them before they collide with the substrate 1.

A surface conduction electron-emitting device according to the invention can be prepared by a second method of spraying a solution containing component elements of the electroconductive thin film through a nozzle, applying a voltage to a pair of device electrode formed on a substrate.

Figure 5A:
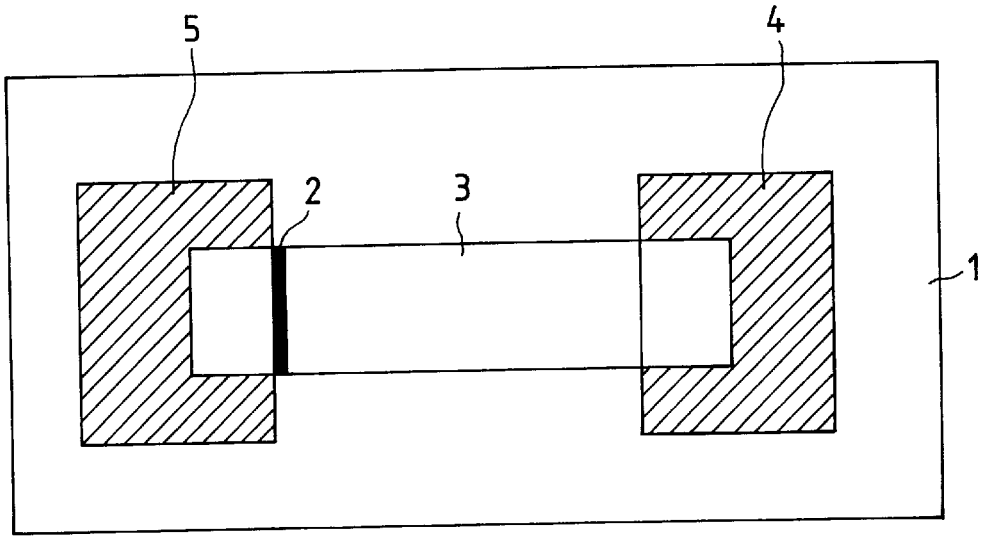
FIGS. 5A and 5B are schematic views of still another embodiment of surface conduction electron-emitting device according to the invention obtained by a first mode of manufacturing method according to the invention.
Figure 5B:
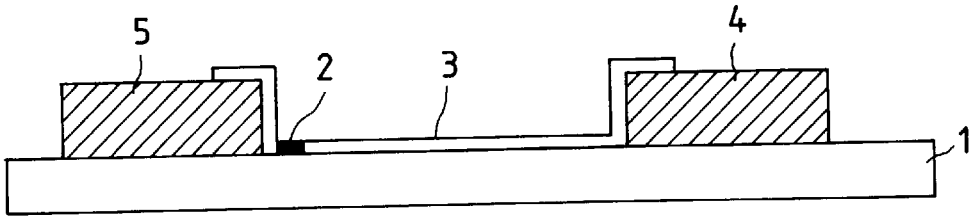

More specifically, with the second method, unlike the first basic arrangement of forming a pair of device electrodes that are arranged asymmetrically (Example 1), a pair of device electrodes appear identical physically appear identical as shown in FIGS. 5A and 5B and differentiated only by the electric potentials of the electrodes so that the electroconductive thin film formed from an organic metal solution sprayed through a nozzle is made more cohesive and tight for the device electrode with a lower electric potential than for the device electrode with a higher electric potential and provides a poor step coverage for the device electrode with a higher electric potential. Consequently, a substantially linear electron-emitting region 2 is formed at a position close to the step portion of the device electrode with a lower electrode as shown in FIGS. 5A and 5B.

For spraying a solution containing component elements of the electroconductive thin film from a nozzle with either one of the first and second manufacturing methods, it is preferable to provide an electric potential difference between the nozzle and the substrate or enhance the adhesion between the substrate and the device electrodes and the electroconductive thin film to make the prepared surface conduction electron-emitting device operate more stably.

As described above, with a manufacturing method according to the invention, a substantially linear electron-emitting region is formed along one of the device electrodes of a surface conduction electron-emitting device at a position close to the step portion of the electrode and the surface of the substrate if the device electrodes are separated by a large distance so that the electron-emitting region can be prepared uniformly in terms of position and profile and the surface conduction electron-emitting device operates excellently as will be described hereinafter.

Additionally, since a nozzle is used to spray an organic metal solution onto a substrate to produce an electroconductive thin film with a manufacturing method according to the invention and hence the substrate is not rotated unlike the case where a spinner is used with a conventional manufacturing method, it is advantageous and effective when a large number of such surface conduction electron-emitting devices are arranged to produce an electron source because a large substrate carrying a number of surface conduction electron-emitting device is made to rotate with a risk of damaging itself and an electron source and an image forming apparatus incorporating such an electron source can be manufactured with relatively simple equipment.

Embodiment 4

Now, a fourth embodiment of surface conduction electron-emitting device according to the invention and having the third basic structure will be described below. This embodiment of surface conduction electron-emitting device comprises a pair of device electrodes and an electroconductive thin film including an electron-emitting region arranged close to one of the device electrodes and additionally provided with a control electrode. In this embodiment, the control electrode may be arranged on one of the device electrodes or, alternatively, it may be arranged at a peripheral area of the device electrode or the electroconductive thin film.

Figure 7A:
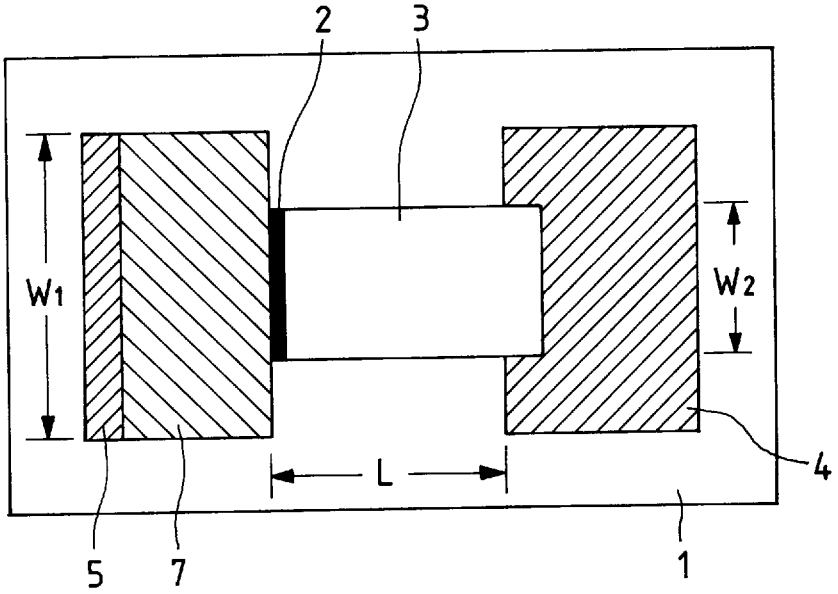
FIGS. 7A and 7B are schematic views of another embodiment of surface conduction electron-emitting device according to the invention, showing a third basic structure.
Figure 7B:
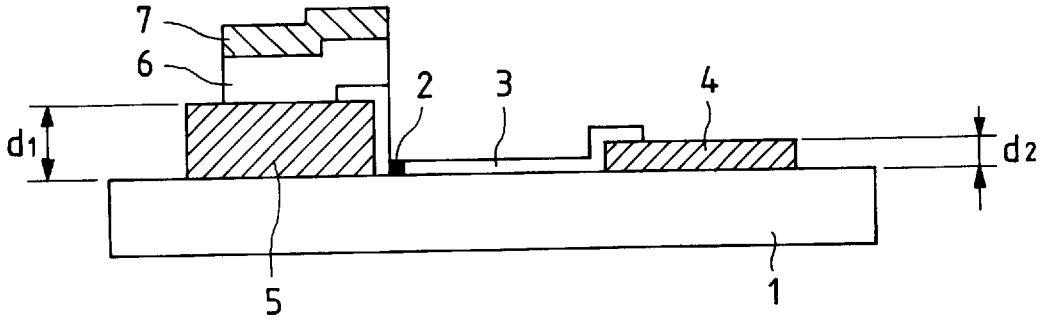

FIGS. 7A and 7B show a surface conduction electron-emitting device according to the invention where a control electrode is arranged on one of the device electrodes. Referring to FIGS. 7A and 7B, the surface conduction electron-emitting device comprises a substrate 1, an electroconductive thin film 3 including an electron-emitting region 2, a pair of device electrodes 4 and 5, an insulation layer 6 and a control electrode 7.

The control electrode is arranged on the device electrode 5 and the electroconductive thin film 3 with an insulation layer 6 interposed therebetween and made of a material popularly used for electrodes.

Possible relations among the electric potentials of the components for driving the surface conduction electron-emitting device will be described below.

The device electrode 5 is held to a potential lower than that of the device electrode 4 and the control electrode 7 is held to a potential higher than that of the device electrode 4.

Under this condition, electrons emitted from the electron-emitting region 2 located close to the device electrode 5 move toward an anode (not shown), following a trajectory directed from the lower potential device electrode 5 to the higher potential device electrode 4 as described earlier and, since the control electrode 7 is located close to the electron-emitting region 2, the moving electrons are effectively effected by the electric potential of the control electrode 7. More specifically, since the electric potential of the control electrode 7 is higher than the device electrodes, the trajectory of electrons is modified so as to make the moving electrons to be less attracted by the electroconductive thin film 3 and the device electrode 4 and more effectively drawn toward the anode. As a result, the rate of electron emission increases as compared with that of electron emission when the control electrode 7 is not provided. If, on the other hand, the electric potential of the control electrode 7 is made lower than that of the device electrode 4 and equal to that of the device electrode 5, the net effect will be equivalent to the one obtained when the device electrode 5 is made tall to improve the convergence of electrons.

If the electric potential of the device electrode 5 is made higher than that of the device electrode 4 and that of the control electrode 7 is made equal to that of the device electrode 4, electrons emitted from the electron-emitting region 2 located close to the device electrode 5 toward the device electrode 5 are effectively cut off by the control electrode 7.

Figure 12:
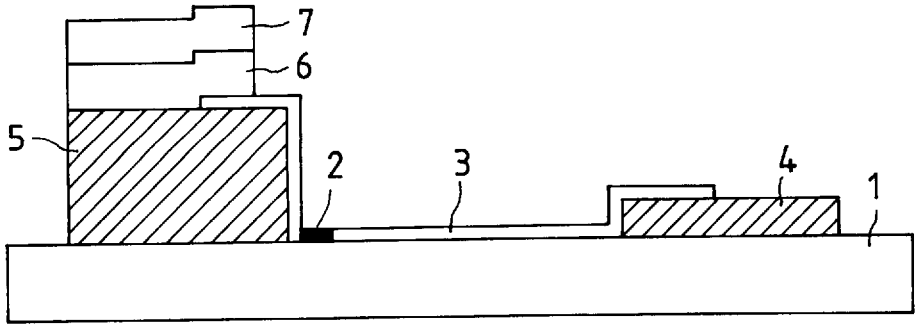
FIG. 12 is a block diagram of a gauging system for determining the electron emitting performance of a surface conduction electron-emitting device having the third basic structure.

Since the electron-emitting region is located close to one of the device electrodes and the control electrode 7 is arranged on that device electrode with an insulation layer interposed therebetween, the trajectory of electrons emitted from the electron-emitting region 2 can be effectively controlled by means of the control electrode 7. While the control electrode has an end surface that agrees with those of the device electrode 5 and the insulation layer 6 in FIG. 7A, the profile of the control electrode 7 is not limited thereto and those of the insulation film 6 and the control electrode 7 may be shifted to the left from that of the device electrode 5 in FIG. 7A (FIG. 12).

Embodiment 5

Figure 9A:
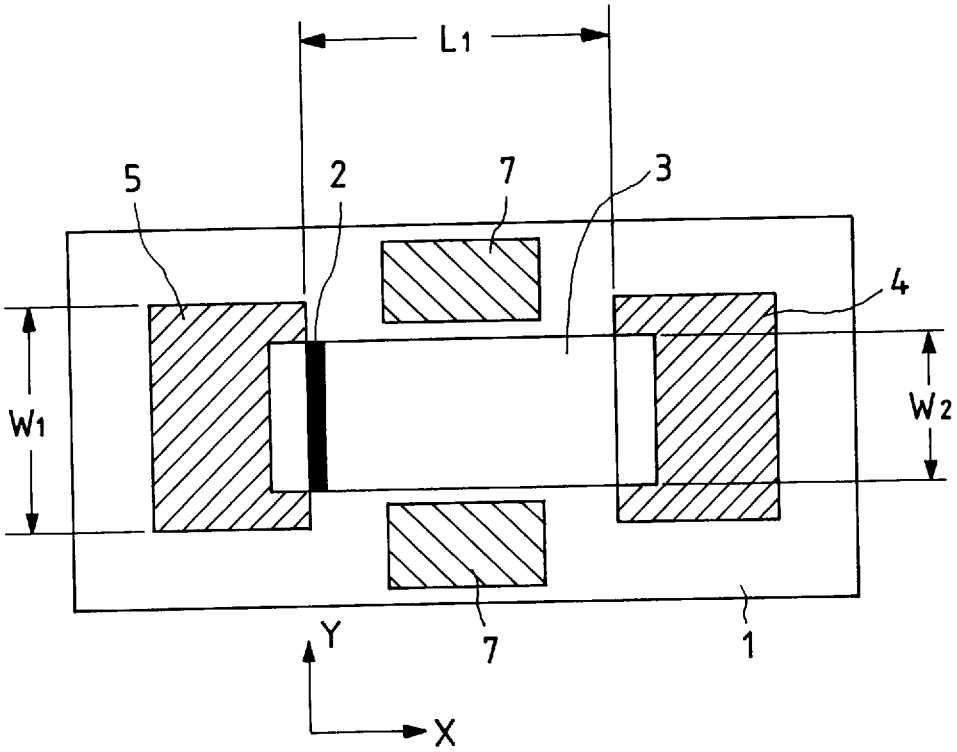
FIGS. 9A and 9B are schematic views of another embodiment of surface conduction electron-emitting device according to the invention, showing a modified third basic structure.
Figure 9B:
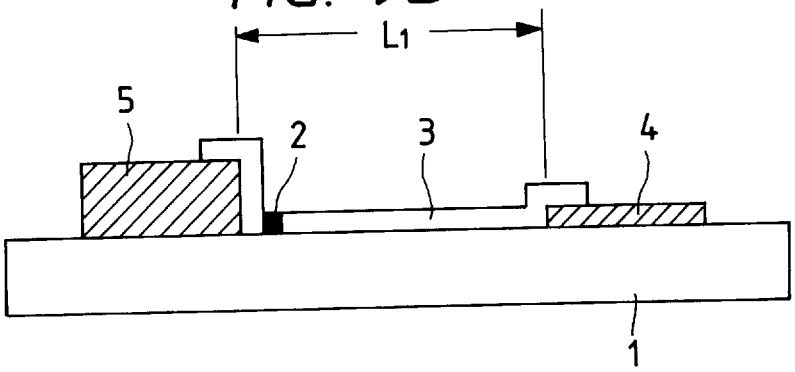

In this embodiment, the control electrode is formed on the substrate as shown in FIGS. 9A and 9B. The components that are same or similar to those of the embodiment of FIGS. 7A and 7B are denoted by the same reference symbols. In the following description, X denotes the direction of L1 and Y denotes a direction perpendicular to X.

Referring to FIGS. 9A and 9B, the control electrode 7 is formed on the substrate 1. The control electrode 7 may be placed between the device electrodes as shown or, alternatively, it may be so arranged as to surround the device electrodes and the electroconductive thin film. It may be electrically connected to either one of the device electrodes. Assume here that the control electrode is arranged in a manner as shown in FIGS. 9A and 9B and the electric potential of the device electrode 5 is lower than that of the device electrode 4 while the electric potential of the control electrode 7 is equal to that of the device electrode 5.

Then, electrons emitted from the electron-emitting region 2 move toward the higher potential device electrode 4 along the X-direction and, if no voltage is applied to the control electrode 7, spread in the Y-direction. However, since the control electrode 7 is held to a relatively low electric potential, the spread of electrons in the Y-direction is suppressed to improve the convergence. Additionally, if no voltage is applied to the control electrode 7 and the substrate is electrically insulated, the electric potential of the insulated substrate is unstable and emitted electrons are affected by the electric potential of the substrate to swerve the trajectory of emitted electrons so that, if the electron-emitting device is used in an image display apparatus, the light emitting spot of the display screen of the apparatus that provides the target of electrons from the electron-emitting device may change its profile to degrade the image displayed on the screen. Such a problem is eliminated by applying an appropriate voltage to the control electrode 7 to stabilize the electric potential of the substrate 1 and hence the trajectory of emitted electrons and consequently improve the quality of the image on the screen. Note that the control electrode 7 may alternatively be arranged on one of the device electrodes and around the device electrodes and the electroconductive thin film.

Now, a method of manufacturing an surface conduction electron-emitting device comprising a control electrode 7 will be described below by referring to a case where the control electrode is formed on one of the device electrodes and another case where the control electrode is formed on the substrate.

Case 1: The control electrode is formed on one of the device electrodes.

A surface conduction electron-emitting device shown in FIGS. 7A and 7B is manufactured by a method as illustrated in FIGS. 8A through 8D.

1) After thoroughly cleansing a substrate 1 with detergent and pure water, a material is deposited on the substrate 1 by means of vacuum deposition, sputtering or some other appropriate technique for a pair of device electrodes 4 and 5, which are then produced by photolithography. Then, the material of the electrodes is further deposited only on the device electrode 5, masking the other device electrode 4, to make the step portion of the device electrode 5 higher than that of the device electrode 4 (FIG. 3A).

Figure 8A:
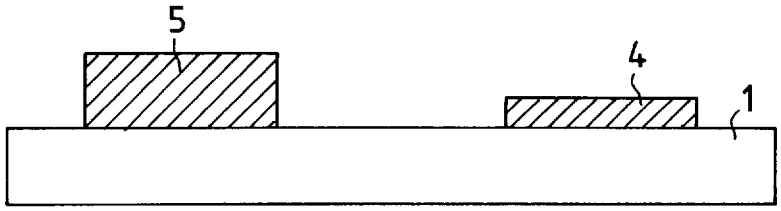
FIGS. 8A through 8D are schematic sectional views of the surface conduction electron-emitting device of FIGS. 7A and 7B in different manufacturing steps.
Figure 8B:
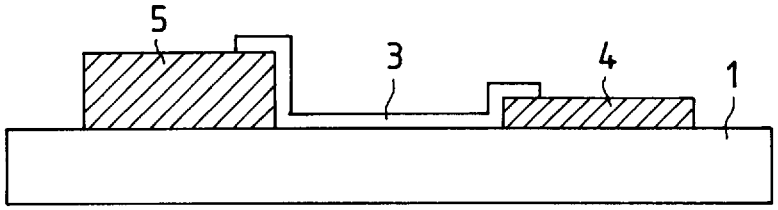

2) An organic metal thin film is formed on the substrate 1 carrying thereon the pair of device electrodes 4 and 5 by applying an organic metal solution and leaving the applied solution for a given period of time. The organic metal solution may contain as a principal ingredient any of the metals listed above for the electroconductive thin film 3. Thereafter, the organic metal thin film is heated, baked and subsequently subjected to a patterning operation, using an appropriate technique such as lift-off or etching, to produce an electroconductive thin film 3 (FIG. 8B). While an organic metal solution is used to produce a thin film in the above description, an electroconductive thin film 3 may alternatively be formed by vacuum deposition, sputtering, chemical vapor phase deposition, dispersed application, dipping, spinner or some other technique.

Figure 8C:
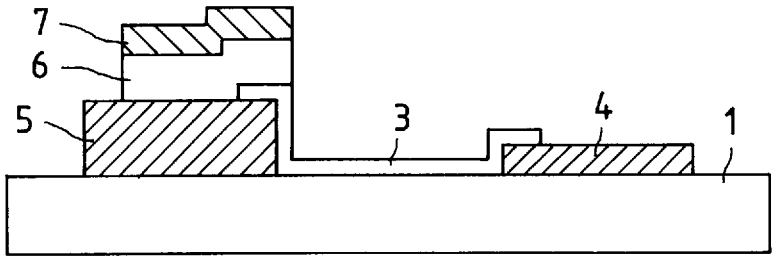
Figure 8D:
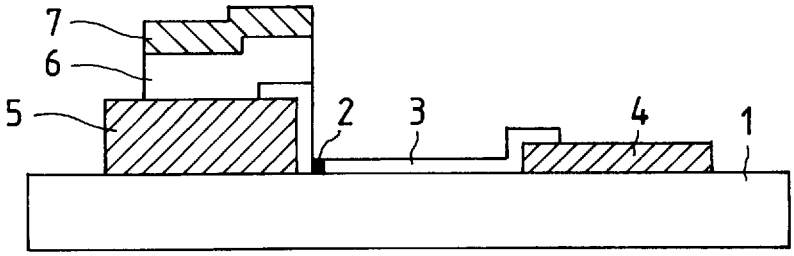

3) After depositing a material for an insulation layer on the substrate 1 that carries a pair of device electrodes 4 and 5 and an electroconductive thin film 3 by vacuum deposition or sputtering, a mask is formed only on the device electrode 5 having a step portion higher than that of the other device electrode 4 by photolithography and an insulation layer 6 having a desired profile is produced by etching, utilizing the mask. Note that the insulation layer 6 does not entirely cover the device electrode 5 and should have a profile that provides appropriate electric contact necessary for applying a voltage to the device electrode. Then, all the area other than the insulation layer 6 is masked and a control electrode 7 is formed on the insulation layer 6 by vacuum deposition or sputtering (FIG. 8C).

4) Thereafter, the device electrodes 4 and 5 are subjected to a process referred to as "energization forming". More specifically, the device electrodes 4 and 5 are electrically energized by means of a power source (not shown) until a substantially linear electron-emitting region 3 is produced at a position of the electroconductive thin film 3 near the step portion of the device electrode 5 (FIG. 8D) as an area where the electroconductive thin film is structurally modified. In other words, the electron-emitting region 2 is a portion of the electroconductive thin film 3 that is locally destructed, deformed or transformed as a result of energization forming to show a modified structure.

The steps subsequent to the energization forming step are same as those of Embodiment 1 and therefore will not be described here any further.

Case 2: The control electrode is formed on the substrate.

Figure 10A:
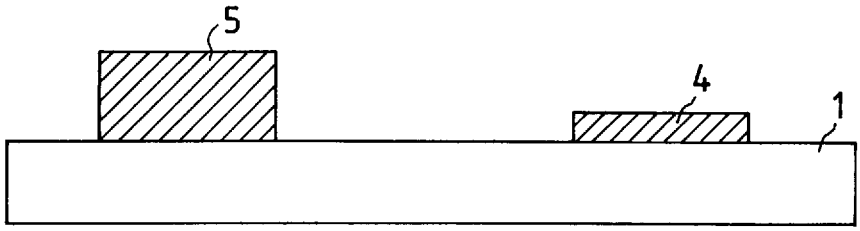
FIGS. 10A to 10C are schematic sectional views of the surface conduction electron-emitting device of FIGS. 9A and 9B in different manufacturing steps.
Figure 10B:
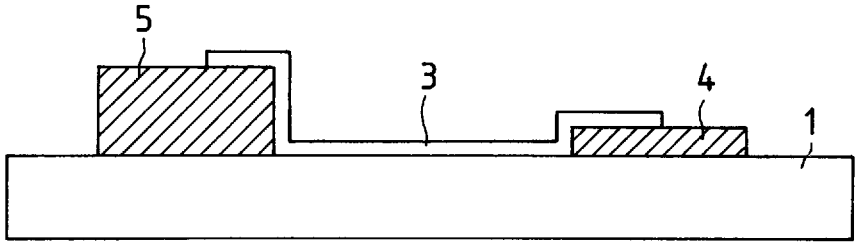
Figure 10C:
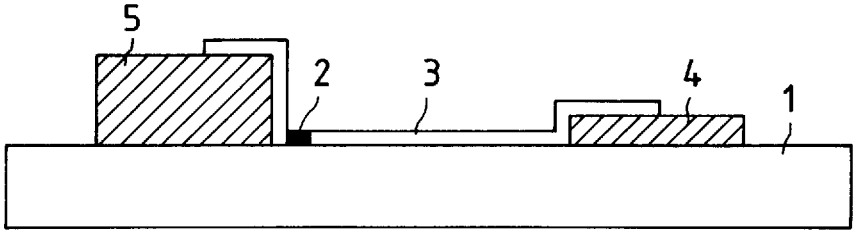

A surface conduction electron-emitting device shown in FIGS. 9A and 9B is manufactured by a method as illustrated in FIGS. 10A through 10C.

1) After thoroughly cleansing a substrate 1 with detergent and pure water, a material is deposited on the substrate 1 by means of vacuum deposition, sputtering or some other appropriate technique for a pair of device electrodes 4 and 5, which are then produced by photolithography. Then, the material of the electrodes is further deposited only on the device electrode 5, masking the other device electrode 4, to make the step portion of the device electrode 5 higher than that of the device electrode 4. At the same time, a control electrode 7 is formed on the insulating substrate 1 by photolithography like the device electrodes 4 and 5 (FIG. 10A).

2) An organic metal thin film is formed on the substrate 1 carrying thereon the pair of device electrodes 4 and 5 by applying an organic metal solution and leaving the applied solution for a given period of time. The organic metal solution may contain as a principal ingredient any of the metals listed above for the electroconductive thin film 3. Thereafter, the organic metal thin film is heated, baked and subsequently subjected to a patterning operation, using an appropriate technique such as lift-off or etching, to produce an electroconductive thin film 3 (FIG. 10B). While an organic metal solution is used to produce a thin film in the above description, an electroconductive thin film 3 may alternatively be formed by vacuum deposition, sputtering, chemical vapor phase deposition, dispersed application, dipping, spinner or some other technique.

3) Thereafter, the device electrodes 4 and 5 are subjected to a process referred to as "energization forming". More specifically, the device electrodes 4 and 5 are electrically energized by means of a power source (not shown) until a substantially linear electron emitting-region 3 is produced at a position of the electroconductive thin film 3 near the step portion of the device electrode 5 (FIG. 10C) as an area where the electroconductive thin film is structurally modified. In other words, the electron-emitting region 2 is a portion of the electroconductive thin film 3 that is locally destructed, deformed or transformed as a result of energization forming to show a modified structure.

The steps subsequent to the energization forming step are same as those of Embodiment 1 and therefore will not be described here any further.

The performance of a surface conduction electron-emitting device according to the invention and manufactured by a method as described above can be determined in a manner as described below.

Figure 11:
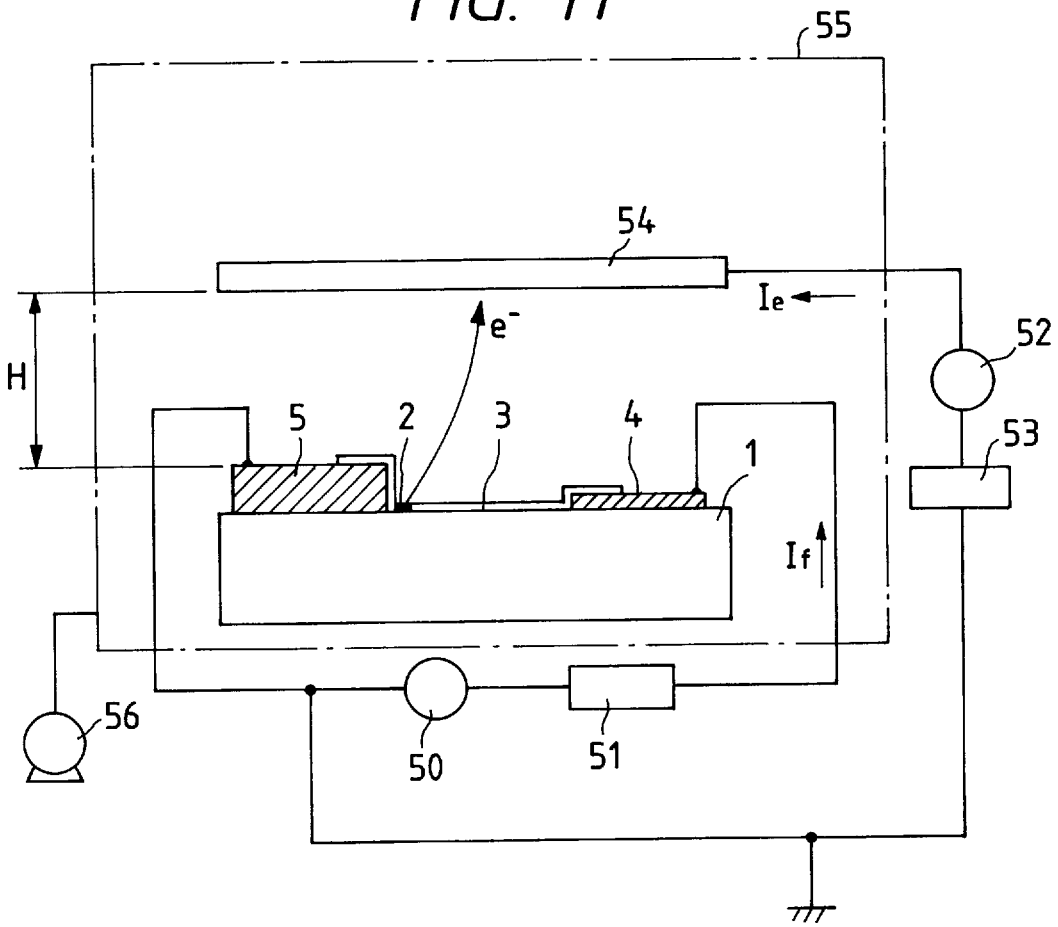
FIG. 11 is a block diagram of a gauging system for determining the electron emitting performance of a surface conduction electron-emitting device having the first basic structure.

FIG. 11 is a schematic block diagram of a gauging system for determining the performance of an electron-emitting device of the type under consideration. Firstly, this gauging system will be described.

Referring to FIG. 11, the components that are same as those of FIGS. 1A and 1B are denoted by the same reference symbols. Otherwise, the gauging system has a power source 51 for applying a device voltage Vf to the device, an ammeter 50 for metering the device current If running through the thin film 3 between the device electrodes 4 and 5, an anode 54 for capturing the emission current Ie produced by electrons emitted from the electron-emitting region of the device, a high voltage source 53 for applying a voltage to the anode 54 of the gauging system and another ammeter 52 for metering the emission current Ie produced by electrons emitted from the electron-emitting region 2 of the device. Reference numerals 55 and 56 respectively denotes a vacuum apparatus and a vacuum pump.

The surface conduction electron-emitting device to be tested, the anode 54 and other components are disposed within the vacuum apparatus 55, which is provided with instruments including a vacuum gauge and other pieces of equipment necessary for the gauging system so that the performance of the surface conduction electron-emitting device or the electron source in the chamber may be properly tested.

The vacuum pump 56 is provided with an ordinary high vacuum system comprising a turbo pump or a rotary pump or an oil-free high vacuum system comprising an oil-free pump such as a magnetic levitation turbo pump or a dry pump and an ultra-high vacuum system comprising an ion pump. The entire vacuum apparatus 55 and the substrate of the electron source held therein can be heated to 250° C. by means of a heater (not shown). Note that the display panel (201 of FIG. 17) of an image forming apparatus according to the invention can be configured as such a gauging system.

Thus, all the processes from the energization forming process on can be carried out with this gauging system.

For determining the performance of a surface conduction electron-emitting device according to the invention, a voltage between 1 and 10 kV may be applied to the anode 54 of the gauging system, which is spaced apart from the electron-emitting device by distance H which is between 2 and 8 mm.

Note that the performance of a surface conduction electron-emitting device as illustrated in FIGS. 7A and 7B or FIGS. 9A and 9B is determined by using a power source (not shown) for applying a voltage to the control electrode 7 (not shown).

Figure 13:
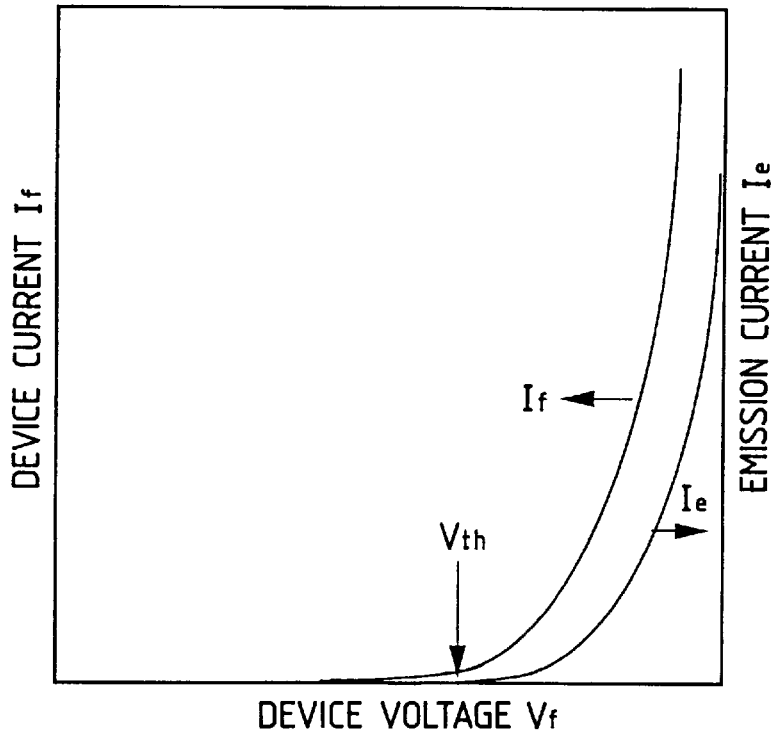
FIG. 13 is a graph showing a typical relationship between the device voltage Vf and the device current If and between the device voltage Vf and the emission current Ie of a surface conduction electron-emitting device or an electron source.

FIG. 13 shows a graph schematically illustrating the relationship between the device voltage Vf and the emission current Ie and the device current If typically observed by the gauging system. Note that different units are arbitrarily selected for Ie and If in FIGS. 8A through 8D in view of the fact that Ie has a magnitude by far smaller than that of If. Note that both the vertical and transversal axes of the graph represent a linear scale.

As seen in FIG. 13, an electron-emitting device according to the invention has three remarkable features in terms of emission current Ie, which will be described below.

Firstly, an electron-emitting device according to the invention shows a sudden and sharp increase in the emission current Ie when the voltage applied thereto exceeds a certain level (which is referred to as a threshold voltage hereinafter and indicated by Vth in FIG. 13), whereas the emission current Ie is practically undetectable when the applied voltage is found lower than the threshold value Vth. Differently stated, an electron-emitting device according to the invention is a non-linear device having a clear threshold voltage Vth to the emission current Ie.

Secondly, since the emission current Ie is highly dependent on the device voltage Vf, the former can be effectively controlled by way of the latter.

Thirdly, the emitted electric charge captured by the anode 54 is a function of the duration of time of application of the device voltage Vf. In other words, the amount of electric charge captured by the anode 54 can be effectively controlled by way of the time during which the device voltage Vf is applied.

The relationship indicated by the solid line in FIG. 13 represents that both the emission current Ie and the device current If show a monotonically-increasing characteristic (hereinafter referred to as MI characteristic) relative to the device voltage Vf but the device current If can show a voltage-controlled-negative-resistance characteristic (hereinafter referred to as VCNR characteristic) (not shown). The electron-emitting device shows either of the two characteristics depending on the method used for manufacturing it, the parameters of the gauging system and other factors. Note that, if the device current If shows a VCNR characteristic to the device voltage Vf, the emission current Ie shows an MI characteristic relative to the device voltage Vf.

Because of the above remarkable characteristic features, it will be understood that the electron-emitting behavior of an electron source comprising a plurality of electron-emitting devices according to the invention and hence that of an image-forming apparatus incorporating such an electron source can easily be controlled in response to the input signal. Thus, such an electron source and an image-forming apparatus may find a variety of applications.

An electron source according to the invention can be realized by arranging surface conduction electron-emitting devices, which will be described below.

For instance, a number of electron-emitting devices may be arranged in a ladder-like arrangement to realize an electron source as described earlier by referring to the prior art. Alternatively, an electron source according to the invention may be realized by arranging n Y-directional wires on m X-directional wires with an interlayer insulation layer interposed therebetween and placing a surface conduction electron-emitting device close to each crossing of the wires, the pair of electrodes of device being connected to the corresponding X- and Y-directional wires respectively. This arrangement is referred to as simple matrix wiring arrangement, which will be described hereinafter in detail.

Because of the basic characteristics of a surface conduction electron-emitting device as described above, the rate at which the device emit electrons can be controlled for by controlling the wave height and the wave width of the pulse voltage applied to the opposite electrodes of the device above the threshold voltage level if the applied device voltage Vf exceeds the threshold voltage Vth. On the other hand, the device does not practically emit any electron below the threshold voltage Vth. Therefore, regardless of the number of electron-emitting devices arranged in an apparatus, desired surface conduction electron-emitting devices can be selected and controlled for electron emission in response to an input signal by applying a pulse voltage to each of the selected devices if a simple matrix wiring arrangement is employed.

Figure 14:
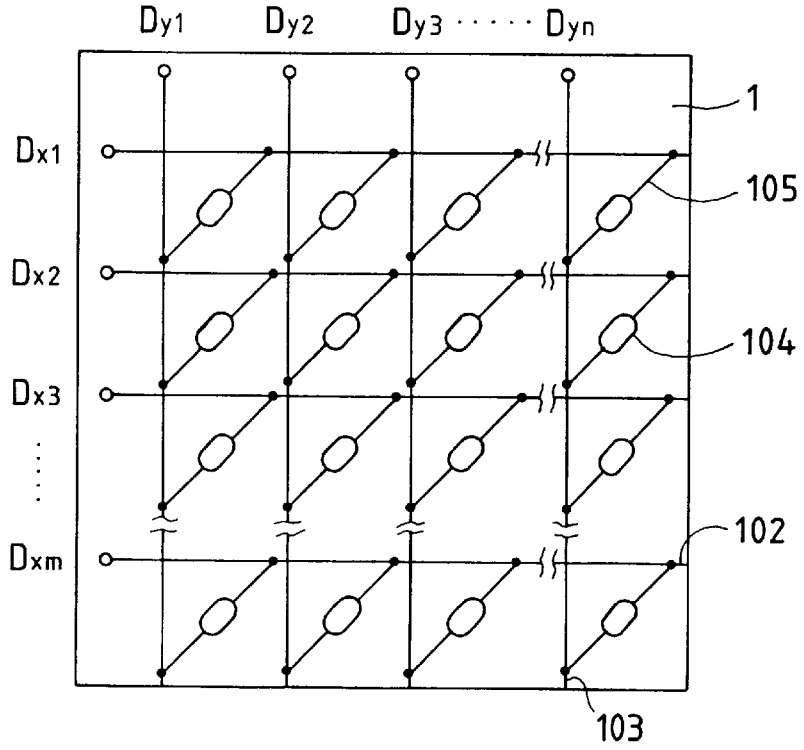
FIG. 14 is a schematic view of an electron source having a simple matrix arrangement.

An electron source having a simple matrix wiring arrangement is realized on the basis of the above simple principle. FIG. 14 is a shematic plan view of an electron source according to the invention and having a simple matrix wiring arrangement.

In FIG. 14, the electron source comprises a substrate 1 which is typically made of a glass panel and has a profile that depends on the number and the application of the surface conduction electron-emitting devices 104 arranged thereon.

There are provided a total of m X-directional wires 102, which are donated by Dx1, Dx2, . . . , Dxm and made of an electroconductive metal produced by vacuum deposition, printing or sputtering. These wires are so designed in terms of material, thickness and width that, if necessary, a substantially equal voltage may be applied to the surface conduction electron-emitting devices.

A total of n Y-directional wires are arranged and donated by Dy1, Dy2, . . . , Dyn, which are similar to the X-directional wires in terms of material, thickness and width.

An interlayer insulation layer (not shown) is disposed between the m X-directional wires and the n Y-directional wires to electrically isolate them from each other. Both m and n are integers.

The interlayer insulation layer (not shown) is typically made of $SiO_2$ and formed on the entire surface or part of the surface of the insulating substrate 1 to show a desired contour by means of vacuum deposition, printing or sputtering. The thickness, material and manufacturing method of the interlayer insulation layer are so selected as to make it withstand the potential difference between any of the X-directional wires 102 and any of the Y-directional wires 103 observable at the crossing thereof. Each of the X-directional wires 102 and the Y-directional wires 103 is drawn out to form an external terminal.

The oppositely arranged electrodes (not shown) of each of the surface conduction electron-emitting devices 104 are connected to related one of the m X-directional wire 102 and related one of the n Y-directional wires 103 by respective connecting wires 105 which are made of an electroconductive metal and formed by means of an appropriate technique such as vacuum deposition, printing or sputtering. In view of the method used for driving the electron source, which will be described hereinafter, the electron-emitting region of each surface conduction electron-emitting device is preferably formed close to the device electrode that is connected to the corresponding X-directional wire 102.

The electroconductive metal material of the device electrodes and that of the m X-directional wires 102, the n Y-directional wires 103 and the connecting wires 105 may be same or contain a common element as an ingredient. Alternatively, they may be different from each other. These materials may be appropriately selected typically from the candidate materials listed above for the device electrodes. If the device electrodes and the connecting wires are made of a same material, they may be collectively called device electrodes without discriminating the connecting wires. The surface conduction electron-emitting devices 104 may be formed either on the substrate 1 or on the interlayer insulation layer (not shown).

As will be described in detail hereinafter, the X-directional wires 102 are electrically connected to a scan signal application means (not shown) for applying a scan signal to a selected row of surface conduction electron-emitting devices 104.

On the other hand, the Y-directional wires 103 are electrically connected to a modulation signal generation means (not shown) for applying a modulation signal to a selected column of surface conduction electron-emitting devices 104 and modulating the selected column according to an input signal. Note that the drive signal to be applied to each surface conduction electron-emitting device is expressed as the voltage difference of the scan signal and the modulation signal applied to the device.

Figure 15:
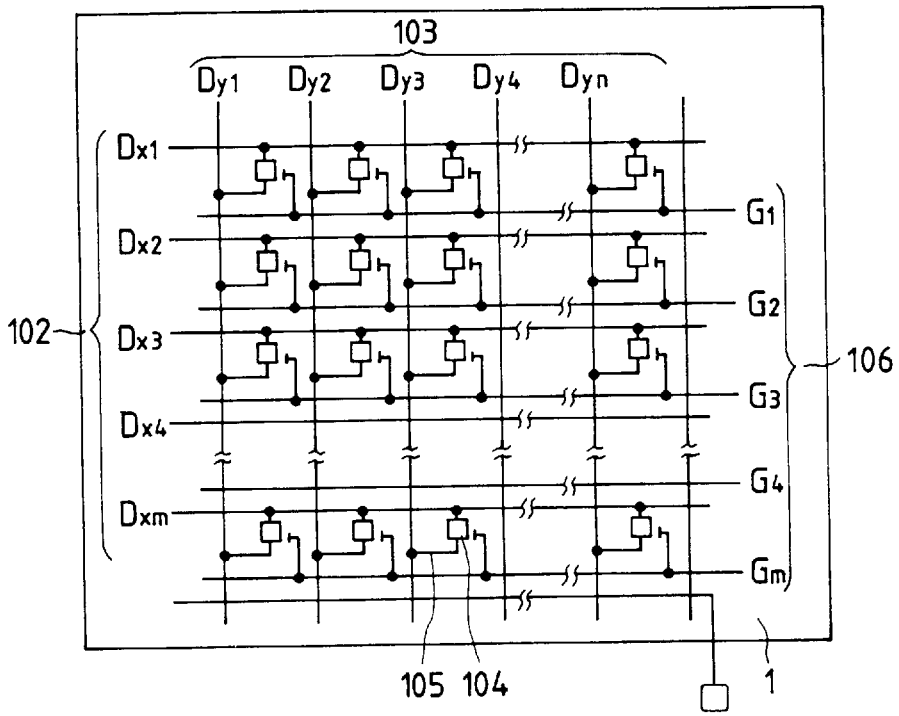
FIG. 15 is a schematic view of an electron source having a simple matrix arrangement of surface conduction electron-emitting devices according to the invention and having the third basic structure (where wires for control electrodes are provided).

Now, an electron source substrate comprising surface conduction electron-emitting devices having the third basic structure of the present invention will be described by referring to FIG. 15. In FIG. 15, reference numerals 1, 102 and 103 respectively denote an electron source substrate, an X-directional wire and a Y-directional wire, whereas reference numerals 106, 104 and 105 respectively denote a wire for a control electrode, a surface conduction electron-emitting device and a connecting wire. The tab connected to line $G_m$ is to indicate the existence of a control electrode; in actuality such would be provided for all of the lines $G_1$, . . .

In FIG. 15, the electron source substrate 1 is typically made of a glass panel and has a profile that depends on the number and the application of the surface conduction electron-emitting devices arranged thereon.

There are provided a total of m X-directional wires 102, which are also donated by Dx1, Dx2, . . . , Dxm and made of an electroconductive metal produced by vacuum deposition, printing or sputtering. These wires are so designed in terms of material, thickness and width that, if necessary, a substantially equal voltage may be applied to the surface conduction electron-emitting devices. A total of n Y-directional wires 103 are arranged and also donated by Dy1, Dy2, Dyn, which are similar to the X-directional wires 102 in terms of material, thickness and width. There are also a total of m wires for control electrodes 106 also denoted by G1, G2, . . . , Gm and arranged like the X-directional wires 102. Interlayer insulation layers (not shown) are disposed so as to electrically isolate the m X-directional wires 102, the m wires for control electrodes 106 and the n Y-directional wires 103 from each other. (Both m and n are integers.)

The interlayer insulation layers (not shown) are typically made of $SiO_2$ and formed on the entire surface or part of the surface of the insulating substrate 1 carrying the X-directional wires 102 and the wired for the control electrodes 106 to show a desired contour by means of vacuum deposition, printing or sputtering. The thickness, material and manufacturing method of the interlayer insulation layers are so selected as to make it withstand the potential difference between any of the X-directional wires 102 and the wires for the control electrode 106 and any of the Y-directional wires 103 observable at the crossing thereof. Each of the X-directional wires 102, the wires for the control electrodes 106 and the Y-directional wires 103 is drawn out to form an external terminal.

The oppositely arranged device electrodes and the control electrode (not shown) of each of the surface conduction electron-emitting devices 104 are connected to related one of the m X-directional wires 102 and related one of the n Y-directional wires 103 by respective connecting wires 105 which are made of an electroconductive metal and formed by means of an appropriate technique such as vacuum deposition, printing or sputtering.

The electroconductive metal material of the device electrodes and the control electrode of each surface conduction electron-emitting device and that of the m X-directional wires 102, the n Y-directional wires 103 and the m wires for the control electrodes 106 may be same or contain a common element as an ingredient. Alternatively, they may be different from each other. These materials may be appropriately selected typically from the candidate materials listed above for the device electrodes. If the device electrodes and the connecting wires are made of a same material, they may be collectively called device electrodes without discriminating the connecting wires. The surface conduction electron-emitting devices may be formed either on the substrate 1 or on the interlayer insulation layer (not shown).

As will be described in detail hereinafter, the X-directional wires 102 and the wires for the control electrodes 106 are electrically connected to a scan signal application means (not shown) for applying a scan signal to a selected row of surface conduction electron-emitting devices 104.

On the other hand, the Y-directional wires 103 are electrically connected to a modulation signal generation means (not shown) for applying a modulation signal to a selected column of surface conduction electron-emitting devices 104 and modulating the selected column according to an input signal.

Note that the drive signal to be applied to each surface conduction electron-emitting device is expressed as the voltage difference of the scan signal and the modulation signal applied to the device.

Now, another electron source substrate comprising surface conduction electron-emitting devices having the third basic structure of the present invention will be described by referring to FIG. 16.

Figure 16:
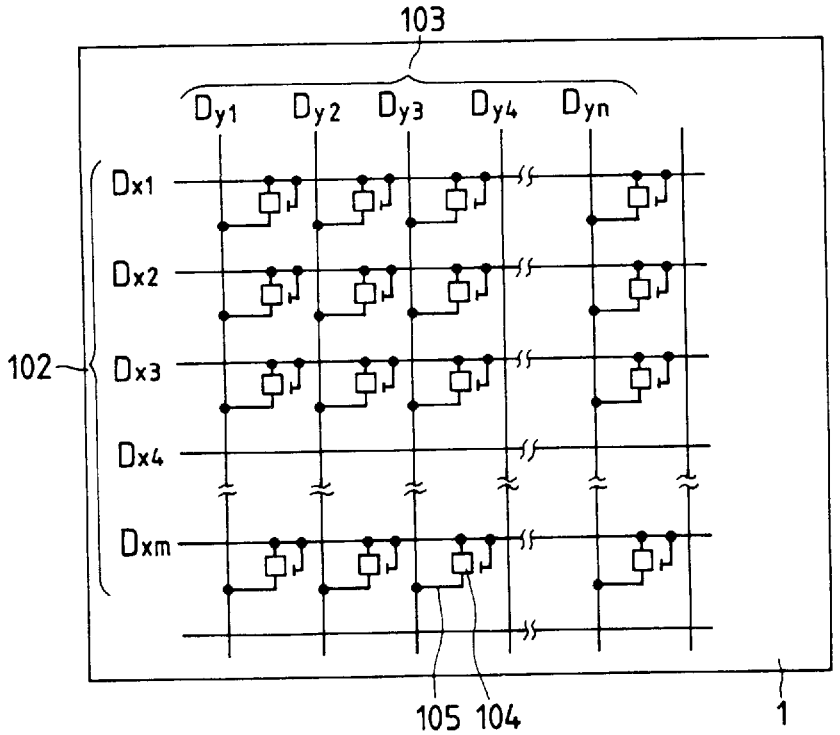
FIG. 16 is a schematic view of an electron source having a simple matrix arrangement of surface conduction electron-emitting devices according to the invention and having the third basic structure (where the row directional wires are also used for the wires of the control electrodes).

In FIG. 16, the components that are same or similar to those of FIG. 15 are denoted by the same reference symbols. The electron source substrate of FIG. 16 differs from that of FIG. 15 in that the wires for the control electrodes 106 formed on the respective control electrodes 7 are emitted and the control electrodes 7 are connected to the corresponding X-directional wires 102. With this arrangement, the number of manufacturing steps can be reduced if compared with the substrate of FIG. 15.

Figure 48:
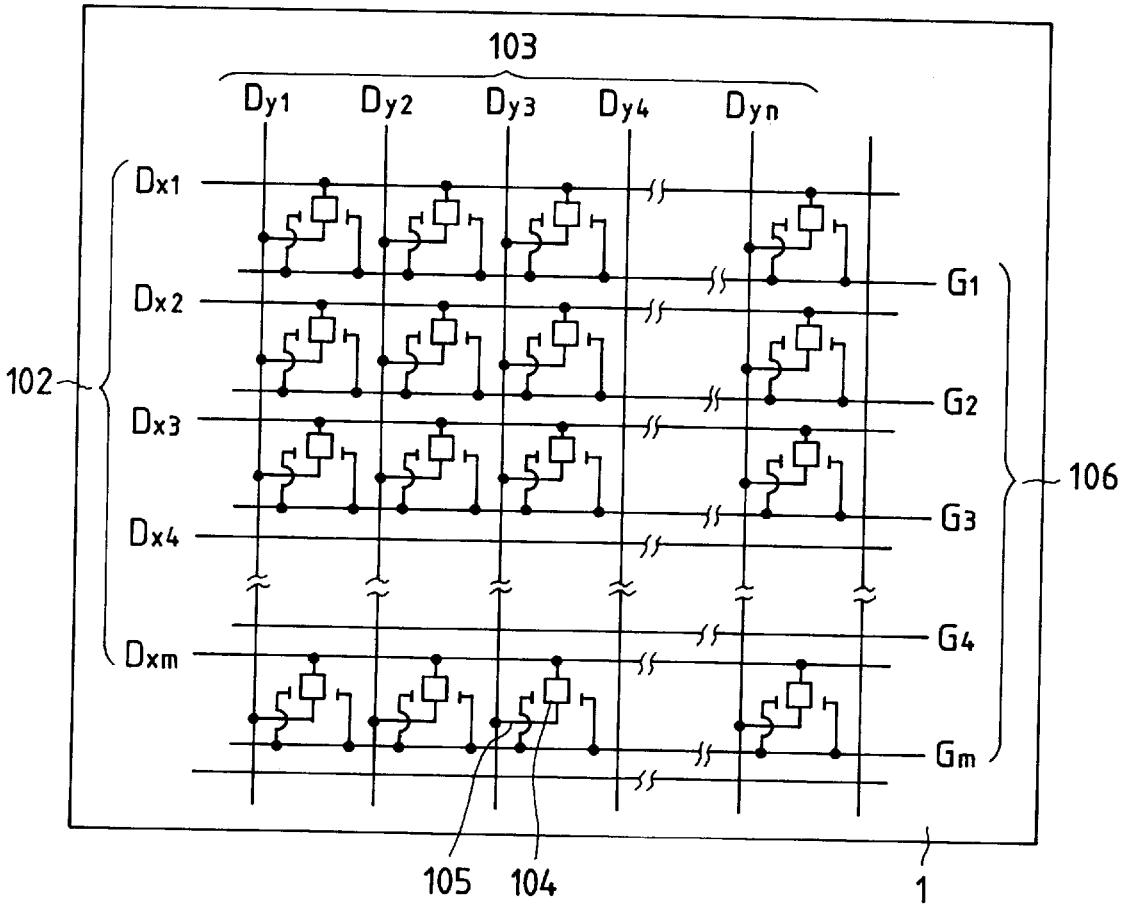
FIG. 48 is a schematic view of an electron source having a simple matrix arrangement of surface conduction electron-emitting devices according to the invention and having the fourth basic structure (where wires for control electrodes are provided).

Now, still another electron source substrate comprising surface conduction electron-emitting devices having the third basic structure of the present invention will be described by referring to FIG. 48. In FIG. 48, reference numerals 1, 102 and 103 respectively denote an electron source substrate, an X-directional wire and a Y-directional wire, whereas reference numerals 106, 104 and 105 respectively denote a wire for a control electrode, a surface conduction electron-emitting device and a connecting wire.

In FIG. 48, the electron source substrate 1 is typically made of a glass panel and has a profile that depends on the number and the application of the surface conduction electron-emitting devices arranged thereon.

There are provided a total of m X-directional wires 102, which are also donated by Dx1, Dx2, . . . , Dxm and made of an electroconductive metal produced by vacuum deposition, printing or sputtering. These wires are so designed in terms of material, thickness and width that, if necessary, a substantially equal voltage may be applied to the surface conduction electron-emitting devices. A total of n Y-directional wires 103 are arranged and also donated by Dy1, Dy2, . . . , Dyn, which are similar to the X-directional wires 102 in terms of material, thickness and width. There are also a total of m wires for control electrodes 106 also denoted by G1, G2, . . . , Gm and arranged alternately and in parallel with the X-directional wires 102. Interlayer insulation layers (not shown) are disposed so as to electrically isolate the m X-directional wires 102, the m wires for control electrodes 106 and the n Y-directional wires 103 from each other. (Both m and n are integers.)

The interlayer insulation layers (not shown) are typically made of $SiO_2$ and formed on the entire surface or part of the surface of the insulating substrate 1 carrying the X-directional wires 102 and the wired for the control electrodes 106 to show a desired contour by means of vacuum deposition, printing or sputtering. The thickness, material and manufacturing method of the interlayer insulation layers are so selected as to make it withstand the potential difference between any of the X-directional wires 102 and the wires for the control electrode 106 and any of the Y-directional wires 103 observable at the crossing thereof. Each of the X-directional wires 102, the wires for the control electrodes 106 and the Y-directional wires 103 is drawn out to form an external terminal.

The oppositely arranged device electrodes and the control electrode (not shown) of each of the surface conduction electron-emitting devices 104 are connected to related one of the m X-directional wires 102 and related one of the n Y-directional wires 103 by respective connecting wires 105 which are made of an electroconductive metal and formed by means of an appropriate technique such as vacuum deposition, printing or sputtering.

The electroconductive metal material of the device electrodes and the control electrode of each surface conduction electron-emitting device and that of the m X-directional wires 102, the n Y-directional wires 103 and the m wires for the control electrodes 106 may be same or contain a common element as an ingredient. Alternatively, they may be different from each other. These materials may be appropriately selected typically from the candidate materials listed above for the device electrodes. If the device electrodes and the connecting wires are made of a same material, they may be collectively called device electrodes without discriminating the connecting wires. The surface conduction electron-emitting devices may be formed either on the substrate 1 or on the interlayer insulation layer (not shown).

As will be described in detail hereinafter, the X-directional wires 102 and the wires for the control electrodes 106 are electrically connected to a scan signal application means (not shown) for applying a scan signal to a selected row of surface conduction electron-emitting devices 104.

On the other hand, the Y-directional wires 103 are electrically connected to a modulation signal generation means (not shown) for applying a modulation signal to a selected column of surface conduction electron-emitting devices 104 and modulating the selected column according to an input signal.

Note that the drive signal to be applied to each surface conduction electron-emitting device is expressed as the voltage difference of the scan signal and the modulation signal applied to the device.

Now, another electron source substrate comprising surface conduction electron-emitting devices having the fourth basic structure of the present invention will be described by referring to FIG. 57.

Figure 57:
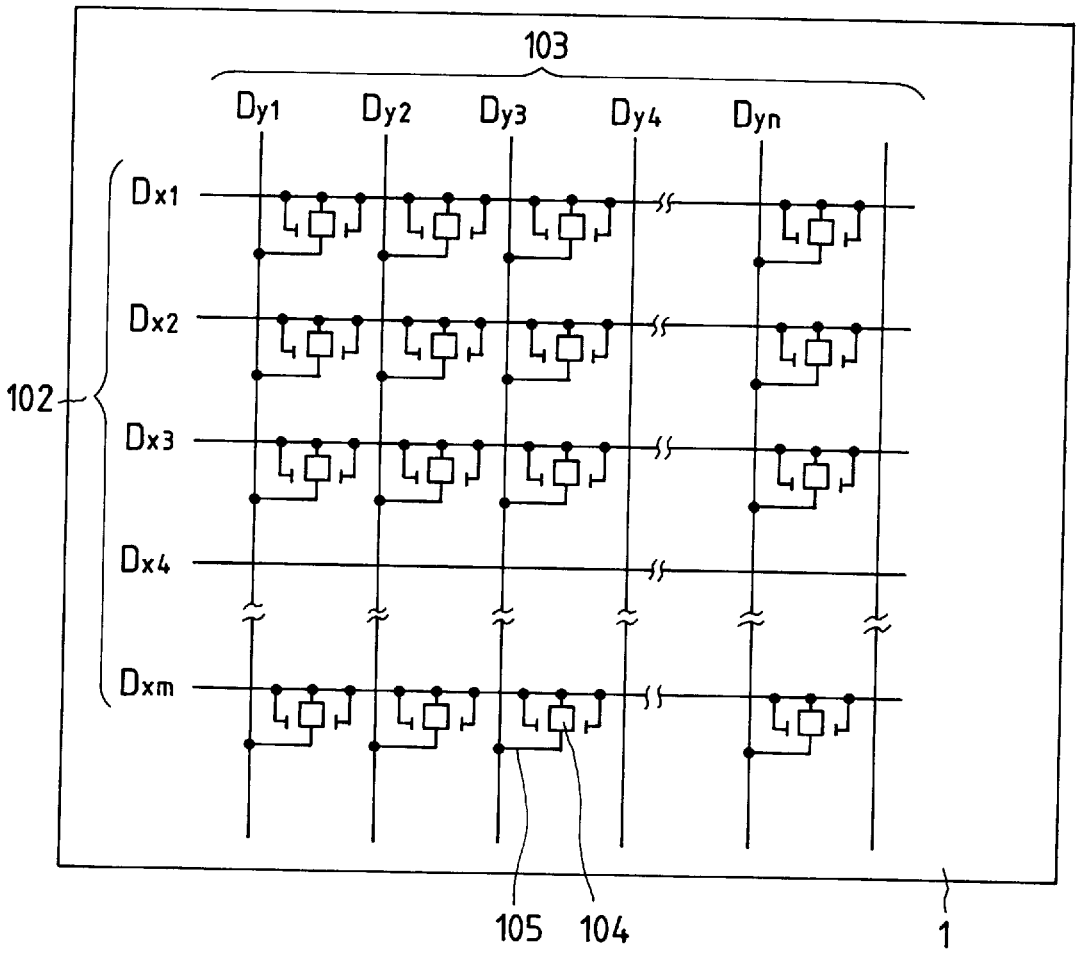
FIG. 57 is a schematic view of an electron source having a simple matrix arrangement of surface conduction electron-emitting devices according to the invention and having the fourth basic structure (where the row directional wires are also used for the wires of the control electrodes).

In FIG. 57, the components that are same or similar to those of FIG. 48 are denoted by the same reference symbols. The electron source substrate of FIG. 57 differs from that of FIG. 48 in that the wires for the control electrodes 106 formed on the respective control electrodes 7 are emitted and the control electrodes 7 are connected to the corresponding X-directional wires 102. With this arrangement, the number of manufacturing steps can be reduced if compared with the substrate of FIG. 15.

Figure 17:
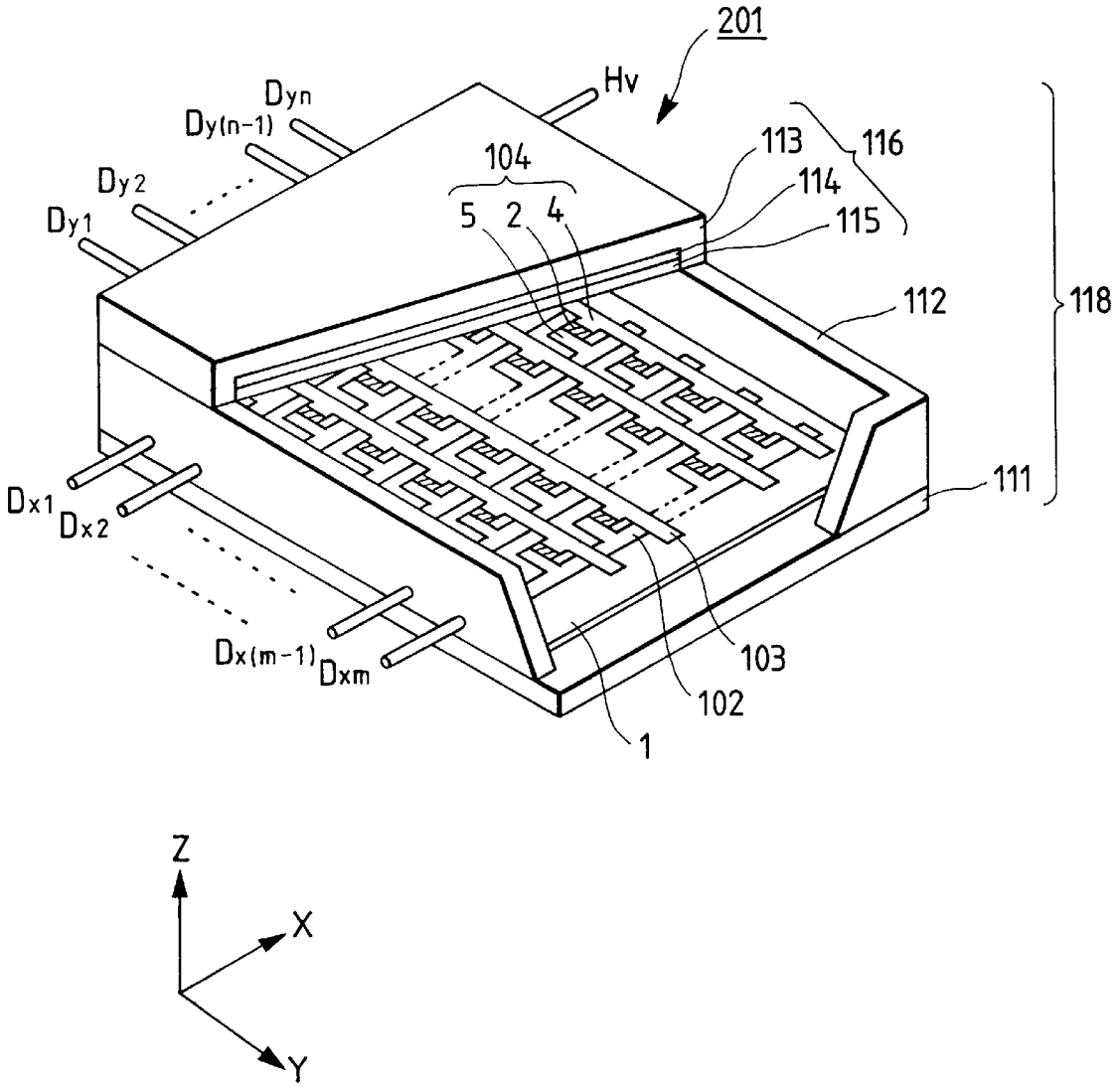
FIG. 17 is a partially cut away schematic perspective view of a display panel comprising an electron source having a simple matrix arrangement.
Figure 18A:
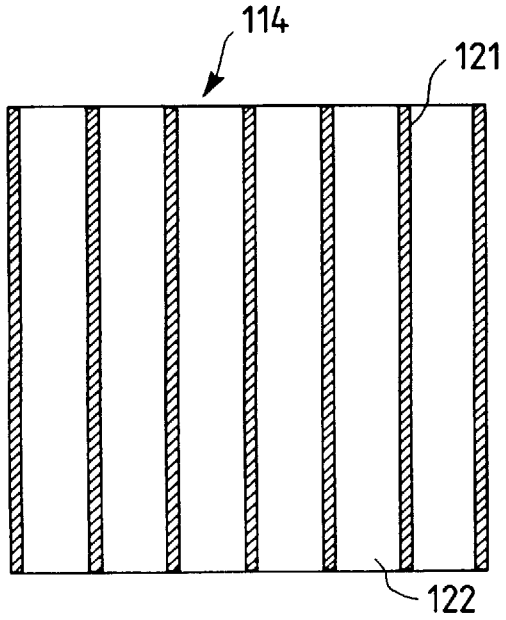
FIGS. 18A and 18B are schematic views, illustrating two possible configurations of fluorescent film of display panel of an image forming apparatus.
Figure 18B:
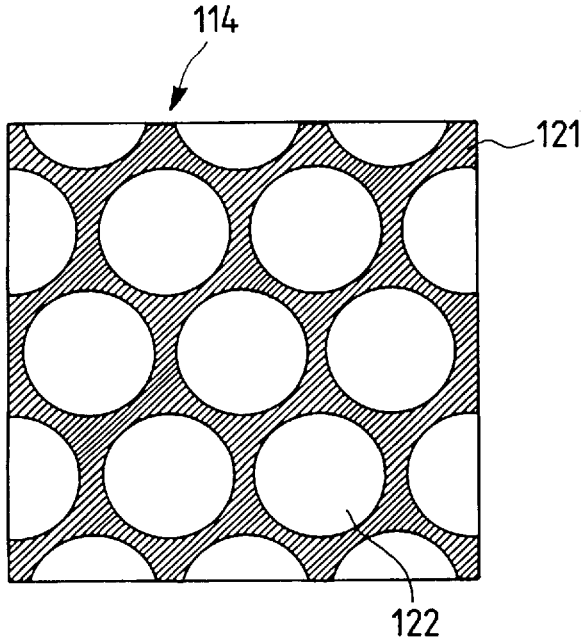
Figure 19:
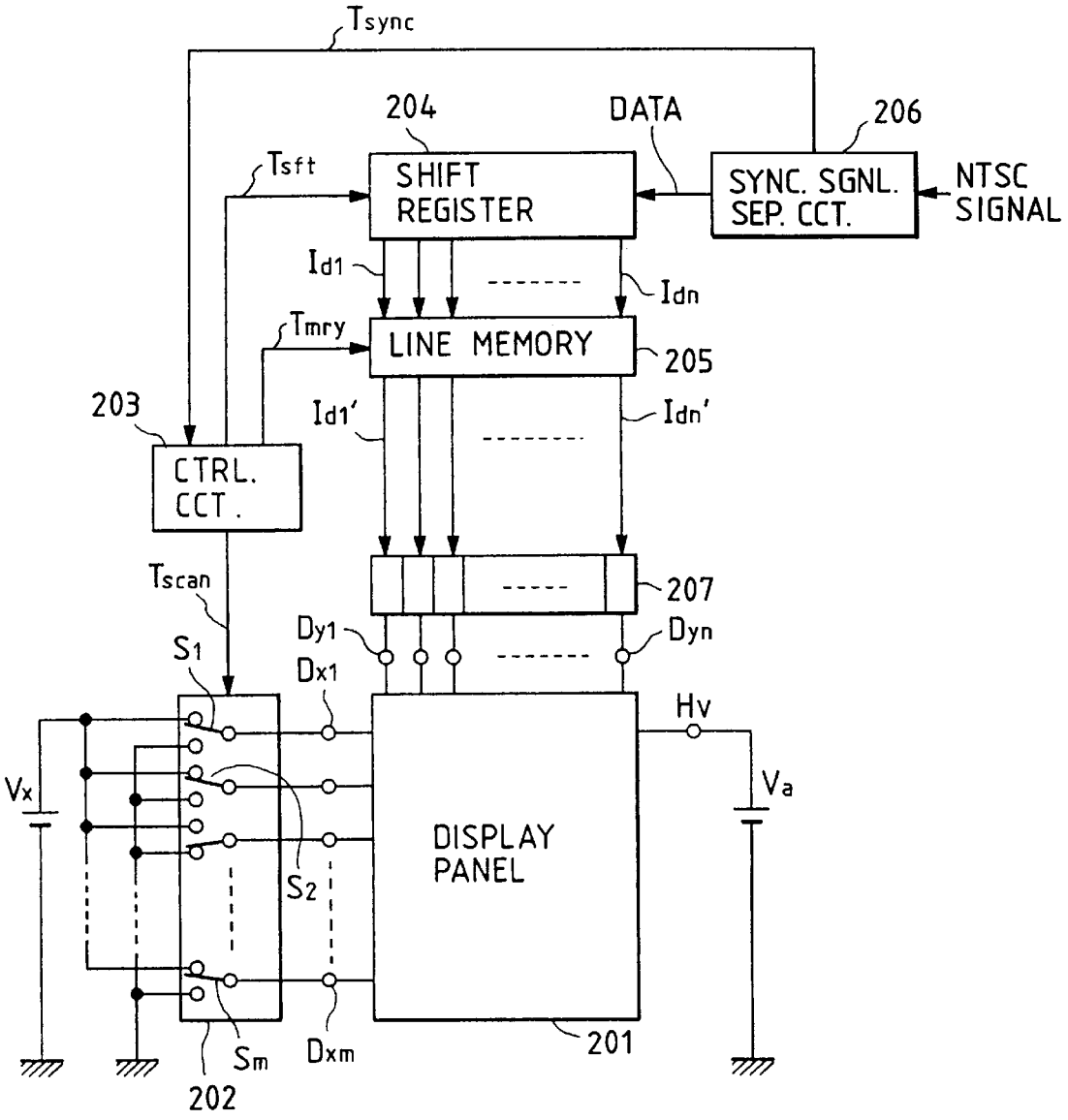
FIG. 19 is a block diagram of a drive circuit of an image forming apparatus for displaying images according to NTSC system television signals.

Now, an image forming apparatus comprising an electron source with a simple matrix wiring arrangement according to the invention will be described by referring to FIGS. 17 through 19, of which FIG. 17 is a schematic perspective view of the display panel 201 of the image forming apparatus and FIGS. 18A and 18B are two possible configurations of the fluorescent film 114 of the display panel, whereas FIG. 19 is a block diagram of a drive circuit for displaying television images according to NTSC television signals.

In FIG. 17, reference numeral 1 denotes an electron source substrate carrying thereon a plurality of surface conduction electron-emitting devices according to the invention. Otherwise, the display panel comprises a rear plate 111 rigidly holding the electron source substrate 1, a face plate 116 prepared by laying a fluorescent film 114 that operates as an image forming member and a metal back 115 on the inner surface of a glass substrate 113 and a support frame 112. The rear plate 111, the support frame 112 and the face plate 116 are bonded together by applying frit glass to the junctions of the these components and baked to 400° to 500° C. for more than 10 minutes in the atmosphere or in nitrogen and hermetically and airtightly sealed to produce an envelope 118.

In FIG. 17, reference numeral 104 denotes an electron-emitting device and reference numerals 102 and 103 respectively denote the X-directional wiring and the Y-directional wiring connected to the respective device electrodes 4 and 5 of each electron-emitting device (FIGS. 1A and 1B).

While the envelope 118 is formed of the face plate 116, the support frame 112 and the rear plate 111 in the above described embodiment, the rear plate 31 may be omitted if the substrate 1 is strong enough by itself because the rear plate 111 is provided mainly for reinforcing the substrate 1. If such is the case, an independent rear plate 111 may not be required and the substrate 1 may be directly bonded to the support frame 112 so that the envelope 118 is constituted of a face plate 116, a support frame 112 and a substrate 1. The overall strength of the envelope 118 may be increased by arranging a number of support members called spacers (not shown) between the face plate 116 and the rear plate 111.

FIGS. 18A and 18B schematically illustrate two possible arrangements of fluorescent film. While the fluorescent film 114 comprises only a single fluorescent body 122 if the display panel is used for showing black and white pictures, it needs to comprise for displaying color pictures black conductive members 121 and fluorescent bodies 122, of which the former are referred to as black stripes (FIG. 18A) or members of a black matrix (FIG. 18B) depending on the arrangement of the fluorescent bodies. Black stripes or members of a black matrix are arranged for a color display panel so that the fluorescent bodies 122 of three different primary colors are made less discriminable and the adverse effect of reducing the contrast of displayed images of external light is minimized in the fluorescent film 114 by blackening the surrounding areas. While graphite is normally used as a principal ingredient of the black stripes, other conductive material having low light transmissivity and reflectivity may alternatively be used.

A precipitation or printing technique may suitably be used for applying a fluorescent material to form fluorescent bodies 122 on the glass substrate 113 regardless of black and white or color display.

An ordinary metal back 115 is arranged on the inner surface of the fluorescent film 114 as shown in FIG. 17. The metal back 115 is provided in order to enhance the luminance of the display panel by causing the rays of light emitted from the fluorescent bodies 122 (FIG. 18A or 18B) and directed to the inside of the envelope to mirror-reflect toward the face plate 116, to use it as a high voltage electrode Hv for applying an accelerating voltage to electron beams and to protect the fluorescent bodies 122 against damages that may be caused when negative ions generated inside the envelope 118 collide with them. It is prepared by smoothing the inner surface of the fluorescent film 114 (in an operation normally called "filming") and forming an Al film thereon by vacuum deposition after forming the fluorescent film 114.

A transparent electrode (not shown) may be formed on the face plate 116 facing the outer surface of the fluorescent film 114 in order to raise the conductivity of the fluorescent film 34.

Care should be taken to accurately align each set of color fluorescent bodies 122 and an electron-emitting device 104, if a color display is involved, before the above listed components of the envelope are bonded together.

The envelope 118 is evacuated to a degree of vacuum of $10^{-6}$ to $10^{-7}$ Torr or higher degree via an evacuation pipe (not shown) and hermetically sealed.

More specifically, the inside of the envelope 118 is evacuated by means of an ordinary vacuum system typically comprising a rotary pump or a turbo pump to a degree of vacuum of about $10^{-6}$ Torr and the surface conduction electron-emitting devices in the inside are subjected to an energization forming step and an activation step to produce electron-emitting regions 2 as described earlier by applying a voltage to the device electrodes 4 and 5 via the external terminals Dx1 through Dxm and Dy1 through Dyn. Thereafter, the vacuum system is switched to an ultra-high vacuum system typically comprising an ion pump, while baking the apparatus at 80° to 200° C. A getter process may be conducted in order to maintain the achieved degree of vacuum in the inside of the envelope 118 immediately before or after it is hermetically sealed. In a getter process, a getter arranged at a predetermined position in the envelope 118 is heated by means of a resistance heater or a high frequency heater to form a film by vapor deposition. A getter typically contains Ba as a principal ingredient and can maintain a high degree of vacuum by the adsorption effect of the vapor deposition film.

The above described display panel 201 can be driven by a drive circuits as shown in FIG. 19. In FIG. 19, reference numeral 201 denotes a display panel. Otherwise, the circuit comprises a scan circuit 202, a control circuit 203, a shift register 204, a line memory 205, a synchronizing signal separation circuit 206 and a modulation signal generator 207. Vx and Va in FIG. 19 denote DC voltage sources.

As shown in FIG. 19, the display panel 201 is connected to external circuits via external terminals Dx1 through Dxm, Dy1 through Dyn and high voltage terminal Hv, of which terminals Dx1 through Dxm are designed to receive scan signals for sequentially driving on a one-by-one basis the rows (of n devices) of an electron source in the apparatus comprising a number of surface-conduction type electron-emitting devices arranged in the form of a matrix having m rows and n columns.

On the other hand, external terminals Dy1 through Dyn are designed to receive a modulation signal for controlling the output electron beam of each of the surface-conduction type electron-emitting devices of a row selected by a scan signal. High voltage terminal Hv is fed by the DC voltage source Va with a DC voltage of a level typically around 10 kV, which is sufficiently high to energize the fluorescent bodies of the selected surface-conduction type electron-emitting devices.

The scan circuit 202 operates in a manner as follows. The circuit comprises M switching devices (of which only devices S1 and Sm are specifically indicated in FIG. 19), each of which takes either the output voltage of the DC voltage source Vx or 0[V] (the ground potential level) and comes to be connected with one of the terminals Dx1 through Dxm of the display panel 201. Each of the switching devices S1 through Sm operates in accordance with control signal Tscan fed from the control circuit 203 and can be easily prepared by combining transistors such as FETs.

The DC voltage source Vx of this circuit is designed to output a constant voltage such that any drive voltage applied to devices that are not being scanned due to the performance of the surface conduction electron-emitting devices (or the threshold voltage for electron emission) is reduced to less than threshold voltage.

The control circuit 203 coordinates the operations of related components so that images may be appropriately displayed in accordance with externally fed video signals. It generates control signals Tscan, Tsft and Tmry in response to synchronizing signal Tsync fed from the synchronizing signal separation circuit 206, which will be described below.

The synchronizing signal separation circuit 206 separates the synchronizing signal component and the luminance signal component form an externally fed NTSC television signal and can be easily realized using a popularly known frequency separation (filter) circuit. Although a synchronizing signal extracted from a television signal by the synchronizing signal separation circuit 206 is constituted, as well known, of a vertical synchronizing signal and a horizontal synchronizing signal, it is simply designated as Tsync signal here for convenience sake, disregarding its component signals. On the other hand, a luminance signal drawn from a television signal, which is fed to the shift register 204, is designed as DATA signal.

The shift register 204 carries out for each line a serial/parallel conversion on DATA signals that are serially fed on a time series basis in accordance with control signal Tsft fed from the control circuit 203. (In other words, a control signal Tsft operates as a shift clock for the shift register 204.) A set of data for a line that have undergone a serial/parallel conversion (and correspond to a set of drive data for N electron-emitting devices) are sent out of the shift register 204 as n parallel signals Id1 through Idn.

The line memory 205 is a memory for storing a set of data for a line, which are signals Id1 through Idn, for a required period of time according to control signal Tmry coming from the control circuit 203. The stored data are sent out as I'd1 through I'dn and fed to modulation signal generator 207.

Said modulation signal generator 207 is in fact a signal line that appropriately drives and modulates the operation of each of the surface-conduction type electron-emitting devices according to each of the image data I'd1 through I'dn and output signals of this device are fed to the surface-conduction type electron-emitting devices in the display panel 201 via terminals Dy1 through Dyn.

As described above, an electron-emitting device, to which the present invention is applicable, is characterized by the following features in terms of emission current Ie. Firstly, there exists a clear threshold voltage Vth and the device emit electrons only a voltage exceeding Vth is applied thereto. Secondly, the level of emission current Ie changes as a function of the change in the applied voltage above the threshold level Vth, although the value of Vth and the relationship between the applied voltage and the emission current may vary depending on the materials, the configuration and the manufacturing method of the electron-emitting device.

More specifically, when a pulse-shaped voltage is applied to an electron-emitting device according to the invention, practically no emission current is generated so far as the applied voltage remains under the threshold level, whereas an electron beam is emitted once the applied voltage rises above the threshold level. It should be noted here that the intensity of an output electron beam can be controlled by changing the peak level of the pulse-shaped voltage. Additionally, the total amount of electric charge of an electron beam can be controlled by varying the pulse width.

Thus, either modulation method or pulse width modulation may be used for modulating an electron-emitting device in response to an input signal. With voltage modulation, a voltage modulation type circuit is used for the modulation signal generator 207 so that the peak level of the pulse shaped voltage is modulated according to input data, while the pulse width is held constant. With pulse width modulation, on the other hand, a pulse width modulation type circuit is used for the modulation signal generator 207 so that the pulse width of the applied voltage may be modulated according to input data, while the peak level of the applied voltage is held constant.

Although it is not particularly mentioned above, the shift register 204 and the line memory 205 may be either of digital or of analog signal type so long as serial/parallel conversions and storage of video signals are conducted at a given rate.

If digital signal type devices are used, output signal DATA of the synchronizing signal separation circuit 206 needs to be digitized. However, such conversion can be easily carried out by arranging an A/D converter at the output of the synchronizing signal separation circuit 206.

It may be needless to say that different circuits may be used for the modulation signal generator 207 depending on if output signals of the line memory 205 are digital signals or analog signals.

If digital signals are used, a D/A converter circuit of a known type may be used for the modulation signal generator 207 and an amplifier circuit may additionally be used, if necessary. As for pulse width modulation, the modulation signal generator 207 can be realized by using a circuit that combines a high speed oscillator, a counter for counting the number of waves generated by said oscillator and a comparator for comparing the output of the counter and that of the memory. If necessary, an amplifier may be added to amplify the voltage of the output signal of the comparator having a modulated pulse width to the level of the drive voltage of a surface-conduction type electron-emitting device according to the invention.

If, on the other hand, analog signals are used with voltage modulation, an amplifier circuit comprising a known operational amplifier may suitably be used for the modulation signal generator 207 and a level shift circuit may be added thereto if necessary. As for pulse width modulation, a known voltage control type oscillation circuit (VCO) may be used with, if necessary, an additional amplifier to be used for voltage amplification up to the drive voltage of surface-conduction type electron-emitting device.

With an image forming apparatus having a configuration as described above, to which the present invention is applicable, the electron-emitting devices 104 emit electrons as a voltage is applied thereto by way of the external terminals Dx1 through Dxm and Dy1 through Dyn. Then, the generated electron beams are accelerated by applying a high voltage to the metal back 115 or a transparent electrode (not shown) by way of the high voltage terminal Hv. The accelerated electrons eventually collide with the fluorescent film 114, which by turn glows to produce images.

The above described configuration of image forming apparatus is only an example to which the present invention is applicable and may be subjected to various modifications. The TV signal system to be used with such an apparatus is not limited to a particular one and any system such as NTSC, PAL or SECAM may feasibly be used with it. It is particularly suited for TV signals involving a larger number of scanning lines (typically of a high definition TV system such as the MUSE system) because it can be used for a large display panel comprising a large number of pixels.

Now, an electron source comprising a plurality of surface conduction electron-emitting devices arranged in a ladder-like manner on a substrate and an image-forming apparatus comprising such an electron source will be described by referring to FIGS. 20 and 21.

Figure 20:
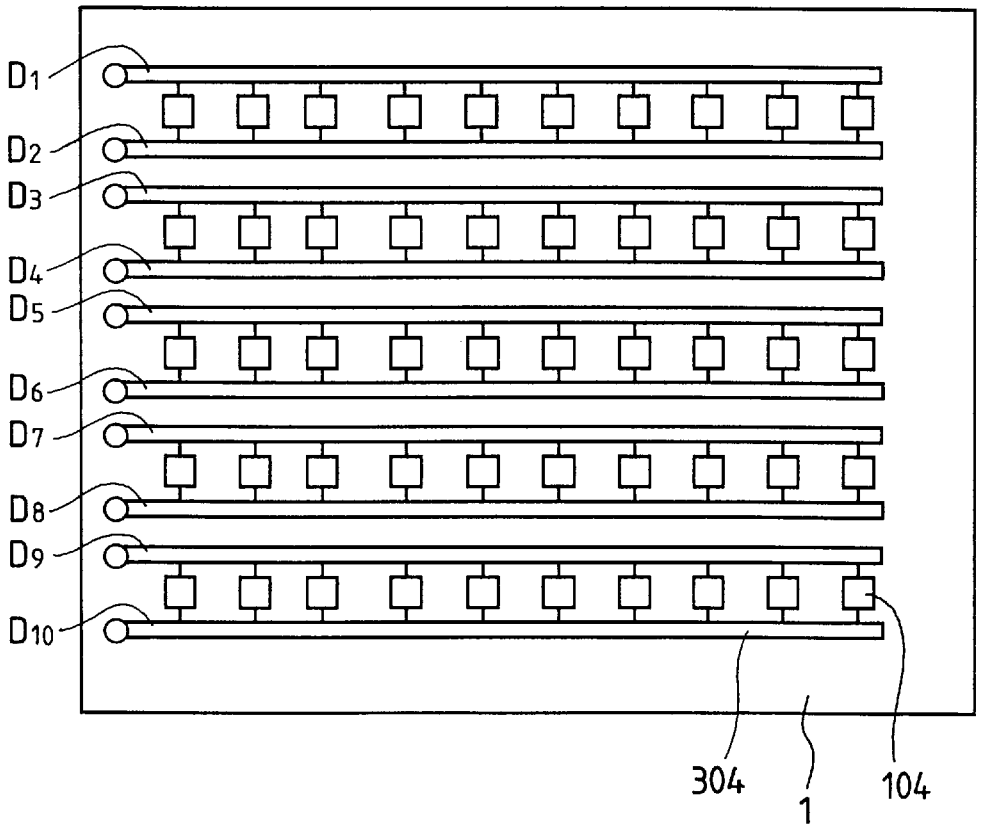
FIG. 20 is a schematic plan view of a ladder wiring type electron source.

Firstly referring to FIG. 20, reference numeral 1 denotes an electron source substrate and reference numeral 104 denotes an surface conduction electron-emitting device arranged on the substrate, whereas reference numeral 304 denotes common wires Dx1 through Dx10 for connecting the surface conduction electron-emitting devices 104.

The electron-emitting devices 104 are arranged in rows along the X-direction (to be referred to as device rows hereinafter) to form an electron source comprising a plurality of device rows, each row having a plurality of devices.

The surface conduction electron-emitting devices of each device row are electrically connected in parallel with each other by a pair of common wires 304 (e.g., common wires 304 for external terminals D1 and D2) so that they can be driven independently by applying an appropriate drive voltage to the pair of common wires. More specifically, a voltage exceeding the electron emission threshold level is applied to the device rows to be driven to emit electrons, whereas a voltage below the electron emission threshold level is applied to the remaining device rows. Alternatively, any two external terminals arranged between two adjacent device rows can share a single common wire 304. Thus, of the common wires D2 through D9, D2 and D3 can share a single common wire instead of two wires.

Figure 21:
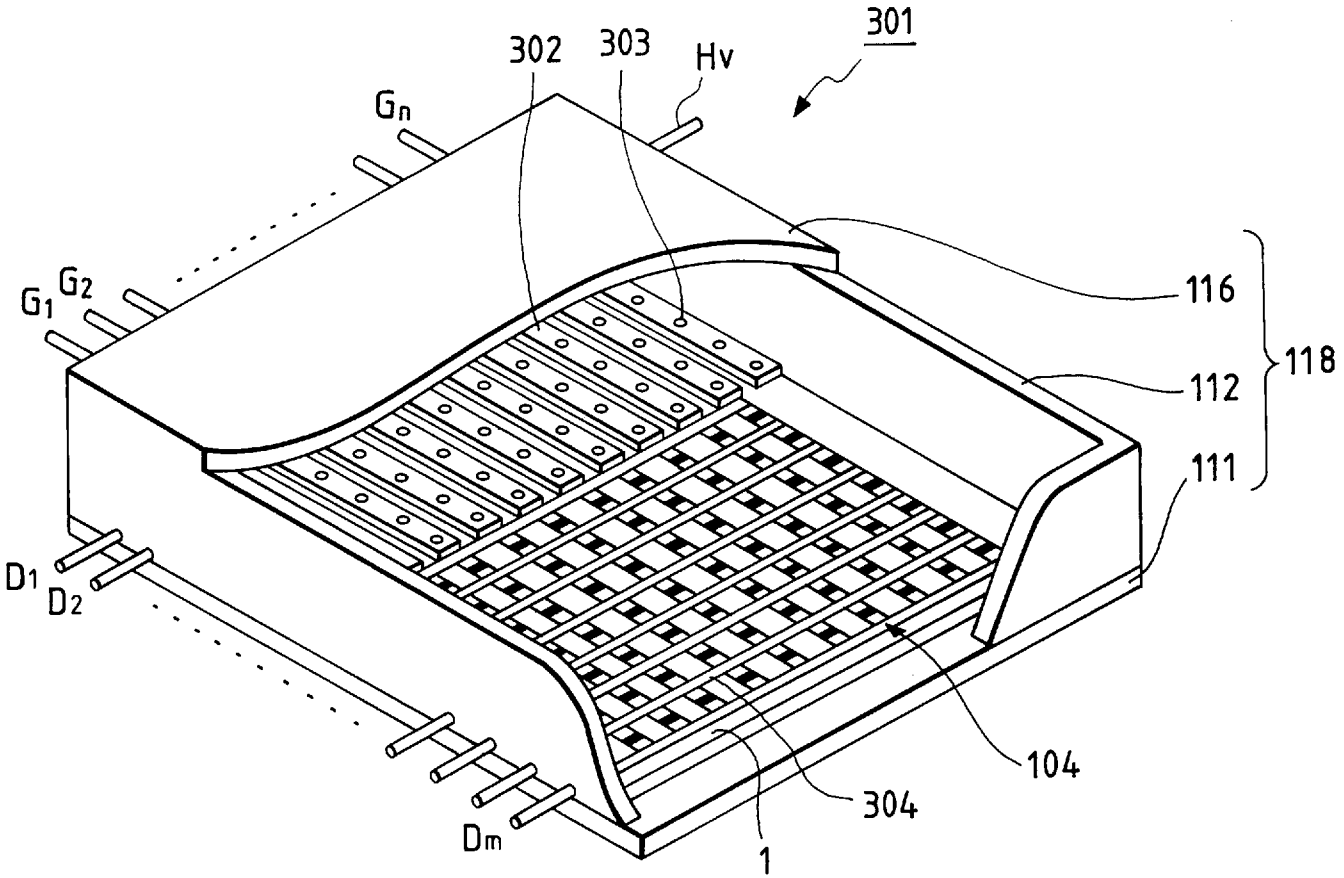
FIG. 21 is a partially cut away schematic perspective view of a display panel comprising a ladder wiring type electron source.

FIG. 21 is a schematic perspective view of the display panel of an image-forming apparatus incorporating an electron source having a ladder-like arrangement of electron-emitting devices.

In FIG. 21, the display panel comprises grid electrodes 302, each provided with a number of bores 303 for allowing electrons to pass therethrough and a set of external terminals D1, D2, . . . , Dm, along with another set of external terminals G1, G2, . . . , Gn connected to the respective grid electrodes 302. The common wires 304 connected to the respective rows of surface conduction electron-emitting devices are integrally formed on the substrate 1.

Note that, in FIG. 21, the components that are similar to those of FIG. 17 are respectively denoted by the same reference symbols. The image forming apparatus of FIG. 21 differs from the image forming apparatus with a simple matrix arrangement of FIG. 17 mainly in that the apparatus of FIG. 17 has grid electrodes 302 arranged between the electron source substrate 1 and the face plate 116.

As pointed out above, grid electrodes 302 are arranged between the substrate 1 and the face plate 116. These grid electrodes 302 are designed to modulate electron beams emitted from the surface conduction electron-emitting devices 104, each being provided with through bores 303 in correspondence to respective electron-emitting devices 104 for allowing electron beams to pass therethrough.

Note that, however, while stripe-shaped grid electrodes 302 are shown in FIG. 21, the profile and the locations of the electrodes are not limited thereto. For example, they may alternatively be provided with mesh-like openings and arranged around or close to the surface conduction electron-emitting devices 104.

The external terminals D1 through Dm and G1 through Gn are electrically connected to a drive circuit (not shown). Thus, an image-forming apparatus having a configuration as described above can be operated for electron beam irradiation by simultaneously applying modulation signals to the rows of grid electrodes 302 for a single line of an image in synchronism with the operation of driving (scanning) the electron-emitting devices on a row by row basis so that the irradiation of electron beams on the fluorescent film 114 can be controlled and the image can be displayed on a line by line basis.

Thus, a display apparatus according to the invention and having a configuration as described above can have a wide variety of industrial and commercial applications because it can operate as a display apparatus for television broadcasting, as a terminal apparatus for video teleconferencing, as an editing apparatus for still and movie pictures, as a terminal apparatus for a computer system, as an optical printer comprising a photosensitive drum and in many other ways.

Now, the present invention will be described by way of examples.

[EXAMPLE 1]

In this example, a number of surface conduction electron-emitting devices having a configuration illustrated in FIGS. 1A and 1B were prepared along with a number of surface conduction electron-emitting devices for the purpose of comparison and they were tested for performance. FIG. 1A is a plan view and FIG. 1B is a cross sectional side view of a surface conduction electron-emitting device according to the invention and used in this example. Referring to FIGS. 1A and 1B, W1 denotes the width of the device electrodes 4 and 5 and W2 denotes the width of the electroconductive thin film 3, while L denotes the distance separating the device electrodes 4 and 5 and d1 and d2 respectively denotes the height of the device electrode 4 and that of the device electrode 5.

Figure 22A:
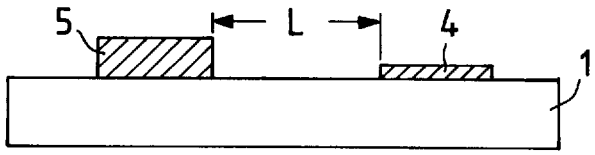
FIGS. 22AA through 22AC and 22BA through 22BC are schematic sectional views of the electron-emitting device of Example 1 in different manufacturing steps.
Figure 22A:
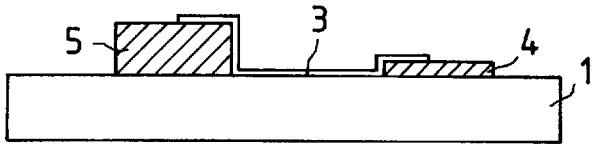
Figure 22A:
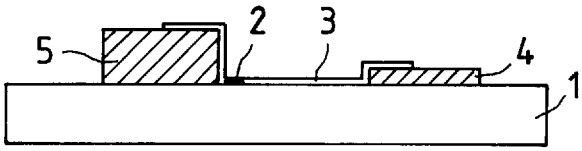
Figure 22B:
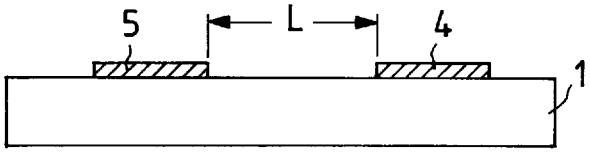
Figure 22B:
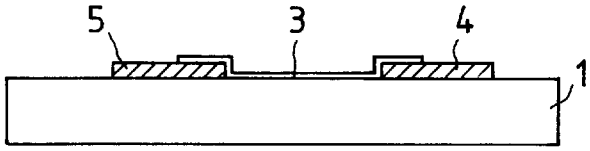
Figure 22B:
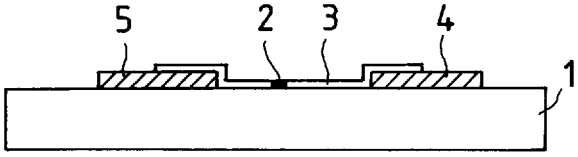

FIGS. 22AA through 22AC show a surface conduction electron-emitting device arranged on substrate A in different manufacturing steps whereas FIGS. 22BA through 22BC show another surface conduction electron-emitting device also in different manufacturing steps, the latter being prepared for the purpose of comparison and arranged on substrate B. Four identical electron-emitting devices were produced on each of the substrates A and B.

1) After thoroughly cleansing a quartz glass plate with a detergent, pure water and an organic solvent for each of the substrates A and B, a Pt film was formed thereon by sputtering to a thickness of 300 Å for a pair of device electrodes for each device, using a mask. For the substrate A, Pt was deposited further to a thickness of 800 Å for the device electrode 4 (FIGS. 22AA and 22BA).

Both of the device electrodes 4 and 5 on the substrate B had a thickness of 300 Å, whereas the device electrodes 4 and 5 on the substrate A had respective thicknesses of 300 Å and 1,100 Å. The device electrodes were separated by a distance L of 100 $\mu$m for both the substrate A and the substrate B.

Thereafter, a Cr film (not shown) to be used for lift-off is formed by vacuum deposition to a thickness of 1,000 Å on each of the substrates A and B for the purpose of patterning the electroconductive thin film 3. At the same time, an opening of 100 $\mu$m corresponding to the width W2 of the electroconductive thin film 3 was formed in the Cr film.

The subsequent steps were identical to both the substrate A and the substrate B.

2) Thereafter, a solution of organize palladium (ccp-4230: available from Okuno Pharmaceutical Co., Ltd.) was applied to the Cr film by means of a spinner and left there to produce an organic Pd thin film. Thereafter, the organic Pd thin film was heated and baked at 300° C. for 10 minutes in the atmosphere to produce an electroconductive thin film 3 mainly constituted by fine PdO particles. The film had a thickness of about 100 Å and an electric resistance of $Rs=5\times10^4$ Ω/□.

Subsequently, the Cr film and the electroconductive thin film 3 were wet etched to produce an electroconductive thin film 3 having a desired pattern by means of an acidic wet etchant (FIGS. 22AB and 22BB).

3) Then, the substrates A and B were moved into the vacuum apparatus 55 of a gauging system as illustrated in FIG. 11 and heated in vacuum to chemically reduce the PdO to Pd in the electroconductive thin film 3 of each sample device. Then, the sample devices were subjected to an energization forming process to produce an electron-emitting region 2 by applying a device voltage Vf between the device electrodes 4 and 5 of each device (FIGS. 22AC and 22BC). The applied voltage was a pulse voltage as shown in FIG. 3B (which was, however, not triangular but rectangularly parallelepipedic).

The peak value of the wave height of the pulse voltage was gradually increased with time as shown in FIG. 3B. The pulse width of T1=1 msec and the pulse interval of T2=10 msec were used. During the energization forming process, an extra pulse voltage of 0.1V (not shown) was inserted into intervals of the forming pulse voltage in order to determine the resistance of the electron emitting region, constantly monitoring the resistance, and the energization forming process was terminated when the resistance exceeded 1 MΩ.

If the product of the pulse wave height and the device voltage If at the end of the energization forming process is defined as forming power ($P_{form}$), the forming power $P_{form}$ of the substrate A (10 mW) was five times as small as the forming power $P_{form}$ of the substrate B (50 mW).

4) Subsequently, the substrates A and B were subjected to an activation process, maintaining the inside pressure of the vacuum apparatus 55 to about $10^{-5}$ Torr. A pulse voltage (which was, however, not triangular but rectangularly parallelepipedic) was applied to each sample device to drive it. The pulse width of T1=1 msec and the pulse interval of T2=10 msec were used and the drive voltage (wave height) was 15V.

5) Then, each sample surface conduction electron-emitting device on the substrates A and B was driven to operate within the vacuum apparatus 55 of about $10^{-6}$ Torr in order to see the device current If and the emission current Ie. After the measurement, the electron-emitting regions 2 of the devices on the substrates A and B were microscopically observed.

As for the parameters of the measurement, the distance H between the anode 54 and the electron-emitting device was 5 mm and the anode voltage and the device voltage Vf were respective 1 kV and 18V. The electric potential of the device electrode 5 was made lower than that of the device electrode 6.

As a result of the measurement, the device current If and the emission current of each device on the substrate B were 1.2 mA±25% and 1.0 μA±30% respectively. On the other hand, the device current If and the emission current of each device on the substrate A were 1.0 mA±5% and 1.95 μA±4.5% to show a remarkably reduced deviation among the devices. It is assumed as a result of this observation that the above described magnitude of forming power $P_{form}$ will more or less affect the deviation in the performance of electron emission.

At the same time, a fluorescent member was arranged on the anode 54 to see the bright spot on the fluorescent member produced by an electron beam emitted from each sample electron-emitting device surface and it was observed that the bright spot produced by a device on the substrate A was smaller than its counterpart produced by a device on the substrate B by about 30 μm.

Figure 23A:
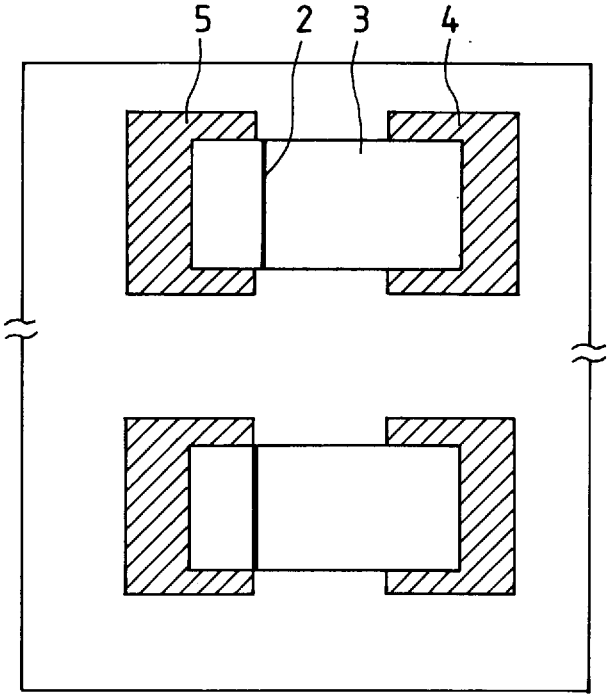
FIGS. 23A and 23B are schematic plan views of the surface conduction electron-emitting device of Example 1, showing in particular its electron emitting region.
Figure 23B:
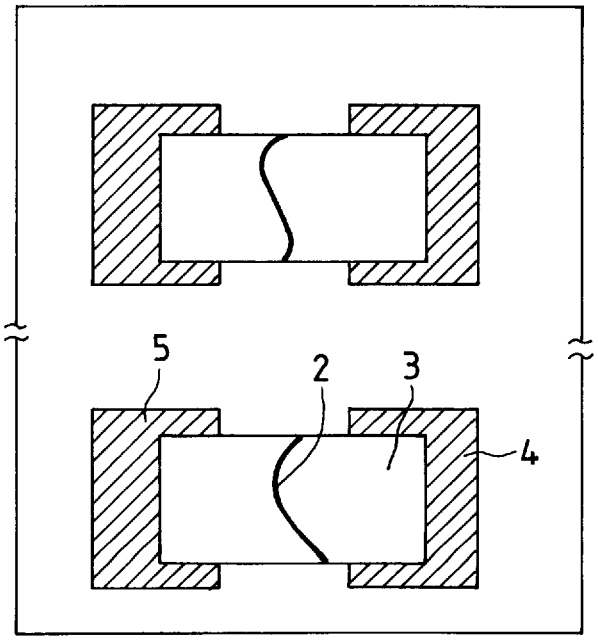

FIGS. 23A and 23B schematically illustrate what was observed for the electron-emitting region 2 of the electroconductive thin film 3 of each device on the substrates A and B. As seen from FIGS. 23A and 23B, a substantially linear electron-emitting region 2 was observed near the device electrode 5 having a higher step portion in each of the four devices on the substrate A, whereas a swerved electron-emitting region 2 was observed in the electroconductive thin film 3 of each of the four devices on the substrate B prepared for comparison. The electron-emitting region 2 was swerved by about 50 μm at the middle point.

As described above, a surface conduction electron-emitting device according to the invention and comprising a substantially linear electron-emitting region 2 located close to one of the device electrodes operates remarkably well to emit highly convergent electron beams without showing any substantial deviation in the performance. It was also found that a surface conduction electron-emitting device according to the invention produces a relatively large bright spot on the fluorescent member if the electric potential of the device electrode 5 is made higher than that of the device electrode 4.

[EXAMPLE 2]

In this example, surface conduction electron-emitting devices according to the invention and surface conduction electron-emitting devices were prepared for comparison respectively on substrates A and B and tested for the electron-emitting performance as in the case of Example 1.

This example will be described by referring to FIGS. 24AA through 24AC (for substrate A) and FIGS. 24BA through 24BC (for substrate B). Four identical surface conduction electron-emitting devices according to the invention were prepared on the substrate A. Likewise, four identical conventional surface conduction electron-emitting devices were prepared on the substrate B for comparison.

1) After thoroughly cleansing a quartz glass plate with a detergent, pure water and an organic solvent for each of the substrates A and B, an $SiO_x$ film was formed to a thickness of 1,500 Å only on the substrate A, to which resist was subsequently applied and patterned. Thereafter, the $SiO_x$ film was removed by reactive ion etching except an area for producing device electrode 5 in each device so that a control member 21 of $SiO_x$ was formed in the area of the device electrode 5. Subsequently, Pt was deposited by sputtering to a thickness of 300 Å for device electrodes on the substrates A and B, using masks (FIGS. 24AA and 24BA).

The stepped portions of the device electrodes 4 and 5 were 300 Å high on the substrate B, whereas those of the device electrodes 5 were 1,800 Å high and those of the device electrodes 4 were 300 Å on the substrate A. The distance L separating the device electrodes of each device was 50 μm on the substrate A, whereas the corresponding value was 2 μm on the substrate B.

Thereafter, a Cr film (not shown) to be used for lift-off was formed by vacuum deposition to a thickness of 1,000 Å on each of the substrates A and B for the purpose of patterning the electroconductive thin film 3. At the same time, an opening of 100 μm corresponding to the width W2 of the electroconductive thin film 3 was formed in the Cr film.

The subsequent steps were identical to both the substrate A and the substrate B.

2) Thereafter, Pd was deposited on the substrate carrying the device electrodes 4 and 5 by sputtering to produce an electroconductive thin film 3 for each device. The film had a thickness of about 30 Å and an electric resistance per unit area of $5\times10^2$ Ω/□.

Figure 24A:
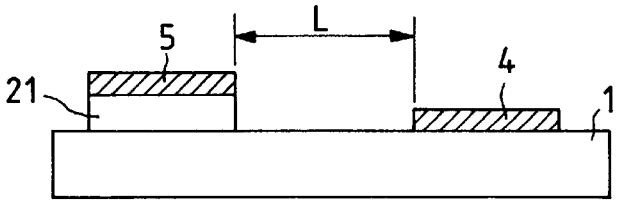
FIGS. 24AA through 24AC and 24BA through 24BC are schematic sectional views of the surface conduction electron-emitting device of Example 2 in different manufacturing steps.
Figure 24A:
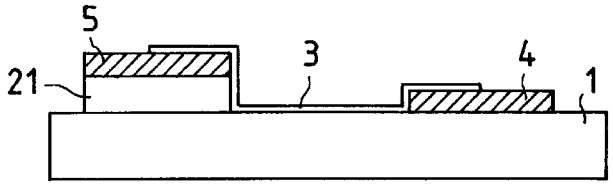
Figure 24A:
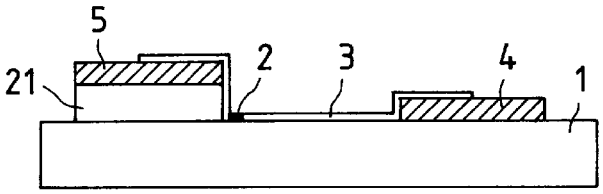
Figure 24B:
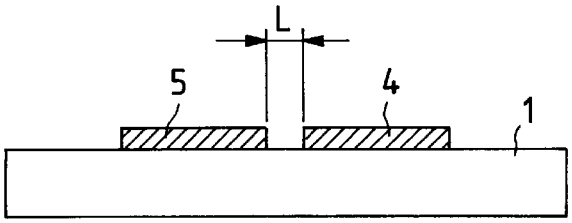
Figure 24B:
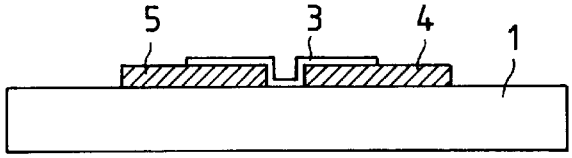
Figure 24B:
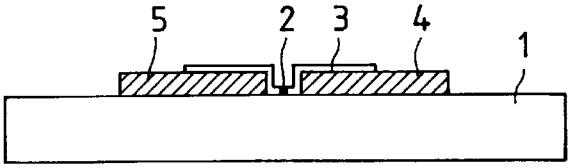

Subsequently, the Cr film and the electroconductive thin film 3 were wet etched to produce an electroconductuctive thin film 3 having a desired pattern by means of an acidic wet etchant (FIGS. 24AB and 24BB).

3) Then, the devices on the substrates A and B were subjected to an energization forming process as in the case of Example 1 (FIGS. 24AC and 24BC). In this example, the forming power $P_{form}$ of the substrate A (6 mW) was about ten times as small as the forming power $P_{form}$ of the substrate B (55 mW).

4) Subsequently, the substrates A and B were subjected to an activation process as in case of Example 1.

5) Then, each sample surface conduction electron-emitting device on the substrates A and B was driven to operate within the vacuum apparatus 55 of about $10^{-6}$ Torr in order to see the device current If and the emission current Ie. After the measurement, the electron-emitting regions 2 of the devices on the substrates A and B were microscopically observed.

As for the parameters of the measurement, the distance H between the anode 54 and the electron-emitting device was 5 mm and the anode voltage and the device voltage Vf were respective 1 kV and 15V. The electric potential of the device electrode 5 was made lower than that of the device electrode 6.

As a result of the measurement, the device current If and the emission current of each device on the substrate B were 1.0 mA±5% and 1.0 μA±5% respectively. On the other hand, the device current If and the emission current of each device on the substrate A were 0.95 mA±4.5% and 1.92 μA±5.0% to show a substantially even deviation among the devices and the emission current of each device on the substrate A was large emission current.

At the same time, a fluorescent member was arranged on the anode 54 to see the bright spot on the fluorescent member produced by an electron beam emitted from each sample electron-emitting device surface and it was observed that the bright spot produced by a device on the substrate A was substantially equal to its counterpart produced by a device on the substrate B.

Figure 25A:
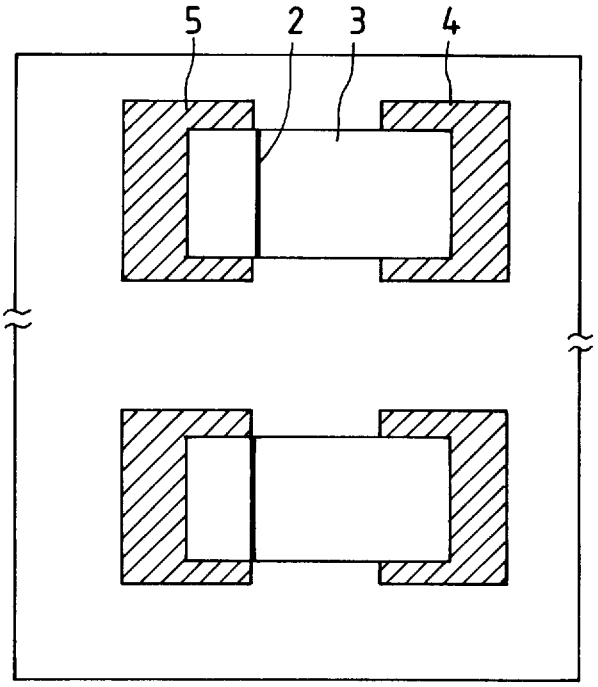
FIGS. 25A and 25B are schematic plan views of the surface conduction electron-emitting device of Example 2, showing in particular its electron emitting region.
Figure 25B:
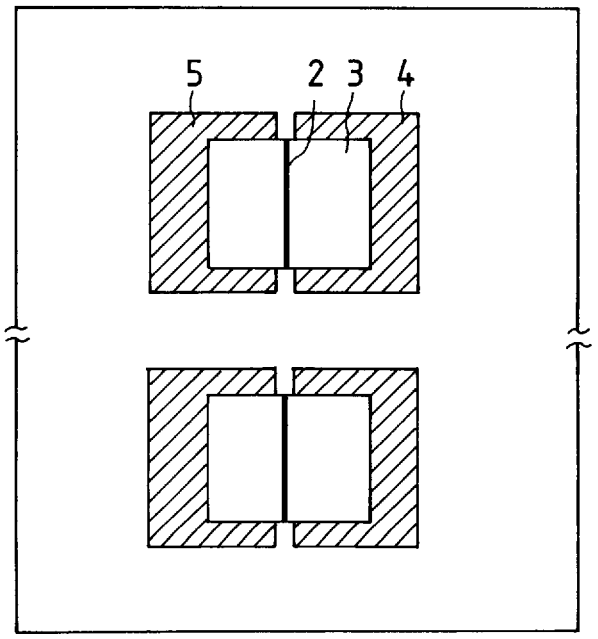

FIGS. 25A and 25B schematically illustrate what was observed for the electron-emitting region 2 of the electroconductive thin film 3 of each device on the substrates A and B. As seen from FIGS. 25A and 25B, a substantially linear electron-emitting region 2 was observed near the device electrode 5 having a higher step portion in each of the four devices on the substrate A, whereas a substantially linear electron-emitting region 2 was observed at the center of the electroconductive thin film 3 of each of the four devices on the substrate B prepared for comparison.

As described above, with a surface conduction electron-emitting device according to the invention and comprising a substantially linear electron-emitting region 2 located close to one of the device electrodes, the distance between the device electrodes can be made as long as 50 μm, or 25 times as large as the comparable distance of a conventional electron-emitting device, while the both devices operate almost identically in terms of deviation in the performance of electron emission and spread of the bright spot on the fluorescent member.

[EXAMPLE 3]

In this example, an image forming apparatus was prepared by using an electron source comprising a plurality of surface conduction electron-emitting devices of FIGS. 1A and 1B on a substrate and wiring them to form a simple matrix arrangement as shown in FIG. 14. FIG. 17 schematically illustrates the image forming apparatus.

Figure 26:
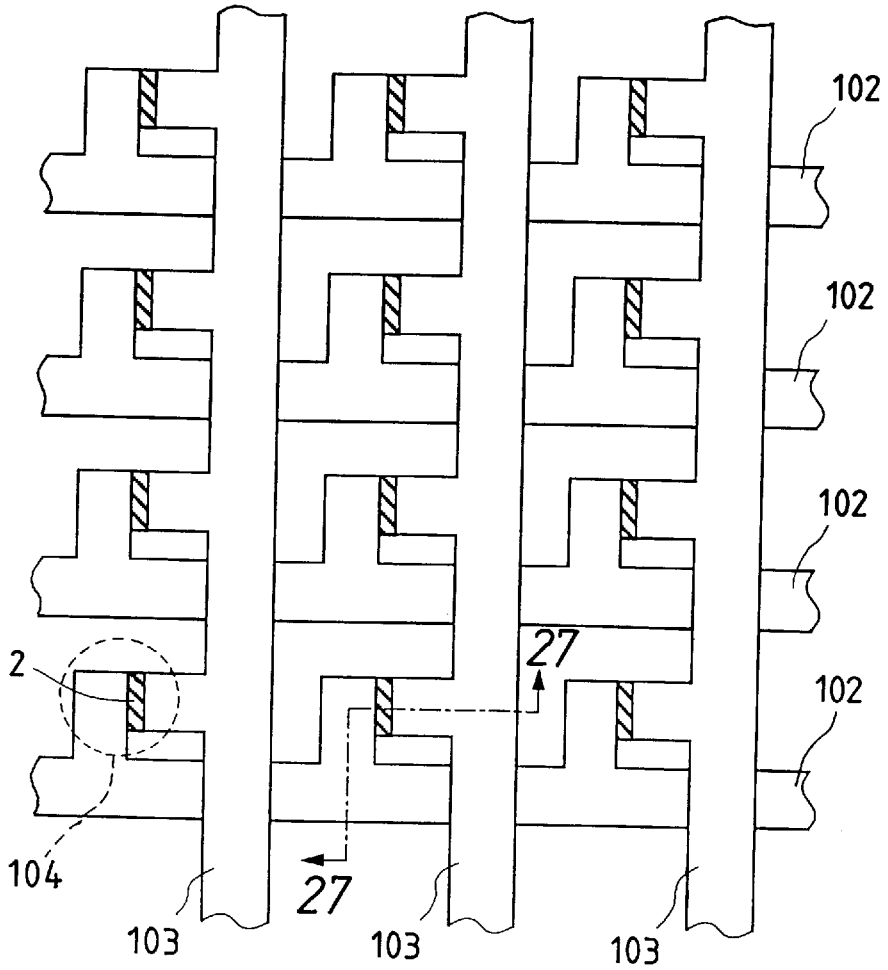
FIG. 26 is a schematic plan view of the electron source having a simple matrix arrangement of Example 3.
Figure 27:
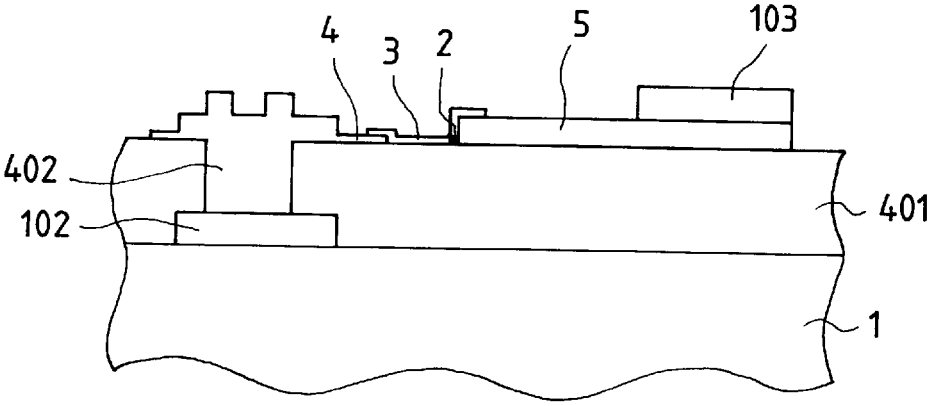
FIG. 27 is a schematic partial sectional view of the electron source of FIG. 26.
Figure 28A:
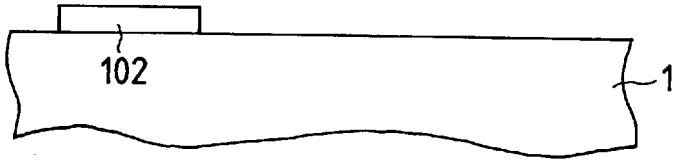
FIGS. 28A through 28D are schematic sectional views of the electron source of FIG. 26 in different manufacturing steps.
Figure 28B:
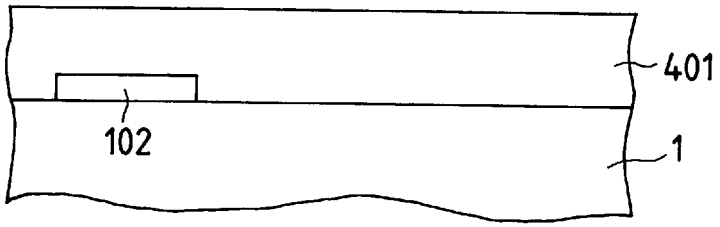
Figure 28C:
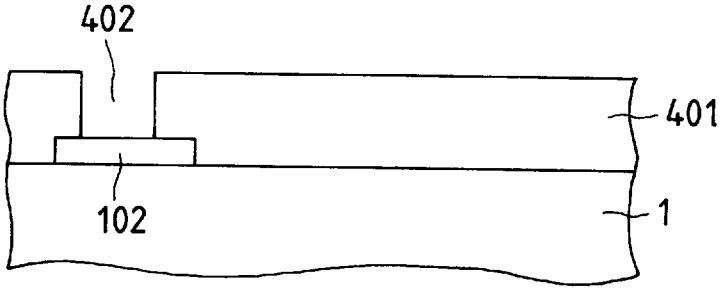
Figure 28D:
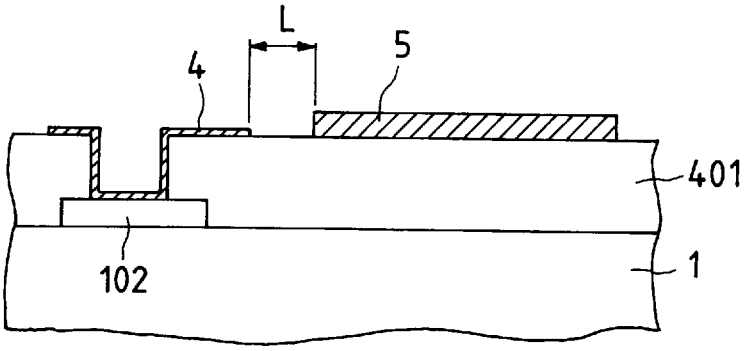
Figure 29E:
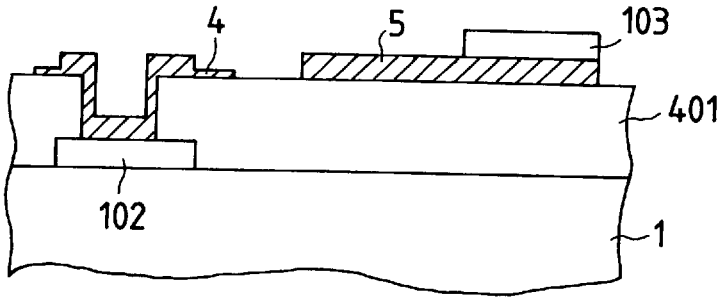
FIGS. 29E through 29H are also schematic sectional views of the electron source of FIG. 26 in different manufacturing steps.
Figure 29F:
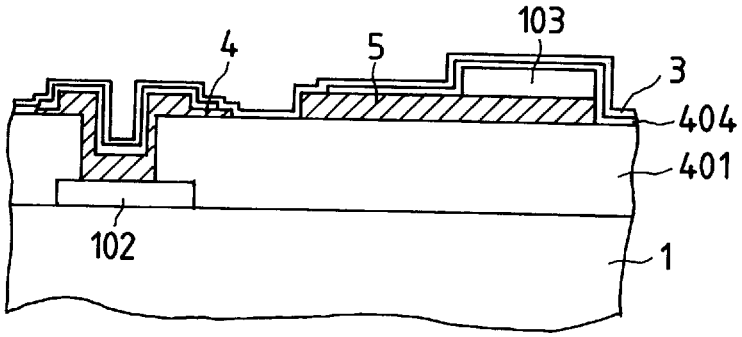
Figure 29G:
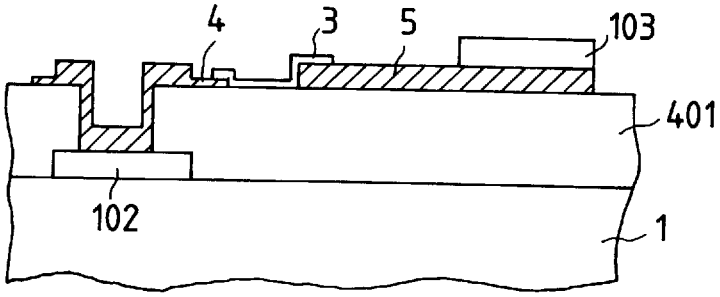
Figure 29H:
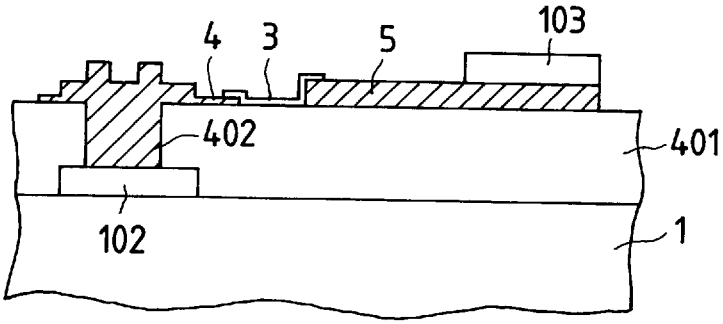

FIG. 26 shows a schematic partial plan view of the electron source. FIG. 27 is a schematic sectional view taken along line 27—27 of FIG. 26. Throughout FIGS. 14, 17, 26 and 27, same reference symbols denote same or similar components.

The electron source had a substrate 1, X-directional wires 102 (also referred to as lower wires) and Y-directional wires 103 (also referred to as upper wires). Each of the devices of the electron source comprised a pair of device electrodes 4 and 5 and an electroconductive thin film 3 including an electron-emitting region. Otherwise, the electron source was provided with an interlayer insulation layer 401 and contact holes 402, each of which electrically connected a corresponding device electrode 4 and a corresponding lower wire 102.

The steps of manufacturing the electron source will be described by referring to FIGS. 28A through 28D and 29E through 29H, which respectively correspond to the manufacturing steps as will be described hereinafter.

Step a: After thoroughly cleansing a soda lime glass plate a silicon oxide film was formed thereon to a thickness of 0.5 μm by sputtering to produce a substrate 1, on which Cr and Au were sequentially laid to thicknesses of 50 Å and 6,000 Å respectively and then a photoresist (AZ1370: available from Hoechst Corporation) was formed thereon by means of a spinner, while rotating the film, and baked. Thereafter, a photo-mask image was exposed to light and developed to produce a resist pattern for lower wires 102 and then the deposited Au/Cr film was wet-etched to produce lower wires 102.

Step b: A silicon oxide film was formed as an interlayer insulation layer 401 to a thickness of 1.0 μm by RF sputtering.

Step c: A photoresist pattern was prepared for producing a contact hole 402 for each device in the silicon oxide film deposited in Step b, which contact hole 102 was then actually formed by etching the interlayer insulation layer 401, using the photoresist pattern for a mask. A technique of RIE (Reactive Ion Etching) using $CF_4$ and $H_2$ gas was employed for the etching operation.

Step d: Thereafter, a pattern of photoresist (RD-2000N-41: available from Hitachi Chemical Co., Ltd.) was formed for a pair of device electrodes 4 and 5 of each device and a gap L separating the electrodes and then Ti and Ni were sequentially deposited thereon respectively to thicknesses of 50 Å and 400 Å by vacuum deposition. The photoresist pattern was dissolved by an organic solvent and the Ni/Ti deposit film was treated by using a lift-off technique to produce a pair of device electrodes 4 and 5 having a width WI of 200 μm and separated from each other by a distance L of 80 μm. The device electrode 5 had a thickness of 1,400 Å.

Step e: After forming a photoresist pattern on the device electrodes 4 and 5 for an upper wire 103, Ti and Au were sequentially deposited by vacuum deposition to respective thicknesses of 50 Å and 5,000 Å and then unnecessary areas were removed by means of a lift-off technique to produce an upper wire 103 having a desired profile.

Step f: Then, a Cr film 404 was formed to a film thickness of 1,000 Å by vacuum deposition, using a mask having an opening on and around the gap L between the device electrodes, which Cr film 404 was then subjected to a patterning operation. Thereafter, an organic Pd compound (ccp-4230: available from Okuno Pharmaceutical Co., Ltd.) was applied to the Cr film by means of a spinner, while rotating the film, and baked at 300° C. for 12 minutes. The formed electroconductive thin film 3 was made of fine particles containing PdO as a principal ingredient and had a film thickness of 70 Å and an electric resistance per unit area of $2\times10^4$ Ω/□.

Step g: The Cr film 404 and the baked electroconductive thin film 3 were wet-etched by using an acidic etchant to provide the electroconductive thin film 4 with a desired pattern.

Step h: Then, resist was applied to the entire surface of the substrate, which was then exposed to light and developed, using a mask, to remove it only on the contact holes 402. Thereafter, Ti and Au were sequentially deposited by vacuum deposition to respective thicknesses of 50 Å and 5,000 Å. Any unnecessary areas were removed by means of a lift-off technique to consequently bury the contact holes.

With the above steps, there was prepared an electron source comprising an insulating substrate 1, lower wires 102, an interlayer insulation layer 401, upper wires 103, device electrodes 4, 5 and electroconductive thin film 3, although the electron source had not been subjected to energization forming.

Then, an image forming apparatus was prepared by using the electron source that had not been subjected to energization forming in a manner as described below by referring to FIGS. 17 and 18A.

After rigidly securing an electron source substrate 1 onto a rear plate 111, a face plate 116 (carrying a fluorescent film 114 and a metal back 115 on the inner surface of a glass substrate 113) was arranged 5 mm above the substrate 1 with a support frame 112 disposed therebetween and, subsequently, frit glass was applied to the contact areas of the face plate 116, the support frame 112 and rear plate 111 and baked at 400° C. for 10 minutes in ambient air to hermetically seal the inside of the assembled components. The substrate 1 was also secured to the rear plate 111 by means of frit glass.

The fluorescent film 114 of this example was prepared by forming black stripes (as shown in FIG. 18A) and filling the gaps with stripe-shaped fluorescent members of red, green and blue. The black stripes were made of a popular material containing graphite as a principal ingredient. A slurry technique was used for applying fluorescent bodies 122 of three primary colors onto the glass substrate to produce the fluorescent film 114.

A metal back 115 is arranged on the inner surface of the fluorescent film 114. After preparing the fluorescent film 114, the metal back 115 was prepared by carrying out a smoothing operation (normally referred to as "filming") on the inner surface of the fluorescent film 114 and thereafter forming thereon an aluminum layer by vacuum deposition.

A transparent electrode (not shown) was be arranged on the face plate 116 in order to enhance the electroconductivity of the fluorescent film 114.

For the above bonding operation, the components were carefully aligned in order to ensure an accurate positional correspondence between the color fluorescent bodies 122 and the electron-emitting devices 104.

The inside of the prepared glass envelope 118 (airtightly sealed container) was then evacuated by way of an exhaust pipe (not shown) and a vacuum pump to a sufficient degree of vacuum and, thereafter, a forming process was carried out on the devices to produce respective electron-emitting regions 2 by applying a voltage to the device electrodes 4, 5 of the surface conduction electron-emitting devices 104 by way of the external terminals Dx1 through Dxm and Dy1 through Dyn.

For the energization forming process, a pulse voltage as shown in FIG. 3A (which was, however, not triangular but rectangularly parallelepipedic) was applied to each device in vacuum of about $1\times10^{-5}$ Torr. The pulse width of T1=1 msec and the pulse interval of T2=10 msec were used.

The electron-emitting region 2 of each surface conduction electron-emitting device produced in this manner is constituted by fine particles containing palladium as a principal ingredient and dispersed appropriately. The average particle size of the fine particles was 50 Å.

Then, the apparatus was subjected to an activation process by applying a pulse voltage as shown in FIG. 3A (which was, however, not triangular but rectangularly parallelepipedic) in vacuum of about $2\times10^{-5}$ Torr, while observing the device current If and the emission current Ie. The pulse width Ti, the pulse interval T2 and the wave height were 1 msec, 10 msec and 14V respectively.

Subsequently, the envelope 118 was evacuated via an exhaust pipe (not shown) to achieve a degree of vacuum of about $10^{-7}$ Torr. Then, the ion pump used for evacuation was switched to an oil-free pump to produce an ultrahigh vacuum condition and the electron source was baked at 200° C. for 24 hours. After the baking operation, the inside of the envelope was held to a degree of vacuum of $1\times10^{-9}$ Torr, when the exhaust pipe was sealed by heating and melting it with a gas burner to hermetically seal the envelope 118. Finally, the display panel was subjected to a getter operation by means of high frequency heating in order to maintain the inside to a high degree of vacuum.

In order to drive the display panel 201 (FIG. 17) of the image-forming apparatus, scan signals and modulation signals were applied to the electron-emitting devices 104 to emit electrons from respective signal generation means (not shown) by way of the external terminals Dx1 through Dxm and Dy1 through Dyn, while a high voltage of greater than 5 kV was applied to the metal back 115 or a transparent electrode (not shown) by way of the high voltage terminal Hv so that electrons emitted from the surface conduction electron-emitting devices were accelerated by the high voltage and collided with the fluorescent film 54 to cause the fluorescent members to excite and emit light to produce fine images of the quality of television.

Separately, an image-forming apparatus comprising the surface conduction electron-emitting devices (FIG. 23B) fabricated for the purpose of comparison in Example 1 was manufactured. This image-forming apparatus exhibited a low luminosity with larger deviation. Thus, not only an effectively lowered forming power was observed, but also the lowered forming power improved the deviation of emission current of plural surface conduction electron-emitting devices simultaneously subjected to forming operation, which is assumingly due to the deviation of forming voltages applied to the respective devices.

[EXAMPLE 4]

Figure 30:
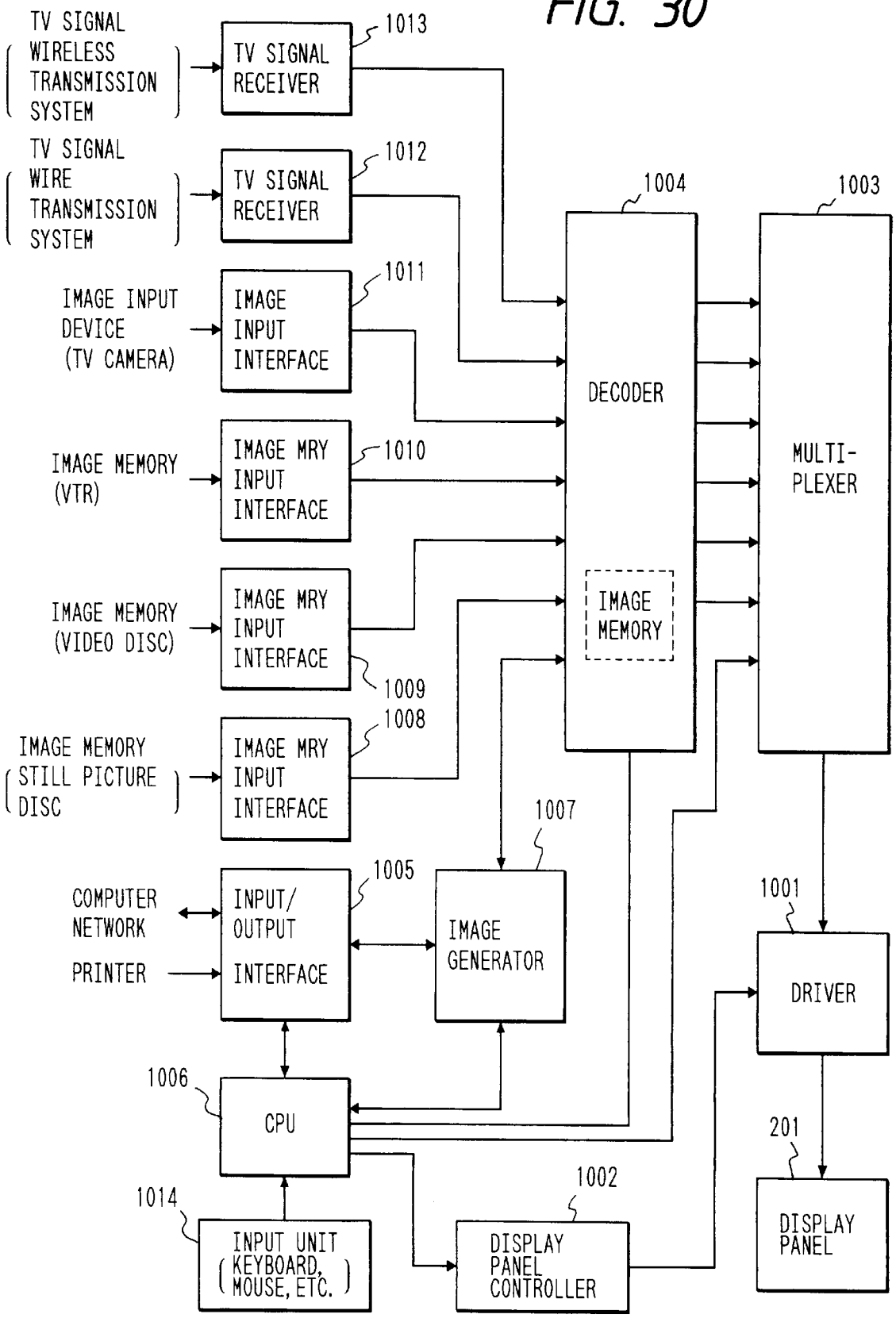
FIG. 30 is a block diagram of the image forming apparatus of Example 4.

FIG. 30 is a block diagram of a display apparatus realized by using an image forming apparatus (display panel) 201 of Example 3 and arranged to provide visual information coming from a variety of sources of information including television transmission and other image sources.

In FIG. 30, there are shown a display panel 201, a display panel drive circuit 1001, a display panel controller 1002, a multiplexer 1003, a decoder 1004, an input/output interface circuit 1005, a CPU 1006, an image generator 1007, image input memory interface circuits 1008, 1009 and 1010, an image input interface circuit 1011, TV signal reception circuits 1012 and 1013 and an input unit 1014.

If the display apparatus is used for receiving television signals that are constituted by video and audio signals, circuits, speakers and other devices are required for receiving, separating, reproducing, processing and storing audio signals along with the circuits shown in the drawing. However, such circuits and devices are omitted here in view of the scope of the present invention.

Now, the components of the apparatus will be described, following the flow of image signals therethrough. Firstly, the TV signal reception circuit 1013 is a circuit for receiving TV image signals transmitted via a wireless transmission system using electromagnetic waves and/or spatial optical telecommunication networks.

The TV signal system to be received is not limited to a particular one and any system such as NTSC, PAL or SECAM may feasibly be used with it. It is particularly suited for TV signals involving a larger number of scanning lines typically of a high definition TV system such as the MUSE system because it can be used for a large display panel 201 comprising a large number of pixels.

The TV signals received by the TV signal reception circuit 1003 are forwarded to the decoder 1004.

Secondly, the TV signal reception circuit 1012 is a circuit for receiving TV image signals transmitted via a wired transmission system using coaxial cables and/or optical fibers. Like the TV signal reception circuit 1013, the TV signal system to be used is not limited to a particular one and the TV signals received by the circuit are forwarded to the decoder 1004.

The image input interface circuit 1011 is a circuit for receiving image signals forwarded from an image input device such as a TV camera or an image pick-up scanner. It also forwards the received image signals to the decoder 1004.

The image input memory interface circuit 1010 is a circuit for retrieving image signals stored in a video tape recorder (hereinafter referred to as VTR) and the retrieved image signals are also forwarded to the decoder 1004.

The image input memory interface circuit 1009 is a circuit for retrieving image signals stored in a video disc and the retrieved image signals are also forwarded to the decoder 1004.

The image input memory interface circuit 1008 is a circuit for retrieving image signals stored in a device for storing still image data such as so-called still disc and the retrieved image signals are also forwarded to the decoder 1004.

The input/output interface circuit 1005 is a circuit for connecting the display apparatus and an external output signal source such as a computer, a computer network or a printer. It carries out input/output operations for image data and data on characters and graphics and, if appropriate, for control signals and numerical data between the CPU 1006 of the display apparatus and an external output signal source.

The image generation circuit 1007 is a circuit for generating image data to be displayed on the display screen on the basis of the image data and the data on characters and graphics input from an external output signal source via the input/output interface circuit 1005 or those coming from the CPU 1006. The circuit comprises reloadable memories for storing image data and data on characters and graphics, read-only memories for storing image patterns corresponding given character codes, a processor for processing image data and other circuit components necessary for the generation of screen images.

Image data generated by the image generation circuit 1007 for display are sent to the decoder 1004 and, if appropriate, they may also be sent to an external circuit such as a computer network or a printer via the input/output interface circuit 1005.

The CPU 1006 controls the display apparatus and carries out the operation of generating, selecting and editing images to be displayed on the display screen.

For example, the CPU 1006 sends control signals to the multiplexer 1003 and appropriately selects or combines signals for images to be displayed on the display screen. At the same time it generates control signals for the display panel controller 1002 and controls the operation of the display apparatus in terms of image display frequency, scanning method (e.g., interlaced scanning or non-interlaced scanning), the number of scanning lines per frame and so on. The CPU 1006 also sends out image data and data on characters and graphic directly to the image generation circuit 1007 and accesses external computers and memories via the input/output interface circuit 1005 to obtain external image data and data on characters and graphics.

The CPU 1006 may additionally be so designed as to participate other operations of the display apparatus including the operation of generating and processing data like the CPU of a personal computer or a word processor. The CPU 1006 may also be connected to an external computer network via the input/output interface circuit 1005 to carry out computations and other operation cooperating therewith.

The input unit 1014 is used for forwarding the instructions, programs and data given to it by the operator to the CPU 1006. As a matter of fact, it may be selected from a variety of input devices such as keyboards, mice, joysticks, bar code readers and voice recognition devices as well as any combinations thereof.

The decoder 1004 is a circuit for converting various image signals input via said circuits 1007 through 1013 back into signals for three primary colors, luminance signals and I and Q signals. Preferably, the decoder 1004 comprises image memories as indicated by a dotted line in FIG. 30 for dealing with television signals such as those of the MUSE system that require image memories for signal conversion.

The provision of image memories additionally facilitates the display of still images as well as such operations as thinning out, interpolating, enlarging, reducing, synthesizing and editing frames to be optionally carried out by the decoder 1004 in cooperation with the image generation circuit 1007 and the CPU 1006.

The multiplexer 1003 is used to appropriately select images to be displayed on the display screen according to control signals given by the CPU 1006. In other words, the multiplexer 1003 selects certain converted image signals coming from the decoder 1004 and sends them to the drive circuit 1001. It can also divide the display screen in a plurality of frames to display different images simultaneously by switching from a set of image signals to a different set of image signals within the time period for displaying a single frame.

The display panel controller 1002 is a circuit for controlling the operation of the drive circuit 1001 according to control signals transmitted from the CPU 1006.

Among others, it operates to transmit signals to the drive circuit 1001 for controlling the sequence of operations of the power source (not shown) for driving the display panel 201 in order to define the basic operation of the display panel 1000. It also transmits signals to the drive circuit 1001 for controlling the image display frequency and the scanning method (e.g., interlaced scanning or non-interlaced scanning) in order to define the mode of driving the display panel 201. If appropriate, it also transmits signals to the drive circuit 1001 for controlling the quality of the images to be displayed on the display screen in terms of luminance, contrast, color tone and sharpness.

The drive circuit 1001 is a circuit for generating drive signals to be applied to the display panel 201. It operates according to image signals coming from said multiplexer 1003 and control signals coming from the display panel controller 1002.

A display apparatus according to the invention and having a configuration as described above and illustrated in FIG. 30 can display on the display panel 201 various images given from a variety of image data sources. More specifically, image signals such as television image signals are converted back by the decoder 1004 and then selected by the multiplexer 1003 before sent to the drive circuit 1001. On the other hand, the display controller 1002 generates control signals for controlling the operation of the drive circuit 1001 according to the image signals for the images to be displayed on the display panel 1000. The drive circuit 1001 then applies drive signals to the display panel 1000 according to the image signals and the control signals. Thus, images are displayed on the display panel 1000. All the above described operations are controlled by the CPU 1006 in a coordinated manner.

The above described display apparatus can not only select and display particular images out of a number of images given to it but also carry out various image processing operations including those for enlarging, reducing, rotating, emphasizing edges of, thinning out, interpolating, changing colors of and modifying the aspect ratio of images and editing operations including those for synthesizing, erasing, connecting, replacing and inserting images as the image memories incorporated in the decoder 1004, the image generation circuit 1007 and the CPU 1006 participate such operations. Although not described with respect to the above embodiment, it is possible to provide it with additional circuits exclusively dedicated to audio signal processing and editing operations.

Thus, a display apparatus according to the invention and having a configuration as described above can have a wide variety of industrial and commercial applications because it can operate as a display apparatus for television broadcasting, as a terminal apparatus for video teleconferencing, as an editing apparatus for still and movie pictures, as a terminal apparatus for a computer system, as an OA apparatus such as a word processor, as a game machine and in many other ways.

It may be needless to say that FIG. 30 shows only an example of possible configuration of a display apparatus comprising a display panel provided with an electron source prepared by arranging a number of surface conduction electron-emitting devices and the present invention is not limited thereto.

For example, some of the circuit components of FIG. 30 may be omitted or additional components may be arranged there depending on the application. To the contrary, if a display apparatus according to the invention is used for visual telephone, it may be appropriately made to comprise additional components such as a television camera, a microphone, lighting equipment and transmission/reception circuits including a modem.

Since the display panel 201 of the image forming apparatus of this example can be realized with a remarkably reduced depth, the entire apparatus can be made very flat. Additionally, since the display panel can provide very bright images and a wide viewing angle, it produces very exciting sensations in the viewer to make him or her feel as if he or she were really present in the scene.

[Advantages of the Invention]

As described above in detail, since a surface conduction electron-emitting device according to the invention comprises a substrate and a pair of device electrodes having respective step portions with different heights and an electroconductive thin film is formed after the device electrodes to show an area of poor step coverage located for the step portion of the device electrode having a larger height, fissures can be preferentially generated by energization forming to produce an electron-emitting region along the corresponding edge of the device electrode in the area of poor step coverage of the electroconductive thin film at a position close to the surface of the substrate even if the device electrodes are separated from each other by a long distance. So, the electron-emitting region is made substantially linear without showing any swerve as in the case of conventional surface conduction electron-emitting devices.

Thus, even a large number of surface conduction electron-emitting devices according to the invention are formed on a common substrate, they are made uniform in terms of the relative position and the profile of the electron-emitting region so that the devices operate uniformly for electron emission.

Since a large number of surface conduction electron-emitting devices according to the invention arranged in an electron source having a large surface area operate uniformly for electron emission, an image forming apparatus comprising such an electron source is free from the problem of uneven brightness, degraded images and spreading electron beams attributable to swerved electron-emitting regions so that high quality images can always be produced on the display screen. The convergence of electron beams emitted from the electron-emitting region of a surface conduction electron-emitting device according to the invention can be improved if the electric potential of the device electrode located close to the electron-emitting region is made lower than that of the other device electrode. The boundaries of the light emitting spots on the image forming member of an image forming apparatus according to the invention can be made remarkably sharp and clear by applying this electric potential relationship to the entire electron source and the image forming apparatus.

[EXAMPLE 5]

In this example, surface conduction electron-emitting devices according to the invention and having a configuration illustrated in FIGS. 4A and 4B were prepared along with surface conduction electron-emitting devices for the purpose of comparison and they were tested for performance. They will be described by referring to FIGS. 1, 24AA to 24BC and 25A and 25B, where same reference symbols denote same or similar components. Since the devices for comparison were same as those of Example 2, they will not be described here any further.

The devices according to the invention were prepared in manner as described below by referring to FIGS. 31A through 31D. These devices were arranged on substrate A, whereas the devices for comparison were formed on substrate B. Four identical devices were prepared on each substrate.

1) The substrate A was made of quartz glass. After thoroughly cleansing it with a detergent, pure water and an organic solvent, a Pt film was formed thereon by sputtering to a thickness of 1,600 Å for device electrode 5 for each device (FIGS. 31A to 31D).

Subsequently, a Cr film (not shown) to be used for lift-off is formed by vacuum deposition to a thickness of 2,000 Å. At the same time, an opening of 100 $\mu$m corresponding to the width W2 of the electroconductive thin film 3 was formed in the Cr film.

2) Thereafter, a solution of organize palladium (ccp-4230: available from Okuno Pharmaceutical Co., Ltd.) was applied to the substrate A carrying device electrodes 5 by means of a spinner and left there to produce an organic Pd thin film. Then, the organic Pd thin film was heated and baked at 300° C. for 10 minutes in the atmosphere to produce an electroconductive thin film 3 mainly constituted by fine Pd particles. The film had a thickness of about 120 Å and an electric resistance of $1\times10^4$ Ω/□.

Subsequently, the Cr film and the electroconductive thin film 3 were wet etched to produce an electroconductive thin film 3 having a desired pattern by means of an acidic wet etchant (FIG. 3B).

3) Thereafter, Pt was deposited on the substrate A to a thickness of 1,600 Å by sputtering, using a mask, for device electrode 4 for each device (FIG. 31C). Note that the device electrodes 4 and 5 of each device was separated by 50 $\mu$m on the substrate A, while by 2 $\mu$m on the substrate B.

Figure 31D:
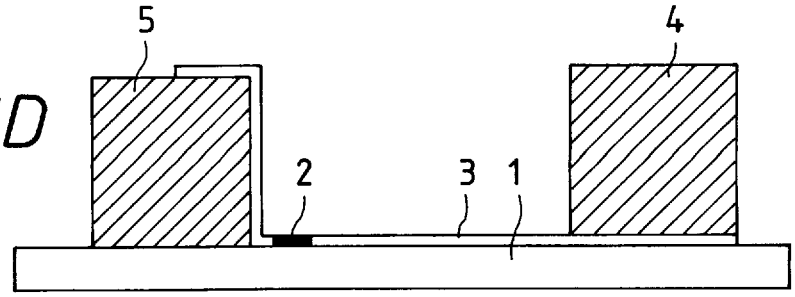

4) Then, the substrates A and B were moved into the vacuum apparatus 55 of a gauging system as illustrated in FIG. 11 and used in Example 2 and the inside of the vacuum apparatus was evacuated by means of a vacuum pump 56 to a degree of vacuum of $2\times10^6$ Torr. Thereafter, the sample devices were subjected to an energization forming process to produce an electron-emitting region 2 for each device by applying a voltage Vf between the device electrodes 4 and 5 of each device from a power source 51 (FIG. 31D). The applied voltage was a pulse voltage as shown in FIG. 3B.

The peak value of the wave height of the pulse voltage was increased stepwise by 0.1V each time as shown in FIG. 3B. The pulse width of T1=1 msec and the pulse interval of T2=10 msec were used. During the energization forming process, an extra pulse voltage of 0.1V (not shown) was inserted into intervals of the forming pulse voltage in order to determine the resistance of the electron emitting region, constantly monitoring the resistance, and the energization forming process was terminated when the resistance exceeded 1 MΩ.

5) Subsequently, the inside of the vacuum apparatus 55 of the gauging system of FIG. 11 was further evacuated to about $10^{-5}$ Torr and then acetone was introduced into the vacuum apparatus 55 as an organic substance. The partial pressure of acetone was set to $1\times10^{-4}$ Torr. A pulse voltage was applied to each sample device on the substrates A and B to drive it for an activation process. Referring to FIG. 3A, the pulse width of T1=1 msec and the pulse interval of T2=10 msec were used and the drive voltage (wave height) was 15V. A voltage of 1 kV was also applied to the anode 54 of the vacuum apparatus, while observing the emission current (Ie) of each electron-emitting device. The activation process was terminated when Ie got to a saturated state. The time required for the activation process was about 20 minutes.

6) Then, after further evacuating the inside of the vacuum apparatus to about $1\times10^{-6}$ Torr, each sample surface conduction electron-emitting device on the substrates A and B was driven to operate within the vacuum apparatus 55 of about $10^{-6}$ Torr in order to see the device current If and the emission current Ie. The voltage applied to the anode 54 was 1 kV and the device voltage (Vf) was 15V. The electric potential of the device electrode 4 was held higher than of the device electrode 5 for each device.

As a result of the measurement, the device current (If) and the emission current (Ie) of each device on the substrate B were 1.0 mA±5% and 0.9 $\mu$A±4% respectively. On the other hand, the device current (If) and the emission current (Ie) of each device on the substrate A were 0.9 mA±5% and 0.85 $\mu$A±4% respectively to show a level of deviation substantially equal to all the devices.

At the same time, a fluorescent member was arranged on the anode 54 to observe bright spots produced on the fluorescent member as electron beams emitted from the electron-emitting devices collide with it. The size and profile of the bright spots were substantially same for all the devices.

After the measurement, the electron-emitting regions 2 of the devices on the substrates A and B were microscopically observed.

FIGS. 25A and 25B schematically illustrate what was observed for the electron-emitting region 2 of the electroconductive thin film 3 of each device on the substrates A and B. As seen from FIGS. 25A and 25B, a substantially linear electron-emitting region 2 was observed near the device electrode 5 having a higher step portion in each of the four devices on the substrate A, whereas a substantially linear electron-emitting region 2 like the devices on the substrate A was observed in the generally central portion between the device electrodes in each device.

As described above, a surface conduction electron-emitting device according to the invention and comprising a substantially linear electron-emitting region 2 located close to one of the device electrodes operates to emit highly convergent electron beams without showing any substantial deviation in the performance like a conventional surface conduction electron-emitting device wherein the device electrodes are separated by only 2 $\mu$m. Thus, the distance separating the device electrodes of a surface conduction electron-emitting device according to the invention can be made as large as 50 $\mu$m or 25 times larger than that of a conventional surface conduction electron-emitting device.

While the device electrodes 4 and 5 of each device was prepared by sputtering in this example, the technique that can be used for producing device electrodes is not limited thereto and a surface conduction electron-emitting device according to the invention may be prepared in a more simple way by utilizing a printing technique.

[EXAMPLE 6]

In this example, a number of surface conduction electron-emitting devices having a configuration illustrated in FIGS. 1A and 1B were prepared along with a number of surface conduction electron-emitting devices for the purpose of comparison and they were tested for performance. FIG. 1A is a plan view and FIG. 1B is a cross sectional side view of a surface conduction electron-emitting device according to the invention and used in this example. Referring to FIGS.

1A and 1B, W1 denotes the width of the device electrodes 4 and 5 and W2 denotes the width of the electroconductive thin film 3, while L denotes the distance separating the device electrodes 4 and 5 and d1 and d2 respectively denotes the height of the device electrode 4 and that of the device electrode 5.

Figure 32A:
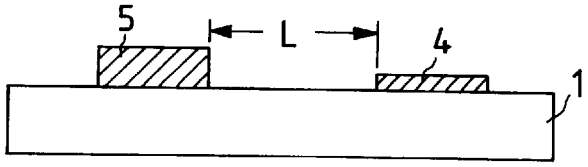
FIGS. 32AA through 32AC and 32BA through 32BC are schematic sectional views of the surface conduction electron-emitting device of Example 6 in different manufacturing steps.
Figure 32A:
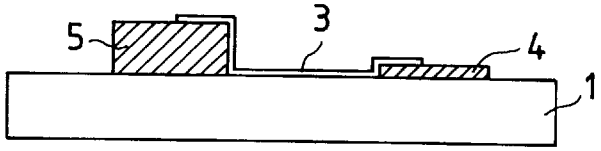
Figure 32A:
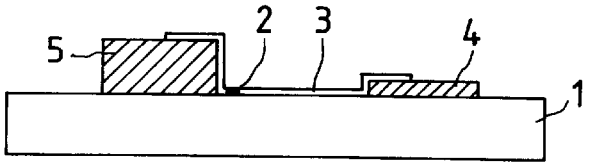
Figure 32B:
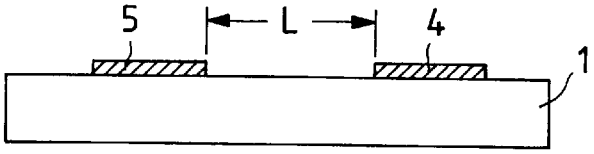
Figure 32B:
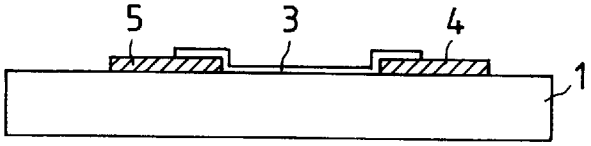
Figure 32B:
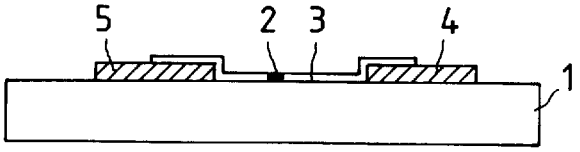

FIGS. 32AA through 32AC show a surface conduction electron-emitting device arranged on substrate A in different manufacturing steps whereas FIGS. 32BA through 32BC shows another surface conduction electron-emitting device also in different manufacturing steps, the latter being prepared for the purpose of comparison and arranged on substrate B. Four identical electron-emitting devices were produced on each of the substrates A and B.

1) After thoroughly cleansing a quartz glass plate with a detergent, pure water and an organic solvent for each of the substrates A and B, a Pt film was formed thereon by sputtering to a thickness of 300 Å for a pair of device electrodes for each device, using a mask. For the substrate A, Pt was deposited further to a thickness of 800 Å for the device electrode 4 (FIGS. 32AA and 32BA).

Both of the device electrodes 4 and 5 on the substrate B had a thickness of 300 Å, whereas the device electrodes 4 and 5 on the substrate A had respective thicknesses of 300 Å and 1,100 Å. The device electrodes were separated by a distance L of 100 μm for both the substrate A and the substrate B.

Thereafter, a Cr film (not shown) to be used for lift-off is formed by vacuum deposition to a thickness of 1,000 Å on each of the substrates A and B for the purpose of patterning the electroconductive thin film 3. At the same time, an opening of 100 μm corresponding to the width W2 of the electroconductive thin film 3 was formed in the Cr film.

The subsequent steps were identical to both the substrate A and the substrate B.

2) Thereafter, a solution of organize palladium (ccp-4230: available from Okuno Pharmaceutical Co., Ltd.) was sprayed onto the substrate 1 with the device electrodes 4 and 5 formed thereon. In the course of this operation, a voltage of 5 kV was applied to between the nozzle and the device electrodes to charge and accelerate the fine liquid particles of organic palladium solution. Thereafter, the organic Pd thin film was heated and baked at 300° C. for 10 minutes in the atmosphere to produce an electroconductive thin film 3 mainly constituted by fine PdO particles. The film had a thickness of about 100 Å and an electric resistance of $Rs=5\times10^3$ Ω/□.

Subsequently, the Cr film and the electroconductive thin film 3 were wet etched to produce an electroconductive thin film 3 having a desired pattern by means of an acidic wet etchant. (FIGS. 32AB and 32BB)

3) Then, the substrates A and B were moved into the vacuum apparatus 55 of a gauging system as illustrated in FIG. 11 and heated in vacuum to chemically reduce the PdO to Pd in the electroconductive thin film 3 of each sample device. Then, the sample devices were subjected to an energization forming process to produce an electron-emitting region 2 by applying a device voltage Vf between the device electrodes 4 and 5 of each device (FIGS. 32AC and 32BC). The applied voltage was a pulse voltage as shown in FIG. 3B (which was, however, not triangular but rectangularly parallelepipedic).

Referring to FIG. 3B, the pulse width of T1=1 msec and the pulse interval of T2=10 msec were used. The wave height of the rectangularly parallelepipedic wave was increased gradually.

4) Subsequently, the substrates A and B were subjected to an activation process, maintaining the inside pressure of the vacuum apparatus 55 to about $10^{-5}$ Torr. A pulse voltage (which was, however, not triangular but rectangularly parallelepipedic) was applied to each sample device to drive it. The pulse width of T1=1 msec and the pulse interval of T2=10 msec were used and the drive voltage (wave height) was 15V. The activation process was terminated in 30 minutes.

5) Then, each sample surface conduction electron-emitting device on the substrates A and B was driven to operate within the vacuum apparatus 55 of about $10^{-6}$ Torr in order to see the device current If and the emission current Ie. After the measurement, the electron-emitting regions 2 of the devices on the substrates A and B were microscopically observed.

As for the parameters of the measurement, the distance H between the anode 54 and the electron-emitting device was 5 mm and the anode voltage and the device voltage Vf were respective 1 kV and 18V. The electric potential of the device electrode 5 was made lower than that of the device electrode 6.

As a result of the measurement, the device current If and the emission current of each device on the substrate B were 1.2 mA±25% and 1.0 μA±30% respectively. On the other hand, the device current If and the emission current of each device on the substrate A were 1.0 mA±5% and 0.95 μA±4.5% to show a remarkably reduced deviation among the devices.

At the same time, a fluorescent member was arranged on the anode 54 to see the bright spot on the fluorescent member produced by an electron beam emitted from each sample electron-emitting device surface and it was observed that the bright spot produced by a device on the substrate A was smaller than its counterpart produced by a device on the substrate B by about 30 μm.

Figure 33A:
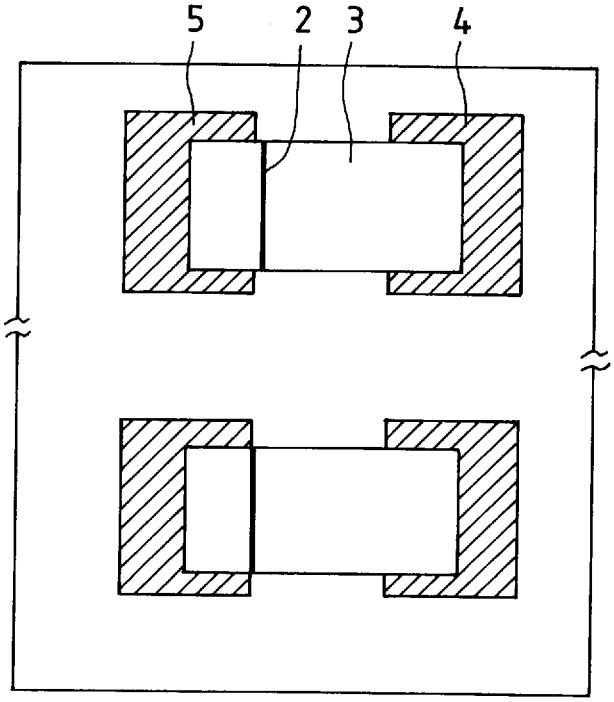
FIGS. 33A and 33B are schematic plan views of the surface conduction electron-emitting device of Example 6, showing in particular its electron emitting region.
Figure 33B:
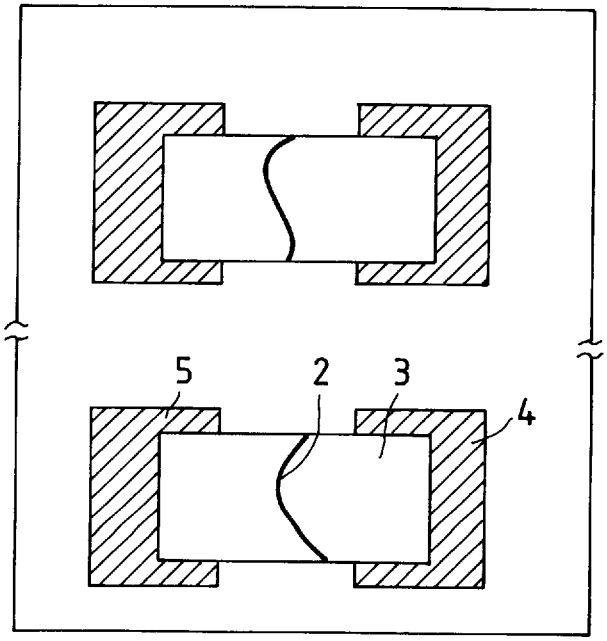

FIGS. 33A and 33B schematically illustrate what was observed for the electron-emitting region 2 of the electroconductive thin film 3 of each device on the substrate A and B. As seen from FIGS. 33A and 33B, a substantially linear electron-emitting region 2 was observed near the device electrode 5 having a higher step portion (having a larger thickness) in each of the four devices on the substrate A, whereas a swerved electron-emitting region 2 was observed in the electroconductive thin film 3 of each of the four devices on the substrate B prepared for comparison. The electron-emitting region 2 was swerved by about 50 μm at the middle point.

As described above, a surface conduction electron-emitting device according to the invention and comprising a substantially linear electron-emitting region 2 located close to one of the device electrodes operates remarkably well to emit highly convergent electron beams without showing any substantial deviation in the performance. It was also found that a surface conduction electron-emitting device according to the invention produces a relatively large bright spot on the fluorescent member if the electric potential of the device electrode 5 is made higher than that of the device electrode 4.

[EXAMPLE 7]

In this example, the second method of manufacturing a surface conduction electron-emitting device according to the invention was used as will be described below by referring to FIGS. 34A through 34C.

Figure 34A:
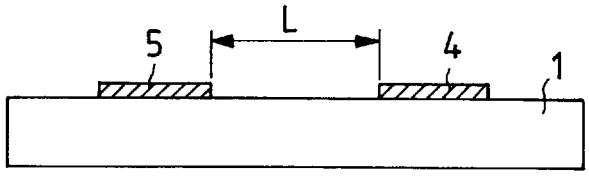
FIGS. 34A through 34C are schematic sectional views of the surface conduction electron-emitting device of Example 7 in different manufacturing steps.

1) After thoroughly cleansing a quartz glass plate with a detergent, pure water and an organic solvent for a substrates 1, a Pt film was formed thereon by sputtering to a thickness of 300 Å for a pair of device electrodes (FIG. 34A). The device electrodes were separated by a distance L of 100 μm.

2) Thereafter, a solution of organic palladium (ccp-4230: available from Okuno Pharmaceutical Co., Ltd.) was sprayed onto the substrate 1 from a nozzle, while applying a voltage of 5 kV to the device electrodes 4 and 5 from a power source 11. As in the case of Example 6, a voltage of 5 kV was also applied between the device electrodes and the nozzle in order to charge the fine drops of the sprayed organic palladium solution with electricity and accelerate their speed before they got to the substrate 1. As a result, a dense film was formed on the device electrode 4 having a lower electric potential, whereas a less dense film was formed on the other device electrode 5 having a higher electric potential to produce a poorly covered area on the step portion of the device electrode 5. Thereafter, the organic Pd thin film was heated and baked at 300° C. for 10 minutes in the atmosphere to produce an electroconductive thin film 3 mainly constituted by fine PdO particles. The film had a thickness of about 100 Å and an electric resistance of $Rs=5\times10^3$ Ω/□.

Figure 34B:
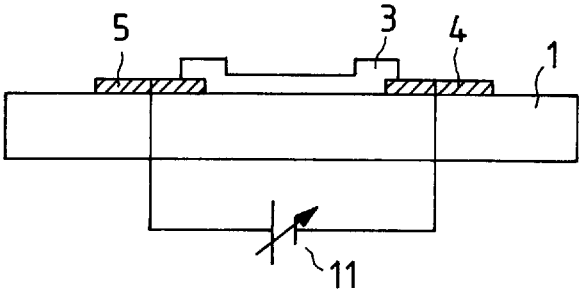
Figure 34C:
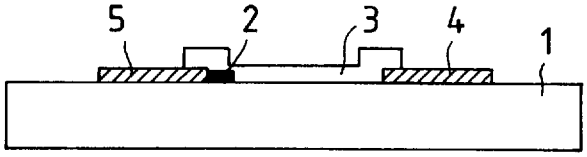

Subsequently, any unnecessary areas of the Cr film were removed by patterning to prouce an electroconductive thin film 3 having a desired profile (FIG. 34B).

3) Then, the substrates A and B were moved into the vacuum apparatus 55 of a gauging systemtem as illustrated in FIG. 11 and heated in vacuum to chemically reduce the PdO to Pd in the electroconductive thin film 3 of each sample device. Then, the sample device was subjected to an energization forming process to produce an electron-emitting region 2 by applying a device voltage Vf between the device electrodes 4 and 5 of each device (FIG. 34C). The applied voltage was a pulse voltage as shown in FIG. 3B (which was, however, not triangular but rectangularly parallelepipedic).

The peak value of the wave height of the rectangularly parallelepipedic pulse voltage was gradually increased with time as shown in FIG. 3B. The pulse width of T1=1 msec and the pulse interval of T2=10 msec were used.

Thereafter, as in case of Example 6, the sample device was subjected to an activation process and then tested for performance. It was found that the device performed well for electron emission like the devices of Example 6.

When viewed through a microspcope, a substantially linear electron-emitting region 2 was observed along and near the device electrode 5 that had been held to a higher electric potential for spraying an organic palladium solution through a nozzle.

[EXAMPLE 8]

In this example, surface conduction electron-emitting devices according to the invention and surface conduction electron-emitting devices were prepared for comparison respectively on substrates A and B and tested for the electron-emitting performance as in the case of Example 6.

This example will be described by referring to FIGS. 35AA through 35AC (for substrate A) and FIGS. 35BA through 35BC (for substrate B). Four identical surface conduction electron-emitting devices according to the invention were prepared on the substrate A. Likewise, four identical surface conduction electron-emitting devices were prepared on the substrate B for comparison.

1) After thoroughly cleansing a quartz glass plate with a detergent, pure water and an organic solvent for each of the substrates A and B, an $SiO_x$ film was formed to a thickness of 1,500 Å only on the substrate A, to which resist was subsequently applied and patterned. Thereafter, the $SiO_x$ film was removed by reactive ion etching except an area for producing device electrode 5 in each device so that a control member 21 of $SiO_x$ was formed in the area of the device electrode 5. Subsequently, Pt was deposited by sputtering to a thickness of 300 Å for device electrodes on the substrates A and B, using masks (FIGS. 35AA and 35BA).

The stepped portions of the device electrodes 4 and 5 were 300 Å high on the substrate B, whereas those of the device electrodes 5 were 1,800 Å high and those of the device electrodes 4 were 300 Å on the substrate A. The distance L separating the device electrodes of each device was 50 μm on the substrate A, whereas the corresponding value was 2 μm on the substrate B.

Thereafter, a Cr film (not shown) to be used for lift-off is formed by vacuum deposition to a thickness of 1,000 Å on each of the substrates A and B for the purpose of patterning the electroconductive thin film 3. At the same time, an opening of 100 μm corresponding to the width W2 of the electroconductive thin film 3 was formed in the Cr film.

The subsequent steps were identical to both the substrate A and the substrate B.

2) Thereafter, an organic metal solution obtained by dissolving an organic complex of Pt into solvent was sprayed through a nozzle to form an organic Pt thin film on the substrates that carried the device electrodes thereon, which organic Pt thin film was heated and baked in vacuum to produce an electroconductive thin film 3 of Pt for each device. The thin film had a thickness of about 30 Å and an electric resistance per unit area of $5\times10^2$ Ω/□.

Figure 35A:
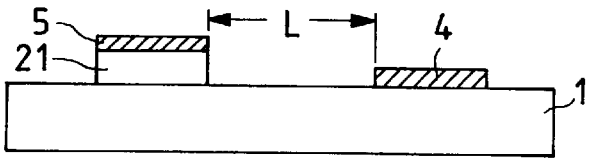
FIGS. 35AA through 35AC and 35BA through 35BC are schematic sectional views of the surface conduction electron-emitting device of Example 8 in different manufacturing steps.
Figure 35A:
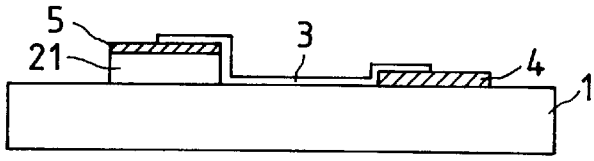
Figure 35A:
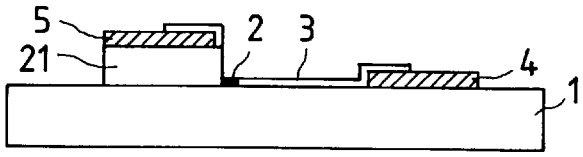
Figure 35B:
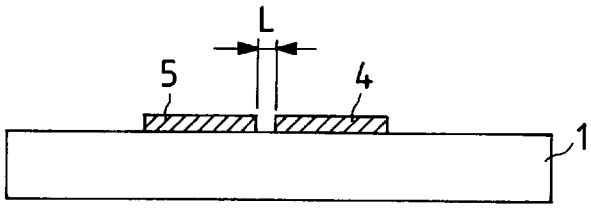
Figure 35B:
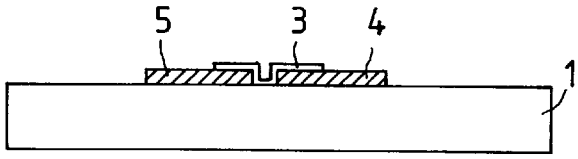
Figure 35B:
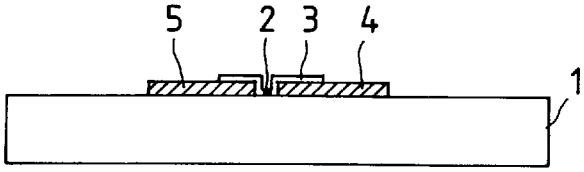

Subsequently, the Cr film and the electroconductive thin film 3 were wet etched to produce an electroconductive thin film 3 having a desired pattern by means of an acidic wet etchant (FIGS. 35AB and 35BB).

3) Then, the devices on the substrates A and B were subjected to an energization forming process as in the case of Example 6 (FIGS. 35AC and 35BC).

4) Subsequently, the substrates A and B were subjected to an activation process as in case of Example 6.

5) Then, each sample surface conduction electron-emitting device on the substrates A and B was driven to operate within the vacuum apparatus 55 of about $10^6$ Torr in order to see the device current If and the emission current Ie. After the measurement, the electron-emitting regions 2 of the devices on the substrates A and B were microscopically observed.

As for the parameters of the measurement, the distance H between the anode 54 and the electron-emitting device was 5 mm and the anode voltage and the device voltage Vf were respective 1 kV and 15V. The electric potential of the device electrode 5 was made lower than that of the device electrode 6.

As a result of the measurement, the device current If and the emission current of each device on the substrate B were 1.0 mA±5% and 1.0 μA±5% respectively. On the other hand, the device current If and the emission current of each device on the substrate A were 0.95 mA±4.5% and 0.92 μA±5.0% to show a substantially equal deviation among the devices.

At the same time, a fluorescent member was arranged on the anode 54 to see the bright spot on the fluorescent member produced by an electron beam emitted from each sample electron-emitting device surface and it was observed that the bright spot produced by a device on the substrate A was substantially equal to its counterpart produced by a device on the substrate B.

Figure 36A:
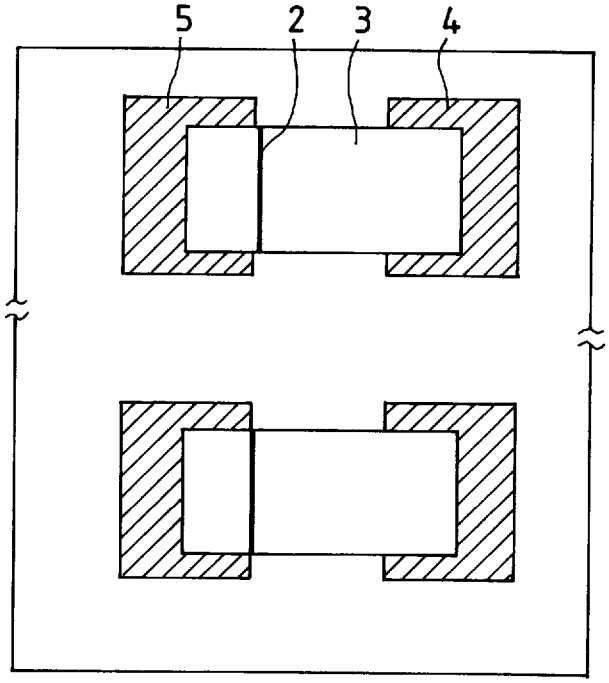
FIGS. 36A and 36B are schematic plan views of the surface conduction electron-emitting device of Example 8, showing in particular its electron emitting region.
Figure 36B:
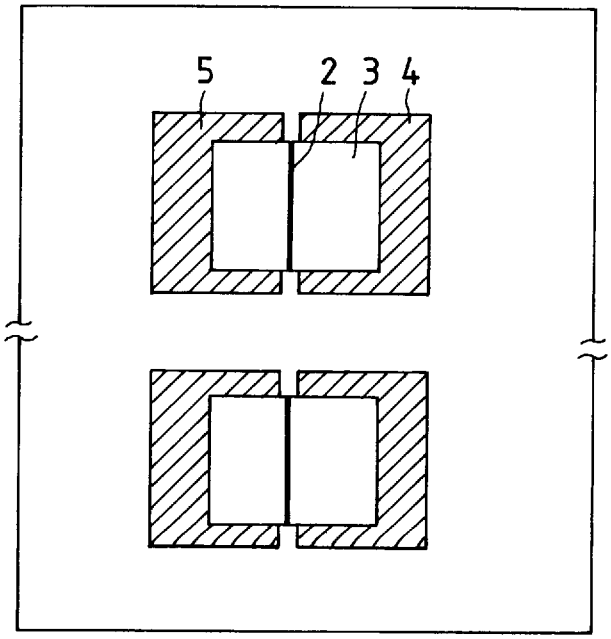

FIGS. 36A and 36B schematically illustrate what was observed for the electron-emitting region 2 of the electroconductive thin film 3 of each device on the substrates A and B. As seen from FIGS. 36A and 36B, a substantially linear electron-emitting region 2 was observed near the device electrode 5 having a higher step portion in each of the four devices on the substrate A, whereas a substantially linear electron-emitting region 2 was observed at the center of the electroconductive thin film 3 of each of the four devices on the substrate B prepared for comparison.

As described above, with a surface conduction electron-emitting device according to the invention and comprising a substantially linear electron-emitting region 2 located close to one of the device electrodes, the distance between the device electrodes can be made as long as 50 μm, or 25 times as large as the comparable distance of a conventional electron-emitting device, while the both devices operate almost identically in terms of deviation in the performance of electron emission and spread of the bright spot on the fluorescent member.

[EXAMPLE 9]

In this example, an image forming apparatus was prepared by using an electron source comprising a plurality of surface conduction electron-emitting devices of FIGS. lA and 1B on a substrate and wiring them to form a simple matrix arrangement as shown in FIG. 14. FIG. 17 schematically illustrates the image forming apparatus.

FIG. 26 shows a schematic partial plan view of the electron source. FIG. 27 is a schematic sectional view taken along line 27—27 of FIG. 26. Throughout FIGS. 14, 17, 26 and 27, same reference symbols denote same or similar components.

The steps of manufacturing the electron source will be described by referring to FIGS. 28A through 28D and 29E through 29H, which respectively correspond to the manufacturing steps as will be described hereinafter.

Step a: After thoroughly cleansing a soda lime glass plate a silicon oxide film was formed thereon to a thickness of 0.5 μm by sputtering to produce a substrate 1, on which Cr and Au were sequentially laid to thicknesses of 50 Å and 6,000 Å respectively and then a photoresist (AZ1370: available from Hoechst Corporation) was formed thereon by means of a spinner, while rotating the film, and baked. Thereafter, a photo-mask image was exposed to light and developed to produce a resist pattern for lower wires 102 and then the deposited Au/Cr film was wet-etched to produce lower wires 102.

Step b: A silicon oxide film was formed as an interlayer insulation layer 401 to a thickness of 1.0 μm by RF sputtering.

Step c: A photoresist pattern was prepared for producing a contact hole 402 for each device in the silicon oxide film deposited in Step b, which contact hole 102 was then actually formed by etching the interlayer insulation layer 401, using the photoresist pattern for a mask. A technique of RIE (Reactive Ion Etching) using $CF_4$ and $H_2$ gas was employed for the etching operation.

Step d: Thereafter, a pattern of photoresist (RD-2000N-41: available from Hitachi Chemical Co., Ltd.) was formed for a pair of device electrodes 4 and 5 of each device and a gap L separating the electrodes and then Ti and Ni were sequentially deposited thereon respectively to thicknesses of 50 Å and 400 Å by vacuum deposition. The photoresist pattern was dissolved by an organic solvent and the Ni/Ti deposit film was treated by using a lift-off technique to produce a pair of device electrodes 4 and 5 having a width W1 of 200 μm and separated from each other by a distance L of 80 μm. The device electrode 5 had a thickness of 1,400 Å.

Step e: After forming a photoresist pattern on the device electrodes 4 and 5 for an upper wire 103, Ti and Au were sequentially deposited by vacuum deposition to respective thicknesses of 50 Å and 5,000 Å and then unnecessary areas were removed by means of a lift-off technique to produce an upper wire 103 having a desired profile.

Step f: Then, a Cr film 404 was formed to a film thickness of 1,000 Å by vacuum deposition, using a mask having an opening on and around the gap L between the device electrodes, which Cr film 404 was then subjected to a patterning operation. Thereafter, an organic Pd compound (ccp-4230: available from Okuno Pharmaceutical Co., Ltd.) was sprayed onto the Cr film and baked at 300° C. for 12 minutes. The formed electroconductive thin film 3 was made of fine particles containing PdO as a principal ingredient and had a film thickness of 70 Å and an electric resistance per unit area of $2\times10^4$ Ω/□.

Step g: The Cr film 404 and the baked electroconductive thin film 3 were wet-etched by using an acidic etchant to provide the electroconductive thin film 4 with a desired pattern.

Step h: Then, resist was applied to the entire surface of the resist on the substrate, which was then exposed to light and developed to remove it only on the contact hole 404. Thereafter, Ti and Au were sequentially deposited by vacuum deposition to respective thicknesses of 50 Å and 5,000 Å. Any unnecessary areas were removed by means of a lift-off technique to consequently bury the contact hole 402.

With the above steps, there was prepared an electron source comprising an insulating substrate 1, lower wires 102, an interlayer insulation layer 401, upper wires 103, device electrodes 4, 5 and electroconductive thin films 3, although the electron source had not been subjected to energization forming.

Then, an image forming apparatus was prepared by using the electron source that had not been subjected to energization forming in a manner as described below by referring to FIGS. 17 and 18A.

After rigidly securing an electron source substrate 1 onto a rear plate 111, a face plate 116 (carrying a fluorescent film 114 and a metal back 115 on the inner surface of a glass substrate 113) was arranged 5 mm above the substrate 1 with a support frame 112 disposed therebetween and, subsequently, frit glass was applied to the contact areas of the face plate 116, the support frame 112 and rear plate 111 and baked at 400° C. for 10 minutes in ambient air to hermetically seal the inside of the assembled components. The substrate 1 was also secured to the rear plate 111 by means of frit glass.

The fluorescent film 114 of this example was prepared by forming black stripes (as shown in FIG. 18A) and filling the gaps with stripe-shaped fluorescent members of red, green and blue. The black stripes were made of a popular material containing graphite as a principal ingredient. A slurry technique was used for applying fluorescent bodies 122 of three primary colors onto the glass substrate to produce the fluorescent film 114.

A metal back 115 is arranged on the inner surface of the fluorescent film 114. After preparing the fluorescent film 114, the metal back 115 was prepared by carrying out a smoothing operation (normally referred to as "filming") on the inner surface of the fluorescent film 114 and thereafter forming thereon an aluminum layer by vacuum deposition.

A transparent electrode (not shown) was be arranged on the face plate 116 in order to enhance the electroconductivity of the fluorescent film 114.

For the above bonding operation, the components were carefully aligned in order to ensure an accurate positional correspondence between the color fluorescent bodies 122 and the electron-emitting devices 104.

The inside of the prepared glass envelope 118 (airtightly sealed container) was then evacuated by way of an exhaust pipe (not shown) and a vacuum pump to a sufficient degree of vacuum and, thereafter, a forming process was carried out on the devices to produce respective electron-emitting regions 2 by applying a voltage to the device electrodes 4, 5 of the surface conduction electron-emitting devices 104 by way of the external terminals Dx1 through Dxm and Dy1 through Dyn.

For the energization forming process, a pulse voltage as shown in FIG. 3B (which was, however, not triangular but rectangularly parallelepipedic) was applied to each device in vacuum of about $1\times10^{-5}$ Torr. The pulse width of T1=1 msec and the pulse interval of T2=10 msec were used.

The electron-emitting region 2 of each surface conduction electron-emitting device produced in this manner is constituted by fine particles containing palladium as a principal ingredient and dispersed appropriately. The average particle size of the fine particles was 50 Å.

Then, the apparatus was subjected to an activation process by applying a pulse voltage as shown in FIG. 3A (which was, however, not triangular but rectangularly parallelepipedic) was applied to each device in vacuum of about $2\times10^{-5}$ Torr. The pulse width T1, the pulse interval T2 and the wave height were 1 msec, 10 msec and 14V respectively.

Subsequently, the envelop 118 was evacuated via an exhaust pipe (not shown) to achieve a degree of vacuum of about $2\times10^{-7}$ Torr. Then, the ion pump used for evacuation was switched to an oil-free pump to produce an ultrahigh vacuum condition and the electron source was baked at 180° C. for 10 hours. After the baking operation, the inside of the envelope was held to a degree of vacuum of $1\times10^{-8}$ Torr, when the exhaust pipe was sealed by heating and melting it with a gas burner to hermetically seal the envelope 118. Finally, the display panel was subjected to a getter operation by means of high frequency heating in order to maintain the inside to a high degree of vacuum.

In order to drive the display panel 201 (FIG. 17) of the image-forming apparatus, scan signals and modulation signals were applied to the electron-emitting devices 104 to emit electrons from respective signal generation means (not shown) by way of the external terminals Dx1 through Dxm and Dy1 through Dyn, while a high voltage of greater than 5 kV was applied to the metal back 115 or a transparent electrode (not shown) by way of the high voltage terminal Hv so that electrons emitted from the cold cathode devices were accelerated by the high voltage and collided with the fluorescent film 54 to cause the fluorescent members to excite and emit light to produce fine images of the quality of high definition television, which were free from the problem of uneven brightness.

[EXAMPLE 10]

In this example, surface conduction electron-emitting devices according to the invention and conventional surface conduction electron-emitting devices were prepared for comparison respectively on substrates A and B and tested for the electron-emitting performance. This example will be described by referring to FIGS. 37AA through 37AD (for substrate A) and FIGS. 37BA through 37BD (for substrate B). Four identical surface conduction electron-emitting devices according to the invention were prepared on the substrate A. Likewise, four identical conventional surface conduction electron-emitting devices were prepared on the substrate B for comparison.

1) After thoroughly cleansing the substrates with a detergent, pure water and an organic solvent, Pt was deposited by sputtering on them to a thickness of 300 Å for device electrodes 4 and 5, using a mask on the both substrate A and B and, thereafter, Pt was further deposited only on the substrate A to a thickness of 800 Å, masking the device electrodes 4. Thus, the device electrodes 5 had a thickness of 300 Å on the substrate B but a greater thickness of 1,100 Å on the substrate A. All the device electrodes 4 had an equal thickness of 300 Å on the both substrate A and B.

2) Thereafter, a Cr film (not shown) to be used for lift-off is formed by vacuum deposition to a thickness of 1,000 Å on each of the substrates A and B for the purpose of patterning the electroconductive thin film 3. The distance L between the device electrodes of each device and the width W of the electroconductive thin film of each device for producing an electron-emitting region were equally 100 μm. Thereafter, an organic Pd compound (ccp-4230: available from Okuno Pharmaceutical Co., Ltd.) was applied to the substrates between the device electrodes 4 and 5 of each device by means of a spinner and left there until an electroconductive thin film was produced. The electroconductive thin film was then heated and baked at 300° C. for 10 minutes in ambient air. The formed electroconductive thin film 3 was made of fine particles containing PdO as a principal ingredient and had a film thickness of 100 Å and an electric resistance per unit area of $5\times10^4$ Ψ/□.

Figure 37A:
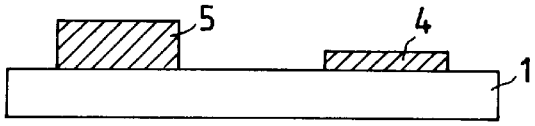
FIGS. 37AA through 37AD and 37BA through 37BD are schematic sectional views of the surface conduction electron-emitting device of Example 10 having the second basic structure, the device being shown in different manufacturing steps.
Figure 37A:
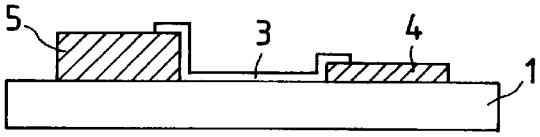
Figure 37A:
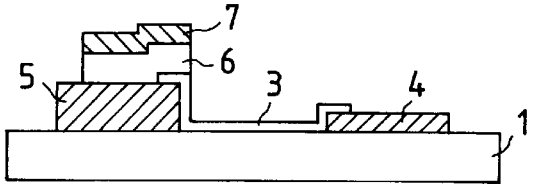
Figure 37A:
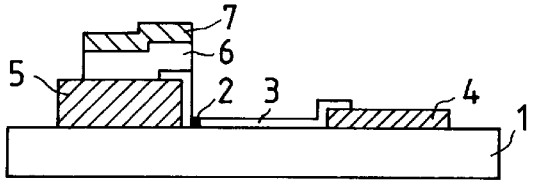
Figure 37B:
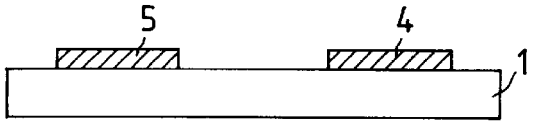
Figure 37B:
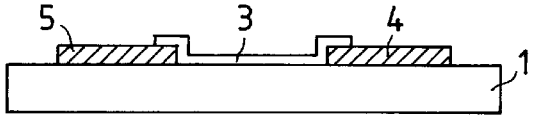
Figure 37B:
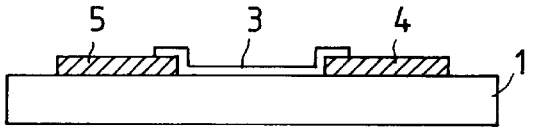
Figure 37B:
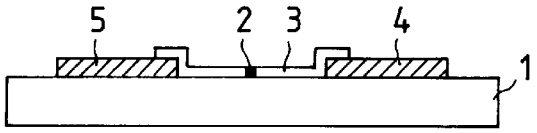

Thereafter, the Cr film and the baked electroconductive thin film 3 were wet-etched by means of an acidic etchant to produce a desired pattern for the films (FIGS. 37AB and 37BB).

3) An $SiO_x$ insulation layer was formed to a thickness of 0.5 μm by RF sputtering only on the substrate A carrying thereon device electrodes 4 and 5. Then, masks were formed only on the device electrodes 5 to exactly cover them by photolithography and the deposited insulating material was removed from the remaining areas to produce an insulation layer 6 for each device by means of RIE (Reactive Ion Etching), using $CF_4$ and $H_2$ gases. Note that not the entire device electrodes 5 were covered by the insulation layer but a boundary was defined for the insulation layer 6 on each device electrode 5 so as to ensure electric contact between the device electrode 5 and the power source for applying a voltage thereto. Thereafter, all the surface area of each device was masked except the insulation layer and Pt was deposited on the insulation layer to a thickness of 300 Å by sputtering to form a control electrode 7 (FIG. 37AC). The subsequent steps were identical to both the substrate A and the substrate B.

4) Then, the substrates A and B were moved into the vacuum apparatus 55 of a gauging system as illustrated in FIG. 11 (power source for control electrodes being unshown) and heated in vacuum to chemically reduce the PdO to Pd in the electroconductive thin film 3 of each sample device. Then, the sample devices were subjected to an energization forming process to produce an electron-emitting region 2 by applying a device voltage Vf between the device electrodes 4 and 5 of each device (FIGS. 37AD and 37BD).

The applied voltage was a pulse voltage as shown in FIG. 3B which was, however, not triangular but rectangularly parallelepipedic.

The peak value of the wave height of the pulse voltage was gradually increased with time as shown in FIG. 3B in vacuum. The pulse width of T1=1 msec and the pulse interval of T2=10 msec were used.

5) Then, both the substrate A and the substrate B were subjected to activation operation, where a driving voltage of 15V, a rectangular wave pulse with T1=1 ms and T2=10 ms of FIG. 3A, and a vacuum degree of $10^{-5}$ Torr were employed. To the devices on the substrate A, 0V was applied to the device electrodes 5, while +15V was applied to the device electrodes 4 and the control electrodes 7.

6) Subsequently, the inside of the vacuum apparatus of FIG. 11 was further reduced to $10^{7}$ Torr and the device current If and the emission current Ie were measured for all the surface conduction electron-emitting devices on the substrates A and B. After the measurement, the electron-emitting regions 2 of the devices on the substrates A and B were microscopically observed.

As for the parameters of the measurement, the distance H between the anode 54 and the electron-emitting device was 5 mm and the anode voltage and the device voltage Vf were respective 1 kV and 18V. As a result of the measurement, the device current If and the emission current of each device on the substrate B were 1.2 mA±25% and 1.0 $\mu$A±30% respectively to give rise to an electron emission efficiency (100× Ie/If) of 0.08%. On the other hand, the device current If and the emission current of each device on the substrate A were 1.0 mA±5% and 1.3 $\mu$A±4.5% to show a remarkably improved electron emission efficiency of 0.13% and a significantly reduced deviation among the devices. The electric potential of the device electrode 5 was made higher than that of the device electrode 4 and the electric potential of the control electrode was made equal to that of the device electrode 4. As the same time, a fluorescent member was arranged on the anode 54 to see the bright spot on the fluorescent member produced by an electron beam emitted from each sample electron-emitting device surface and it was observed that the bright spot produced by a device on the substrate A was smaller than its counterpart produced by a device on the substrate B by about 20 $\mu$m.

When the electroconductive thin film 3 of each device was observed through a microscope for both the substrate A and the substrate B, a substantially linear electron-emitting region 2 produced as a result of structural modification of the electroconductive thin film 3 was found near the device electrode 5 having a higher step portion in each of the four devices on the substrate A and no carbon nor carbides were found on the electroconductive thin film 3 and the device electrode 4 except in an area near the electron-emitting region.

On the other hand, a swerved electron-emitting region 2 was observed at the center of the electroconductive thin film 3 of each of the four devices on the substrate B prepared for comparison. The electron-emitting region 2 was swerved by about 50 $\mu$m at the middle point. Additionally, a relatively large amount of carbon and carbides was found on the electroconductive thin film and the device electrode with a higher electric potential within 30 to 60 $\mu$m from the electron-emitting region 2.

Since a substantially linear electron-emitting region was formed close to one of a pair of device electrodes and a control electrode was arranged on the device electrode with an insulation layer interposed therebetween, each of the electron-emitting devices according to the invention operated highly efficiently for electric emission.

[EXAMPLE 11]

In this example, an image forming apparatus was prepared by using an electron source comprising a plurality of surface conduction electron-emitting devices as those of Example 10 on a substrate and wiring them to form a simple matrix arrangement with 40 rows and 120 columns (inclusive of those for three primary colors).

Figure 38:
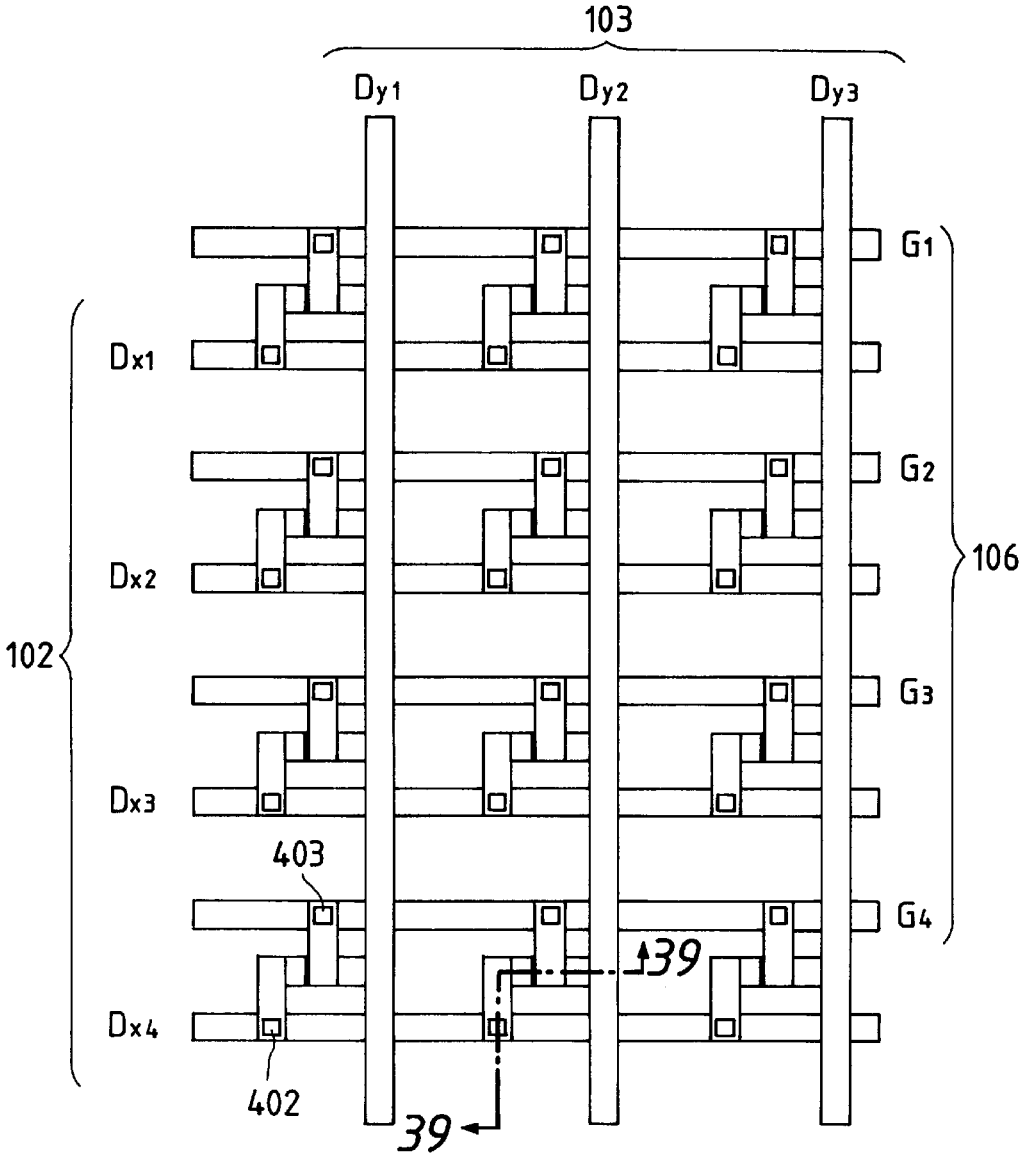
FIG. 38 is a schematic plan view of the electron source having a simple matrix arrangement of Example 11.
Figure 39:
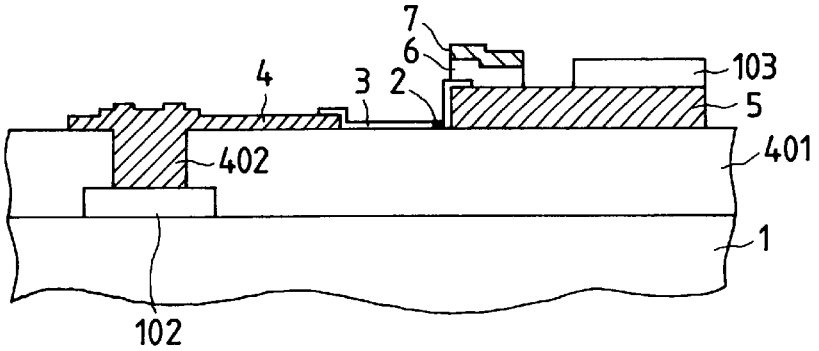
FIG. 39 is a schematic partial sectional view of the electron source of FIG. 38.

FIG. 38 shows a schematic partial plan view of the electron source. FIG. 39 is a schematic sectional view taken along line 39—39 of FIG. 38. Throughout FIGS. 38, 39, 40A through 40D and 41E through 41H, same reference symbols denote same or similar components. The electron source had a substrate 1, X-directional wires 102 (also referred to as lower wires) that correspond to Dx1 through Dxm of FIG. 15, Y-directional wires 103 (also referred to as upper wires) that correspond to Dy1 through Dyn of FIG. 15 and wires 106 for control electrodes that correspond to G1 through Gm of FIG. 15. Each of the devices of the electron source comprised a pair of device electrodes 4 and 5 and an electroconductive thin film 3 including an electron-emitting region. Otherwise, the electron source was provided with an interlayer insulation layer 401, a set of contact holes 402, each of which electrically connected a corresponding device electrode 4 and a corresponding lower wire 102 and another set of contact holes 403, each of which electrically connected a corresponding control electrode 7 and a corresponding wire 106 for the control electrode 7.

The steps of manufacturing the electron source will be described below by referring to FIGS. 40A through 40D and 41E through 41H.

Figure 40A:
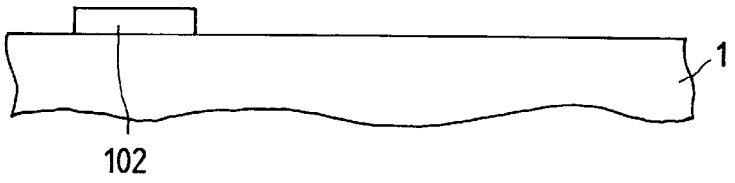
FIGS. 40A through 40D a re schematic sectional views of the electron source of FIG. 38 in different manufacturing steps.

Step a: After thoroughly cleansing a soda lime glass plate a silicon oxide film was formed thereon to a thickness of 0.5 $\mu$m by sputtering to produce a substrate 1, on which Cr and Au were sequentially laid to thicknesses of 50 Å and 6,000 Å respectively and then a photoresist (AZ1370: available from Hoechst Corporation) was formed thereon by means of a spinner, while rotating the film, and baked. Thereafter, a photo-mask image was exposed to light and developed to produce a resist pattern for lower wires 102 and wires for control electrodes 106 then the deposited Au/Cr film was wet-etched to produce lower wires 102 and wires for control electrodes 106 (FIG. 40A).

Figure 40B:
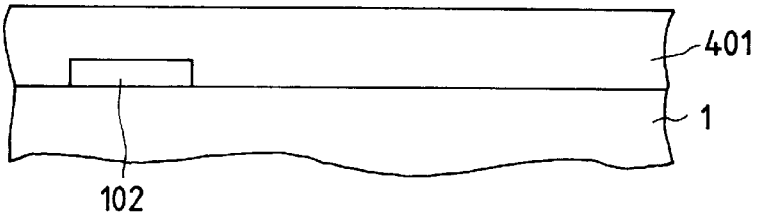

Step b: A silicon oxide film was formed as an interlayer insulation layer 401 to a thickness of 1.0 $\mu$m by RF sputtering (FIG. 40B).

Figure 40C:
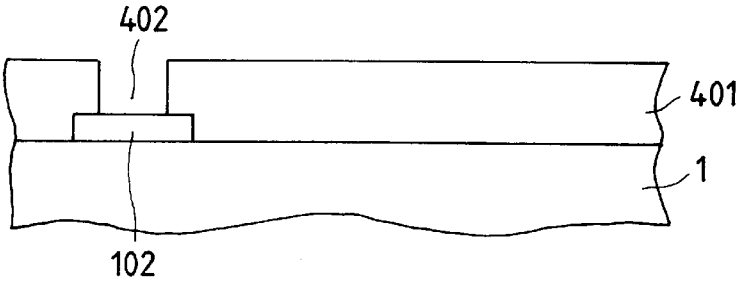

Step c: A photoresist pattern was prepared for producing contact holes 402 and 403 for each device in the silicon oxide film deposited in Step b, which contact holes 402 and 403 were then actually formed by etching the interlayer insulation layer 401, using the photoresist pattern for a mask. A technique of RIE (Reactive Ion Etching) using $CF_4$ and $H_2$ gas was employed for the etching operation (FIG. 40C).

Figure 40D:
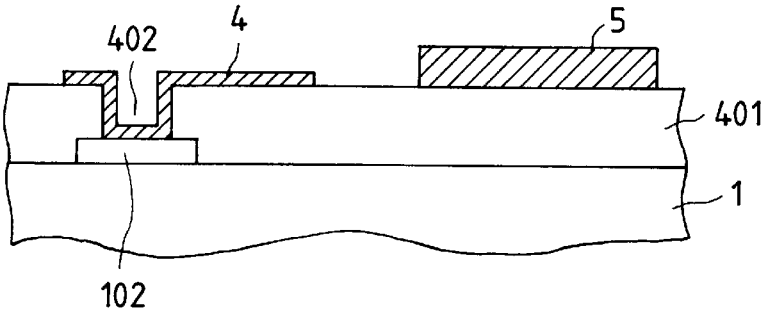

Step d: Thereafter, a pattern of photoresist was formed for a pair of device electrodes 4 and 5 of each device and a gap L separating the electrodes and then Ti and Ni were sequentially deposited thereon respectively to thicknesses of 50 Å and 400 Å by vacuum deposition. The photoresist pattern was dissolved by an organic solvent and the Ni/Ti deposit film was treated by using a lift-off technique. Thereafter, the device was covered by photoresist except the device electrode 5 and Ni was deposited to a thickness of 1,000 Å so that the device electrode 5 showed an overall height of 1,400 Å. The produced device electrodes 4 and 5 of each device had a width W1 of 200 μm and were separated from each other by a distance L of 80 μm (FIG. 40D).

Figure 41E:
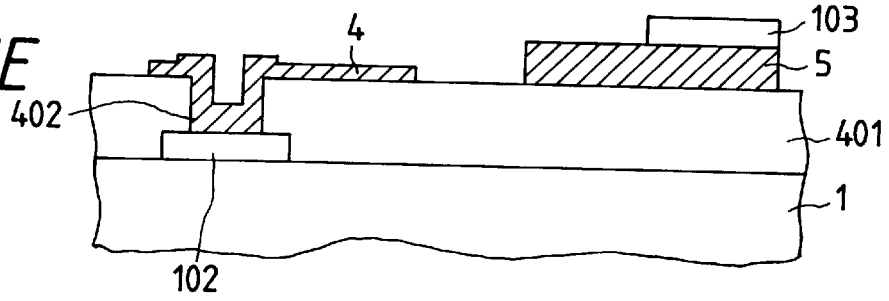
FIGS. 41E through 41H are also schematic sectional views of the electron source of FIG. 38 in different manufacturing steps.

Step e: After forming a photoresist pattern on the device electrode 5 for an upper wire 103, Ti and Au were sequentially deposited by vacuum deposition to respective thicknesses of 50 Å and 5,000 Å and then unnecessary areas were removed by means of a lift-off technique to produce an upper wire 103 having a desired profile (FIG. 41E).

Figure 41F:
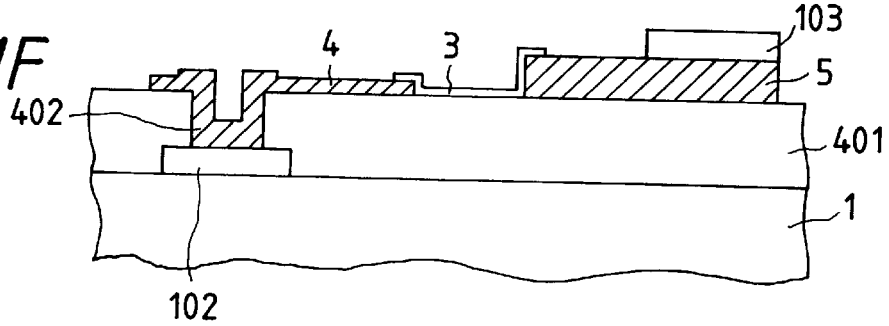

Step f: Then, a Cr film 404 was formed to a film thickness of 1,000 Å by vacuum deposition, using a mask having an opening on and around the gap L between the device electrodes, which Cr film 404 was then subjected to a patterning operation. Thereafter, an organic Pd compound (ccp-4230: available from Okuno Pharmaceutical Co., Ltd.) was applied to the Cr film by means of a spinner, while rotating the film, and baked at 300° C. for 12 minutes. The formed electroconductive thin film 3 was made of fine particles containing PdO as a principal ingredient and had a film thickness of 70 Å and an electric resistance per unit area of $2\times10^4$ Ω/□. The Cr film and the baked electroconductive thin film 3 were etched by using an acidic etchant until it showed a desired pattern (FIG. 41F).

Figure 41G:
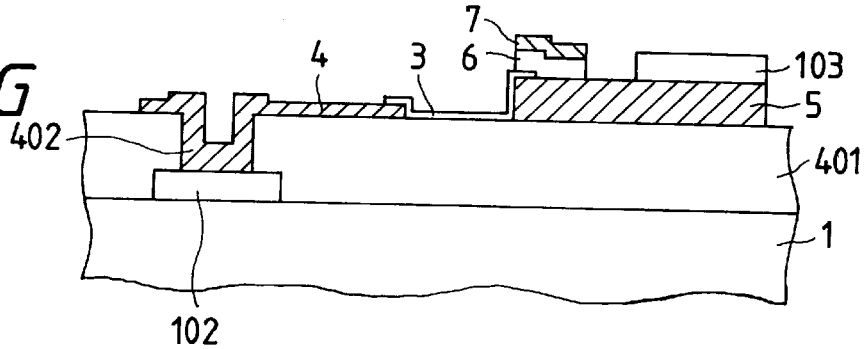

Step g: Then, an insulation layer of silicon oxide film was deposited on the substrate 1 prepared in Step e to a thickness of 0.5 μm. Then, the device electrode 5 having a higher step portion was covered by a mask showing a profile similar to that of the device electrode 5 by means of a photolithography technique and the insulating material deposited in this step was etched out except the area on the device electrode 5 to produce an insulation layer 6. An RIE technique, using $CF_4$ gas and $H_2$ gas, was used for the etching operation. Note that not the entire device electrode 5 was covered by the insulation layer but a boundary was defined for the insulation layer 6 on each device electrode 5 so as to ensure electric contact between the device electrode 5 and the power source for applying a voltage thereto. Thereafter, all the surface area of each device was masked except the insulation layer and Ni was deposited on the insulation layer 6 to a thickness of 500 Å to form a control electrode 7 (FIG. 41G).

Figure 41H:
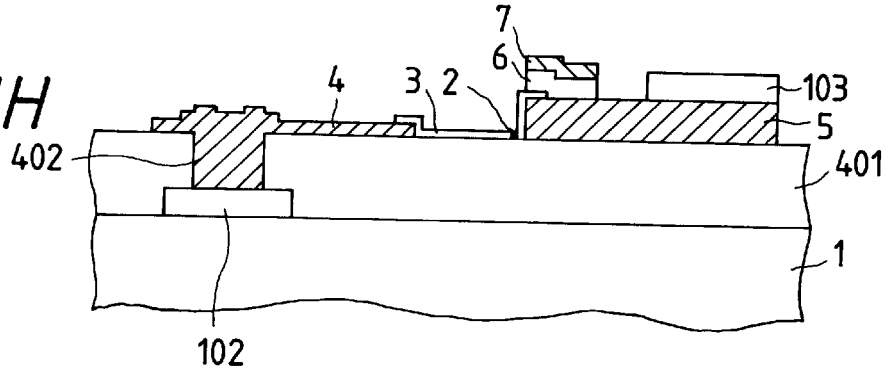

Step h: Then, resist was applied to the entire surface of the substrate except the contact holes 402 and 403, which was then exposed to light and developed to remove it only on the contact holes 402 and 403. Thereafter, Ti and Au were sequentially deposited by vacuum deposition to respective thicknesses of 50 Å and 5,000 Å. Any unnecessary areas were removed by means of a lift-off technique to consequently bury the contact holes 402 and 403 (FIG. 41H).

With the above steps, there was prepared an electron source comprising an insulating substrate 1, lower wires 102, wires for control electrodes 106, an interlayer insulation layer 401, upper wires 103, device electrodes 4, 5 and electroconductive thin films 3, although the electron source had not been subjected to energization forming.

Figure 58:
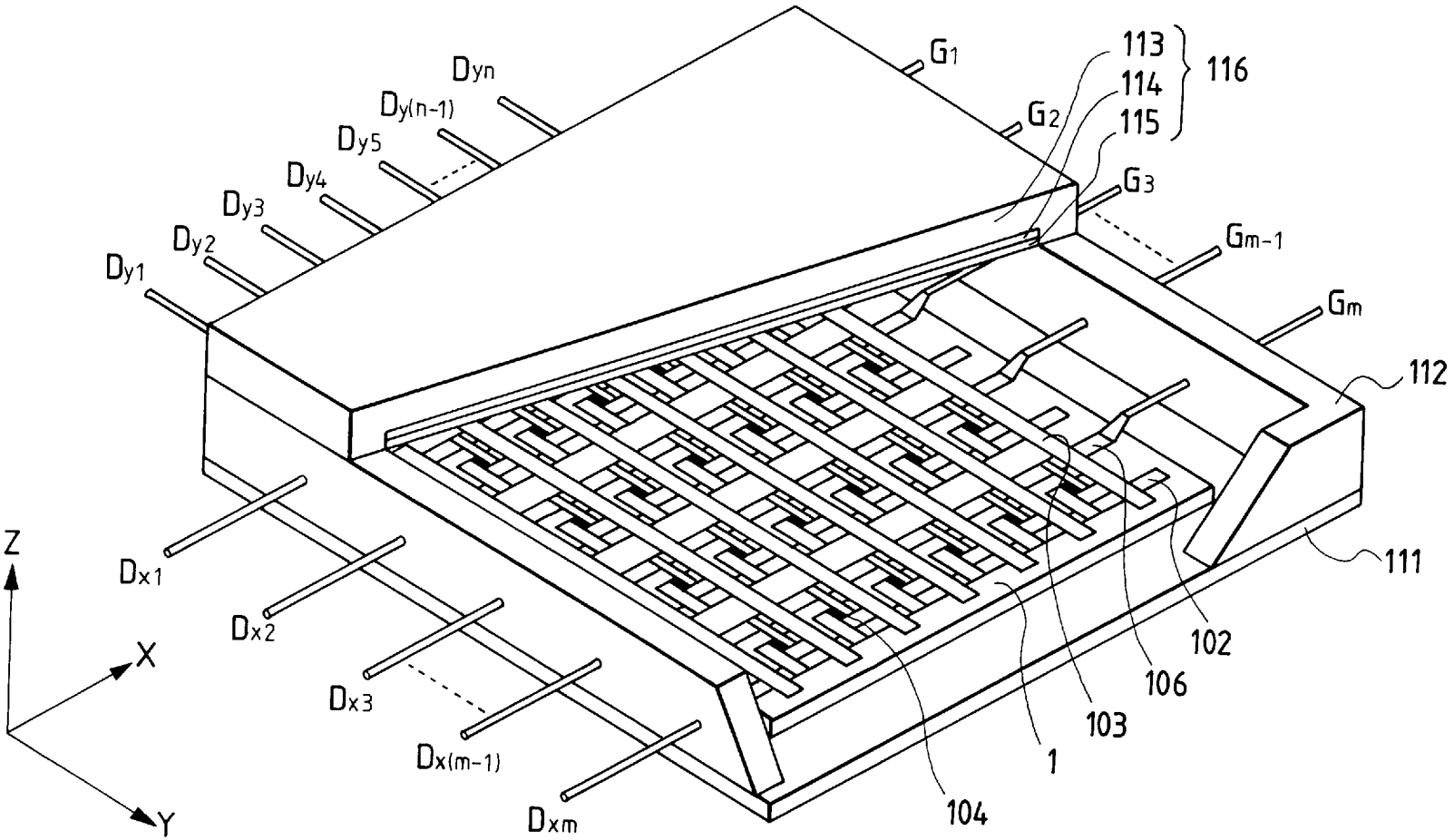
FIG. 58 is a partially cut away schematic perspective view of the display panel comprising the electron source having a simple matrix arrangement of Example 11.

Then, an image forming apparatus was prepared by using the electron source that had not been subjected to energization forming in a manner as described below by referring to FIGS. 58 and 18A.

After rigidly securing an electron source substrate 1 carrying thereon a large number of surface conduction electron-emitting devices onto a rear plate 111, a face plate 116 (carrying a fluorescent film 114 and a metal back 115 on the inner surface of a glass substrate 113) was arranged 5 mm above the substrate 1 with a support frame 112 disposed therebetween and, subsequently, frit glass was applied to the contact areas of the face plate 116, the support frame 112 and rear plate 111 and baked at 400° C. for 10 minutes in ambient air to hermetically seal the inside of the assembled components. In FIG. 58, reference symbols 104 denote an electron-emitting device and reference symbols 102 and 103 respectively denote an X-directional wire and a Y-directional wire, while reference numeral 106 denotes a wire for a control electrode.

The fluorescent film 114 of this example was prepared by forming black stripes (as shown in FIG. 18A) and filling the gaps with stripe-shaped fluorescent members of red, green and blue. The black stripes were made of a popular material containing graphite as a principal ingredient.

A slurry technique was used for applying fluorescent bodies 122 of three primary colors onto the glass substrate 103 to produce the fluorescent film 114.

A metal back 115 is arranged on the inner surface of the fluorescent film 114. After preparing the fluorescent film 114, the metal back 115 was prepared by carrying out a smoothing operation (normally referred to as "filming") on the inner surface of the fluorescent film 114 and thereafter forming thereon an aluminum layer by vacuum deposition.

A transparent electrode (not shown) was be arranged on the face plate 116 in order to enhance the electroconductivity of the fluorescent film 114.

For the above bonding operation, the components were carefully aligned in order to ensure an accurate positional correspondence between the color fluorescent bodies 122 and the electron-emitting devices 104.

The inside of the prepared glass envelope 118 (airtightly sealed container) was then evacuated by way of an exhaust pipe (not shown) and a vacuum pump to a sufficient degree of vacuum and, thereafter, a forming process was carried out on the devices to produce respective electron-emitting regions 2 by applying a voltage to the device electrodes 4, 5 of the surface conduction electron-emitting devices 104 by way of the external terminals Dx1 through Dxm and Dy1 through Dyn.

For the energization forming process, a pulse voltage as shown in FIG. 3B which was, however, not triangular but rectangularly parallelepipedic was applied to each device in vacuum of about $1\times10^{-5}$ Torr.

The pulse width of T1=1 msec and the pulse interval of T2=10 msec were used.

Then, the apparatus was subjected to an activation process by applying a pulse voltage same as the one used for the energization forming operation in vacuum of about $2\times10^{-5}$ Torr, while observing the device current If and the emission current Ie. The pulse width T1, the pulse interval T2 and the wave height were 1 msec, 10 msec and 14V respectively.

As a result of the above energization forming and activation steps, electron-emitting regions 2 were formed in the electron-emitting devices 104.

Subsequently, the envelope 118 was evacuated via an exhaust pipe (not shown) to achieve a degree of vacuum of about $10^{-7}$ Torr. Then, the ion pump used for evacuation was switched to an oil-free pump to produce an ultrahigh vacuum condition and the electron source was baked at 180° C. for 10 hours. After the baking operation, the inside of the envelope was held to a degree of vacuum of $1\times10^{-8}$ Torr, when the exhaust pipe was sealed by heating and melting it with a gas burner to hermetically seal the envelope 118.

Finally, the display panel was subjected to a getter operation on by means of high frequency heating in order to maintain the inside to a high degree of vacuum. This was an operation where a getter (not shown) arranged within the image forming apparatus was heated by high frequency heating to produce a film by vapor deposition immediately before the apparatus was hermetically sealed. The getter contained Ba as a principal ingredient.

In order to drive the display panel 201 (FIG. 17) of the image-forming apparatus, scan signals and modulation signals were applied to the electron-emitting devices 104 to emit electrons from respective signal generation means (not shown) by way of the external terminals Dx1 through Dxm and Dy1 through Dyn, while a voltage of 5 kV was applied to the metal back 115 or a transparent electrode (not shown) by way of the high voltage terminal Hv so that electrons emitted from the surface conduction electron-emitting devices were accelerated by the high voltage and collided with the fluorescent film 114 to cause the fluorescent members to excite and emit light to produce fine images of the quality of television, which were free from the problem of uneven brightness.

[EXAMPLE 12]

In this example, surface conduction electron-emitting devices according to the invention and having a configuration illustrated in FIGS. 5A and 5B were prepared along with surface conduction electron-emitting devices for the purpose of comparison and they were tested for performance. The electron emission performance of these devices will be described below.

FIG. 5A is a plan view of a surface conduction electron-emitting device according to the invention and used in this example and FIG. 5B is a cross sectional view thereof.

Figure 42A:
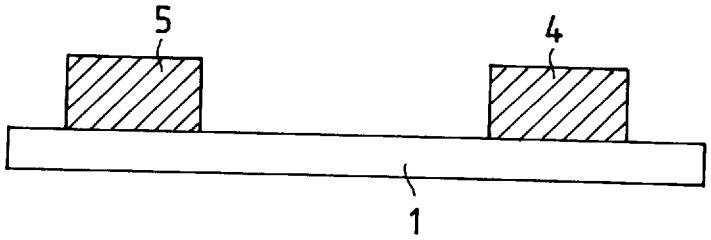
FIGS. 42AA through 42AC and 42BA through 42BC are schematic sectional views of the surface conduction electron-emitting device of Example 12 in different manufacturing steps.
Figure 42A:
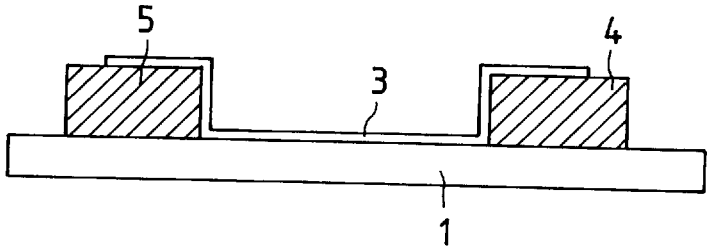
Figure 42A:
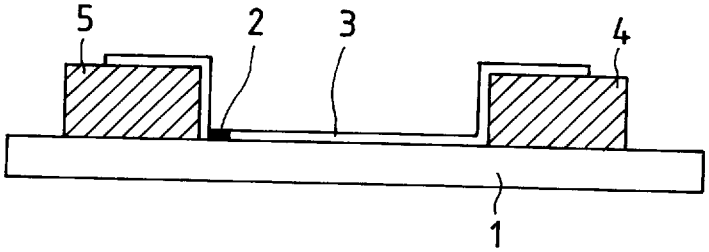
Figure 42B:
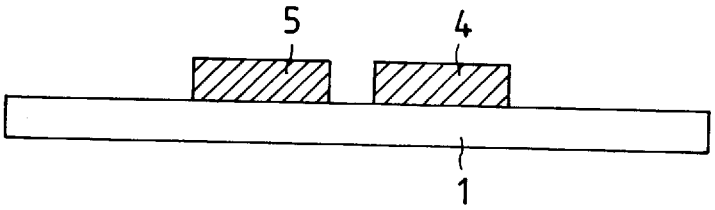
Figure 42B:
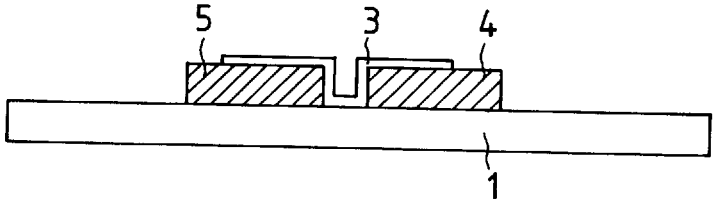
Figure 42B:
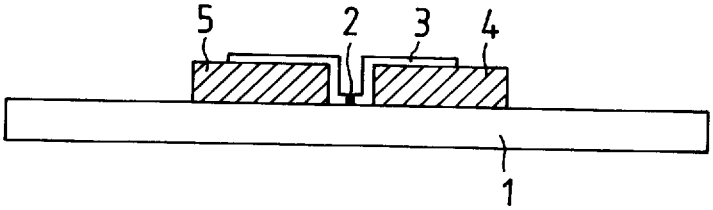

FIGS. 42AA through 42AC show a surface conduction electron-emitting device arranged on substrate A in different manufacturing steps, whereas FIGS. 42BA through 42BC show another surface conduction electron-emitting device also in different manufacturing steps, the latter being prepared for the purpose of comparison and arranged on substrate B. Four identical electron-emitting devices were produced on each of the substrates A and B.

1) The both substrates A and B were made of quartz glass. After thoroughly cleansing them with a detergent, pure water and an organic solvent, a Pt film was formed thereon by sputtering for device electrodes 4 and 5 to a thickness of 600 Å for the substrate A and 300 Å for the substrate B (FIGS. 42AA and 42BA).

The device electrodes 4 and 5 had a thickness of 500 Å on the substrate A and 300 Å on the substrate B. The device electrodes of each device were separated by a distance of 60 μm on the substrate A, whereas they were separated by 2 μm on the substrate B.

2) Subsequently, a Cr film (not shown) to be used for lift-off is formed by vacuum deposition to a thickness of 600 Å for the purpose of patterning the electroconductive thin film 3 on both the substrate A and the substrate B. At the same time, an opening of 100 μm corresponding to the width W2 of the electroconductive thin film 3 was formed in the Cr film for each device on both the substrate A and substrate B.

Thereafter, a solution of organize palladium (ccp-4230: available from Okuno Pharmaceutical Co., Ltd.) was sprayed onto the substrate A by means of an apparatus as shown in FIG. 6B to form an organic palladium thin film. At this time, unlike the case of Example 6, the substrate A carrying device electrodes was tilted by 30° relative to the normal line of Example 6 (FIG. 43). As a result of using the arrangement of tiling the substrate by 300 relative to the normal line of Example 6 for spraying the solution, a dense film was formed on and securely held to the device electrode 4 of each device, whereas a less dense film was formed on the device electrode 5 of each device and the device electrode 5 showed an area in the step portion that is poorly covered by the film.

On the other hand, the solution of organized palladium (ccp-4230: available from Okuno Pharmaceutical Co., Ltd.) was applied to the substrate B carrying device electrodes 4 and 5 by means of a spinner and left there to produce an organic Pd thin film.

Thereafter, the organic Pd thin film was heated and baked at 300° C. for 10 minutes in the atmosphere to produce an electroconductive thin film 3 mainly constituted by fine PdO particles for both the substrate A and the substrate B. The film had a thickness of about 120 Å and an electric resistance of $5\times10^4$ Ω/□ for both the substrate A and the substrate B.

Subsequently, the Cr film and the electroconductive thin film 3 were wet etched to produce an electroconductive thin film 3 having a desired pattern by means of an acidic wet etchant (FIGS. 42AB and 42BB).

3) Then, the substrates A and B were moved into the vacuum apparatus 55 of a gauging system as illustrated in FIG. 11. Thereafter, the sample devices were subjected to an energization forming process to produce an electron-emitting region 2 for each device by applying a voltage between the device electrodes 4 and 5 of each device from a power source 51 (FIGS. 42AC and 42BC). The applied voltage was a pulse voltage as shown in FIG. 3B (although it was not triangular but rectangularly parallelepipedic).

The peak value of the wave height of the pulse voltage was increased stepwise. The pulse width of T1=1 msec and the pulse interval of T2=10 msec were used. During the energization forming process, an extra pulse voltage of 0.1V (not shown) was inserted into intervals of the forming pulse voltage in order to determine the resistance of the electron emitting region, constantly monitoring the resistance, and the energization forming process was terminated when the resistance exceeded 1 MΩ.

If the product of the pulse wave height and the device current If at the end of the energization forming process is defined as forming power ($P_{form}$), the forming power $P_{form}$ of the substrate A was seven times as small as the forming power $P_{form}$ of the substrate B.

4) Subsequently, the inside of the vacuum apparatus 55 of the gauging system of FIG. 11 was further evacuated to about $10^{-7}$ Torr, leaving the substrates A and B within the vacuum apparatus 55 and then acetone was introduced into the vacuum apparatus 55 as an organic substance. The partial pressure of acetone was set to $2\times10^{-4}$ Torr. A pulse voltage was applied to each sample device on the substrates A and B to drive it for an activation process. Referring to FIG. 3A (although the pulse was not triangular but rectangularly parallelepipedic), the pulse width of T1=1 msec and the pulse interval of T2=10 msec were used and the drive voltage (wave height) was 15V. A voltage of 1 kV was also applied to the anode 54 of the vacuum apparatus, while observing the emission current (Ie) of each electron-emitting device. The activation process was terminated when Ie got to a saturated state.

5) Then, after further evacuating the inside of the vacuum apparatus to about $1\times10^{-7}$ Torr, the ion pump used for evacuation was switched to an oil-free pump to produce an ultrahigh vacuum condition and the electron source was baked at 150° C. for 2 hours. After the baking operation, the inside of the vacuum apparatus was held to a degree of vacuum of $1\times10^{-7}$ Torr. Subsequently, each sample surface conduction electron-emitting device on the substrates A and B was driven to operate within the vacuum apparatus 55 in order to see the device current (If) and the emission current (Ie). The voltage applied to the anode 54 was 1 kV and the device voltage (Vf) was 15V. The electric potential of the device electrode 4 was held higher than of the device electrode 5 for each device.

As a result of the measurement, the device current (If) and the emission current (Ie) of each device on the substrate B were 0.90 mA±6% and 0.7 μA±5% respectively. On the other hand, the device current (If) and the emission current (Ie) of each device on the substrate A were 0.8 mA±5% and 0.7 μA±4% respectively to show a level of deviation substantially equal to all the devices.

At the same time, a fluorescent member was arranged on the anode 54 to observe bright spots produced on the fluorescent member as electron beams emitted from the electron-emitting devices collide with it. The size and profile of the bright spots were substantially same for all the devices.

After the measurement, the electron-emitting regions 2 of the devices on the substrates A and B were microscopically observed. FIGS. 25A and 25B schematically illustrate what was observed for the electron-emitting region 2 of the electroconductive thin film 3 of each device on the substrates A and B. As seen from FIGS. 25A and 25B, a substantially linear electron-emitting region 2 was observed near the device electrode 5 having a higher step portion in each of the four devices on the substrate A, while a similarly linear electron-emitting region 2 was observed at the middle point of the device electrodes in the electroconductive thin film 3 of each of the four devices on the substrate B prepared for comparison.

As described above, a surface conduction electron-emitting device according to the invention and comprising a substantially linear electron-emitting region 2 located close to one of the device electrodes operates to emit highly convergent electron beams without showing any substantial deviation in the performance like a surface conduction electron-emitting device for comparison wherein the device electrodes are separated by only 2 μm. Thus, the distance separating the device electrodes of a surface conduction electron-emitting device according to the invention can be made as large as 60 μm or 30 times larger than that of a surface conduction electron-emitting device for comparison.

[EXAMPLE 13]

In this example, a surface conduction electron-emitting device according to the invention and having a configuration as illustrated in FIGS. 9A and 9B was prepared. FIG. 9A is a plan view and FIG. 9B is a cross sectional view of the device.

FIGS. 10A through 10C also show the surface conduction electron-emitting device of this example in different manufacturing steps.

Referring to FIGS. 9A and 9B, the device comprises a substrate 1, a pair of device electrodes 4 and 5, an electroconductive thin film 3 including an electron-emitting region 2 and a control electrode 7. The steps followed to prepare the device will be described below by referring to FIGS. 9A and 9B and 10A through 10C.

Step-a

After thoroughly cleansing a substrate of soda lime glass, an $SiO_x$ film was formed to a thickness of 0.5 μm by sputtering and then Pt was deposited also by sputtering to form a pair of device electrodes 4 and 5 and a control electrode 7, using a mask. The device electrodes 4 and 5 and the control electrode 7 were differentiated by film thickness. The device electrode 5 and the control electrode 7 were 150 nm thick, whereas the device electrode 4 had a film thickness of 30 nm. The distance L separating the device electrodes was 50 micrometers and the device electrodes had a width W1 of 300 micrometers. As shown in FIG. 9A, the control electrode 7 was arranged near the electroconductive thin film 3 and electrically isolated from the device electrodes 4 and 5 and the electroconductive thin film 3.

Step-b

A Cr film was formed by vacuum deposition to a thickness of 50 nm over the entire surface of the substrate including the device electrodes formed in Step-a and then photoresist was applied also to the entire surface of the substrate. Then, the Cr film was etched by patterning and photochemically developing a pattern, using a mask (not shown) having an opening with a length greater than the distance between the device electrodes and a width equal to W2, on the gap between the device electrodes and its vicinity, to produce a Cr mask that exposed part of the device electrodes and the gap between the electrodes and had a width equal to W2, which was 100 μm. Thereafter, an organic palladium solution (ccp-4230: available from Okuno Pharmaceutical Co., Ltd.) was applied thereon by means of a spinner and the applied solution was heated and baked at 300° C. for 10 minutes. Subsequently, the Cr film was etched by means of an acidic etchant and lifted off to produce an electroconductive thin film 3, which was constituted by fine particles of Pd and had a film thickness of 100 angstroms. The electric resistance per unit area of the film was $2\times10^4$ Ω/□.

Thus, a pair of device electrodes 4 and 5, an electroconductive thin film 3 and a control electrode 7 were formed on the substrate 1.

Step-d

A gauging system as illustrated in FIG. 11 was prepared and the inside was evacuated by means of a vacuum pump to a degree of vacuum of $2\times10^{-6}$ Torr. Thereafter, the sample was subjected to an energization forming process by applying a device voltage Vf between the device electrodes 4 and 5 from a power source 51. The applied voltage was a pulse voltage as shown in FIG. 3B.

The peak value of the wave height of the pulse voltage as shown in FIG. 3B was increased stepwise by 0.1V. The pulse width of T1=1 msec and the pulse interval of T2=10 msec were used. During the energization forming process, an extra pulse voltage of 0.1V (not shown) was inserted into intervals of T2s of the forming pulse voltage in order to determine the resistance of the device, and the energization forming process was terminated when the resistance exceeded 1 MΩ. The energization forming voltage was about 11V.

Thus, an electron-emitting region 2 was produced to finish the operation of preparing the electron-emitting device.

The performance of the prepared surface conduction electron-emitting device was examined by means of the above gauging system.

The electron-emitting device was separated from the anode by 4 mm and an voltage of 1 kV was applied to the anode. The inside of the vacuum apparatus was held to $1\times10^{-7}$ Torr during the test.

The anode was constituted by a transparent electrode arranged on a glass substrate, on which a fluorescent substance was deposited so that the bright spot formed by the profile of the electron beam emitted from the electron-emitting device might be closely observed.

FIG. 13 schematically illustrates the relationship between the emission current Ie and the device voltage Vf and between the device current If and the device voltage Vf of the device observed in the gauging system of FIG. 11. Note that the units of the graph of FIG. 13 are arbitrarily selected because the emission current Ie is very small relative to the device current If.

Additionally, a voltage lower than the electric potential of the high potential device electrode 4, or typically 0V, was applied to the control electrode 7, while the electron-emitting device was driven to operate. With such an arrangement, a highly convergent bright spot was observed on the fluorescent film arranged on the anode 54.

[EXAMPLE 14]

In this example, an image forming apparatus was prepared by arranging an electron source comprising a plurality of surface conduction electron-emitting devices of Example 13 to form a simple matrix arrangement.

Figure 44:
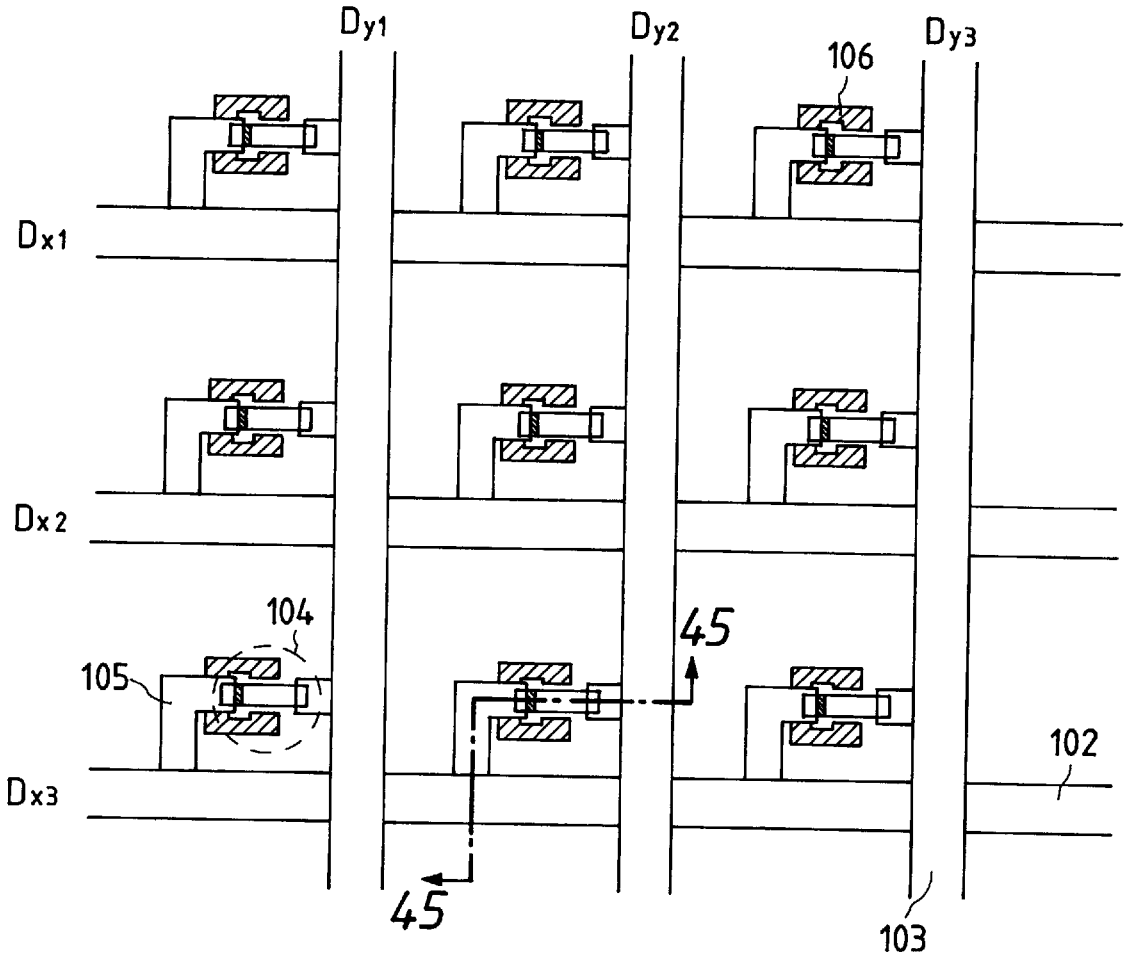
FIG. 44 is a schematic plan view of the electron source having a simple matrix arrangement of Example 14.
Figure 45:
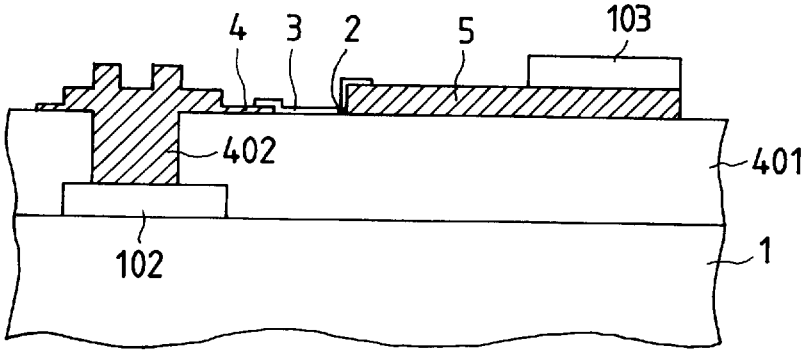
FIG. 45 is a schematic partial sectional view of the electron source of FIG. 44.
Figure 46A:
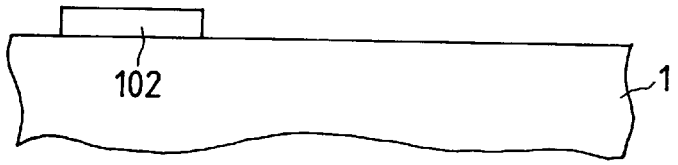
FIGS. 46A through 46D are schematic sectional views of the electron source of FIG. 44 in different manufacturing steps.
Figure 46B:
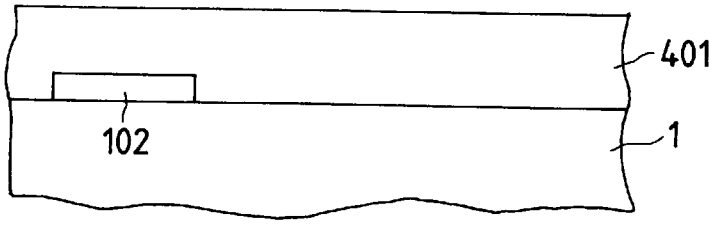
Figure 46C:
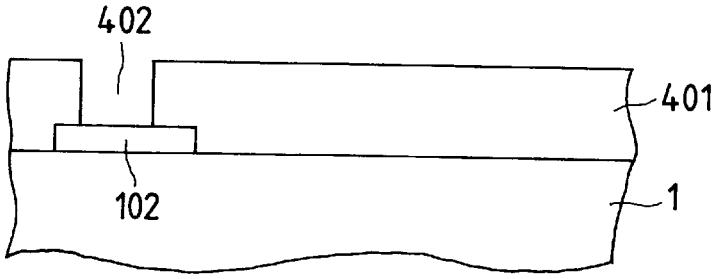
Figure 46D:
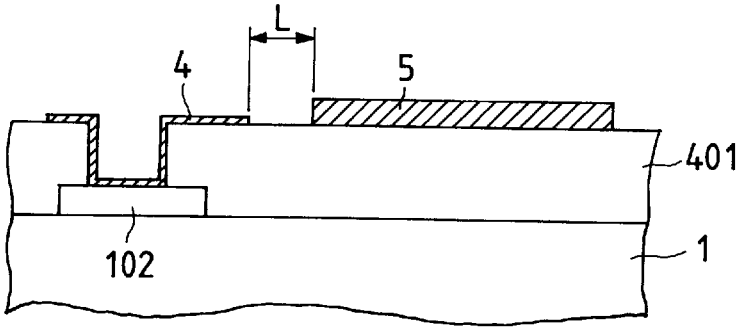
Figure 47E:
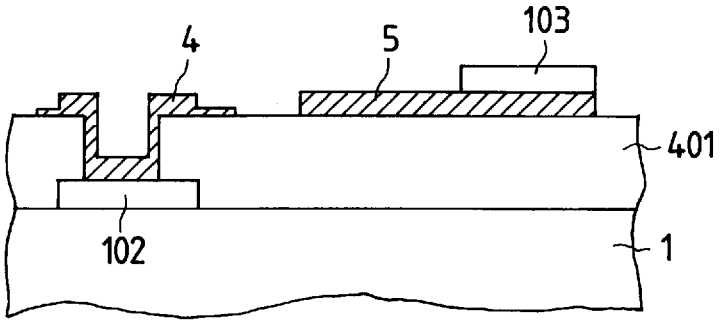
FIGS. 47E through 47H are also schematic sectional views of the electron source of FIG. 44 in different manufacturing steps.
Figure 47F:
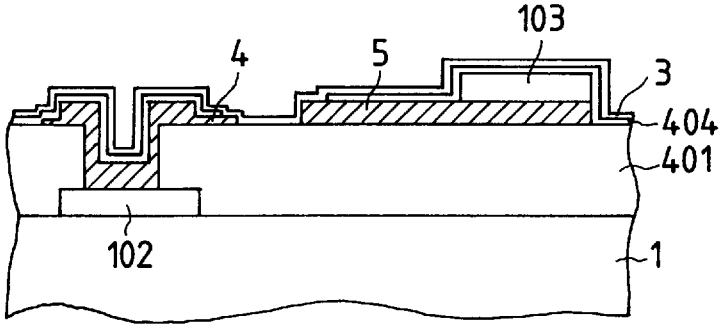
Figure 47G:
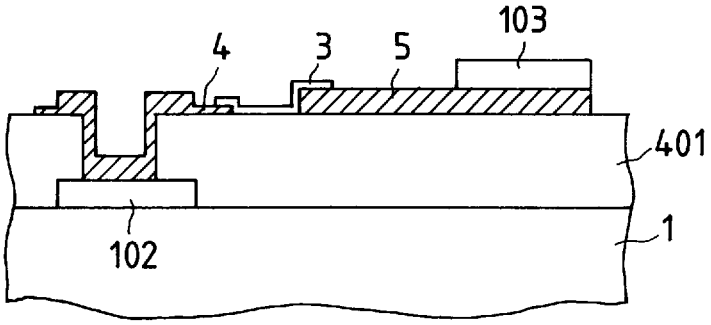
Figure 47H:
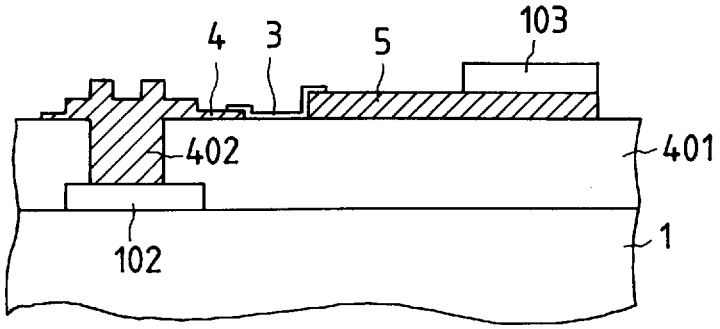

FIG. 44 shows a schematic partial plan view of the electron source. FIG. 45 is a schematic sectional view taken along line 45—45 of FIG. 44. Throughout FIGS. 44, 45, 46A through 46D and 47E through 47H, same reference symbols denote same or similar components. The electron source had a substrate 1, X-directional wires 102 corresponding to Dmx of FIG. 57 (also referred to as lower wires) and Y-directional wires 103 corresponding to Dyn of FIG. 57 (also referred to as upper wires). Each of the devices of the electron source comprised a pair of device electrodes 4 and 5 and an electroconductive thin film 3 including an electron-emitting region. Otherwise, the electron source was provided with an interlayer insulation layer 401, contact holes 402, each of which electrically connected a corresponding device electrode 4 and a corresponding lower wire 102 and wires for control electrodes 106. Reference numerals 104 and 105 respectively denote a surface conduction electron-emitting device and a device electrode including a connecting wire.

Step-a

After thoroughly cleansing a soda lime glass plate a silicon oxide film was formed thereon to a thickness of 0.5 μm by sputtering to produce a substrate 1, on which Cr and Au were sequentially laid to thicknesses of 50 Å and 600 Å respectively and then a photoresist (AZ1370: available from Hoechst Corporation) was formed thereon by means of a spinner, while rotating the film, and baked. Thereafter, a photo-mask image was exposed to light and developed to produce a resist pattern for lower wires 102 and then the deposited Au/Cr film was wet-etched to produce lower wires 102.

Step-b

A silicon nitride film was formed as an interlayer insulation layer 401 to a thickness of 1.0 μm by means of a plasma CVD technique.

Step-c

A photoresist pattern was prepared for producing a contact hole 402 for each device in the silicon oxide film deposited in Step b, which contact hole 102 was then actually formed by etching the interlayer insulation layer 401, using the photoresist pattern for a mask. A technique of RIE (Reactive Ion Etching) using $CF_4$ and $H_2$ gas was employed for the etching operation.

Step-d

Thereafter, a pattern of photoresist (RD-2000N-41: available from Hitachi Chemical Co., Ltd.) was formed for a device electrode 4 of each device and then Ti and Ni were sequentially deposited thereon respectively to thicknesses of 5.0 nm and 40 nm by vacuum deposition. The photoresist pattern was dissolved by an organic solvent and the Ni/Ti deposit film was treated by using a lift-off technique to produce a device electrode 4. In a similar manner, another device electrode 5, a coupling wire and a control electrode 106 were formed to a thickness of 200 nm. Thus, a pair of device electrodes 4 and 5 separated by a gap L1 of 50 micrometers and having a width W1 of 300 micrometers and a control electrode 106 were formed for each device.

Step-e

After forming a photoresist pattern on the device electrodes 4 and 5 of each device for an upper wire 103, Ti and Au were sequentially deposited by vacuum deposition to respective thicknesses of 5.0 nm and 500 nm and then unnecessary areas were removed by means of a lift-off technique to produce an upper wire 103 having a desired profile.

Step-f

A Cr film 404 was formed to a film thickness of 100 nm by vacuum deposition, using a mask for forming an electroconductive thin film having an opening on and around the gap L between the device electrodes of each device, which Cr film 404 was then subjected to a patterning operation. Thereafter, an organic Pt compound was applied to the Cr film by means of a spinner, while rotating the film, and baked at 300° C. for 10 minutes. The formed electroconductive thin film 3 was made of fine particles containing Pt as a principal ingredient and had a film thickness of 5 nm and an electric resistance per unit area of $2\times10^3$ Ω/□.

Step-g

The Cr film 404 and the baked electroconductive thin film 3 of each device were wet-etched by using an acidic etchant to provide the electroconductive thin film 4 with a desired pattern.

Step-h

Resist was applied to the entire surface of the substrate of each device, which was then exposed to light and developed, using a mask, to remove it only on the contact holes 402. Thereafter, Ti and Au were sequentially deposited by vacuum deposition to respective thicknesses of 5.0 nm and 500 nm. Any unnecessary areas were removed by means of a lift-off technique to consequently bury the contact hole 402.

With the above steps, there was prepared an electron source comprising surface conduction electron-emitting devices, each being provided with an insulating substrate 1, a lower wire 102, an interlayer insulation layer 401, an upper wire 103, a pair of device electrodes 4, 5 and an electroconductive thin film 3, although the devices had not been subjected to energization forming.

Figure 59:
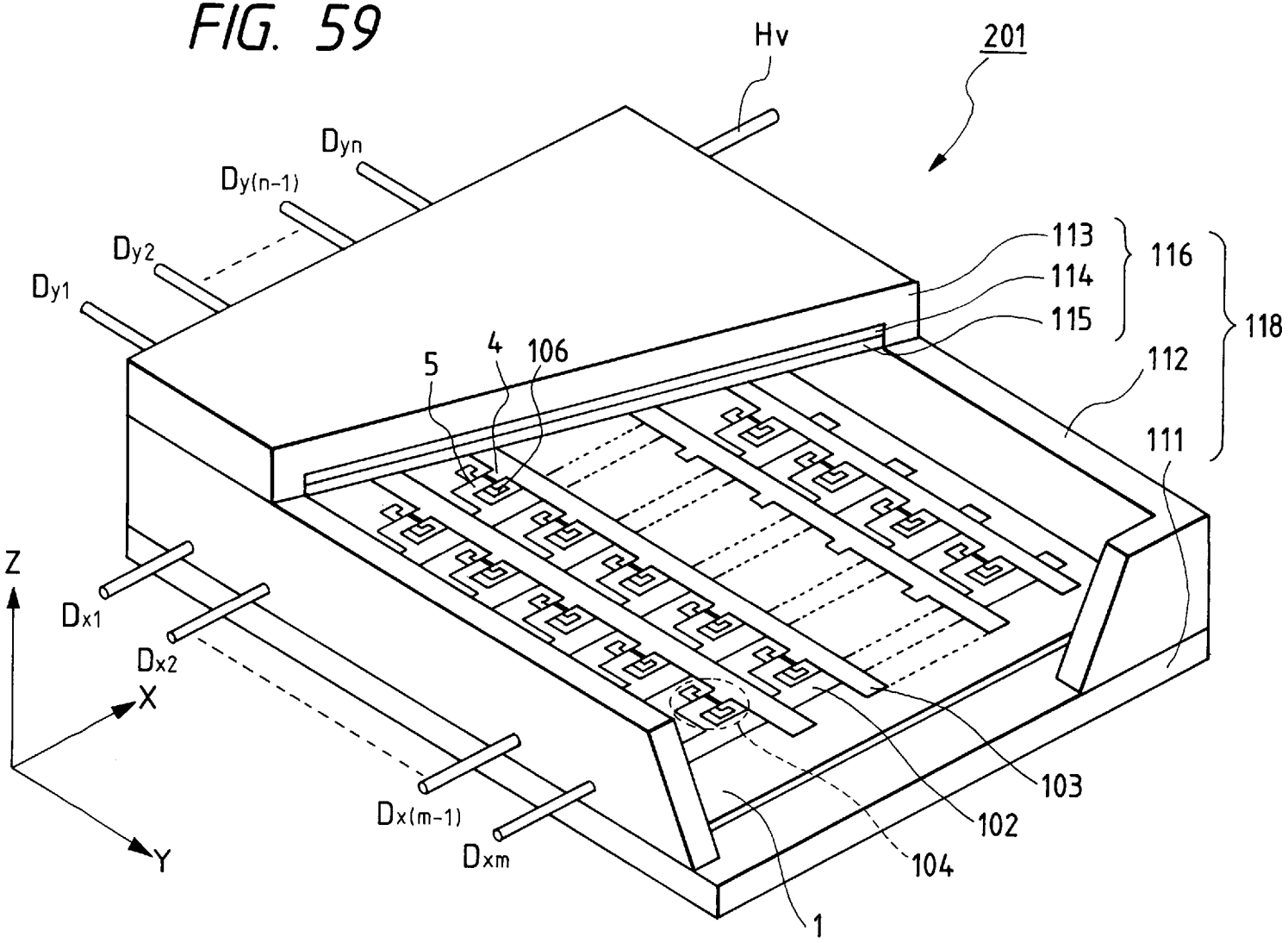
FIG. 59 is a partially cut away schematic perspective view of the display panel comprising the electron source having a simple matrix arrangement of Example 14.

Then, an image forming apparatus was prepared by using the electron source that had not been subjected to energization forming in a manner as described below by referring to FIGS. 59 and 18A.

After rigidly securing an electron source substrate 1 carrying the surface conduction electron-emitting devices onto a rear plate 111, a face plate 116 (carrying a fluorescent film 114 and a metal back 115 on the inner surface of a glass substrate 113) was arranged 5 mm above the substrate 1 with a support frame 112 disposed therebetween and, subsequently, frit glass was applied to the contact areas of the face plate 116, the support frame 112 and rear plate 111 and baked at 500° C. for more than 5 minutes in a nitrogen atmosphere to hermetically seal the inside of the assembled components. The substrate 1 was also secured to the rear plate 111 by means of frit glass. In FIG. 59, 104 denotes an electron-emitting device and 102 and 103 respectively denote an X-directional wire and a Y-directional wire.

While the fluorescent film 114 is consisted only of a fluorescent body if the apparatus is for black and white images, the fluorescent film 114 of this example was prepared by forming black stripes and filling the gaps with stripe-shaped fluorescent members of red, green and blue. The black stripes were made of a popular material containing graphite as a principal ingredient.

A slurry technique was used for applying fluorescent materials onto the glass substrate 113. A metal back 115 is arranged on the inner surface of the fluorescent film 114. After preparing the fluorescent film, the metal back was prepared by carrying out a smoothing operation (normally referred to as "filming") on the inner surface of the fluorescent film and thereafter forming thereon an Al layer by vacuum deposition.

While a transparent electrode (not shown) might be arranged on the outer surface of the fluorescent film 114 on the face plate 116 in order to enhance its electroconductivity, it was not used in this example because the fluorescent film 114 showed a sufficient degree of electroconductivity by using only a metal back.

For the above bonding operation, the components were carefully aligned in order to ensure an accurate positional correspondence between the color fluorescent members and the electron-emitting devices.

The inside of the prepared glass envelope (airtightly sealed container) was then evacuated by way of an exhaust pipe (not shown) and a vacuum pump to a sufficient degree of vacuum and, thereafter, an energization forming process was carried out on the devices to produce electron-emitting regions 2 in the electroconductive thin films 3 by applying an voltage to between the device electrodes 4 and 5 of the electron-emitting devices 114 by way of external terminals Dx1 through Dxm and Dy1 through Dyn. The pulse voltage used for the energization forming is shown in FIG. 3B.

In this example, T1 and T2 were respectively equal to 1 ms and 10 ms. The energization forming operation was carried out in vacuum of about $1\times10^{-6}$ Torr.

As a result of energization forming, the electron-emitting regions 2 came to be constituted by dispersed fine particles containing Pt as a principal ingredient, the average diameter of the particles being about 3.0 nm.

Subsequently, the inside of the envelope was evacuated through an exhaust pipe (not shown) to a degree of vacuum of about $2\times10^{-7}$ Torr and acetone as an organic substance was introduced into the envelope to a partial pressure of acetone of $2\times10^{-4}$ Torr. Then, a voltage pulse was applied to each surface conduction electron-emitting device for activation. The voltage pulse applied was of the type shown in FIG. 3A with T1=1 ms, T2=10 ms and a wave height of 15V. The activation operation was carried out with measuring the device current If and the emission current Ie.

The operation of preparing electron-emitting devices was completed as the electron-emitting regions 2 were formed.

Then, the inside of the image forming apparatus was evacuated to a degree of $10^{-8}$ Torr and subsequently, the ion pump used for evacuation was switched to an oil-free pump to produce an ultrahigh vacuum condition and the electron source was baked at 180° C. for 7 hours. After the baking operation, the inside of the imageforming apparatus was held to a degree of vacuum of $1\times10^{-7}$ Torr, when the exhaust pipe (not shown) was molten by means of a gas burner to completely seal the envelop of the image forming apparatus.

Finally, the apparatus was subjected to a getter process, using a high frequency heating method to maintain the obtained high degree of vacuum.

In order to drive the prepared image-forming apparatus comprising a display panel, scan signals and modulation signals were applied to the electron-emitting devices to emit electrons from respective signal generation means by way of the external terminals Dx1 through Dxm and Dy1 through Dyn, while a high voltage was applied to the metal back 115 or a transparent electrode (not shown) by way of the high voltage terminal Hv so that electrons emitted from the surface conduction electron-emitting devices were accelerated by the high voltage and collided with the fluorescent film 114 to cause the fluorescent members to excite to emit light and produce images.

The above described image forming apparatus operated excellently to stably produce highly defined clear images.

[EXAMPLE 15]

This example deals with an image-forming apparatus comprising a large number of surface conduction electron-emitting devices and modulation electrodes (grids).

Since the surface conduction electron-emitting devices used in this example were prepared in a way as described above by referring to Example 1, the method of manufacturing the same will not be described any further.

Now, the electron source realized by arranging the surface conduction electron-emitting devices on a substrate and the image forming apparatus prepared by using the electron source will be described hereinafter.

Figure 49:
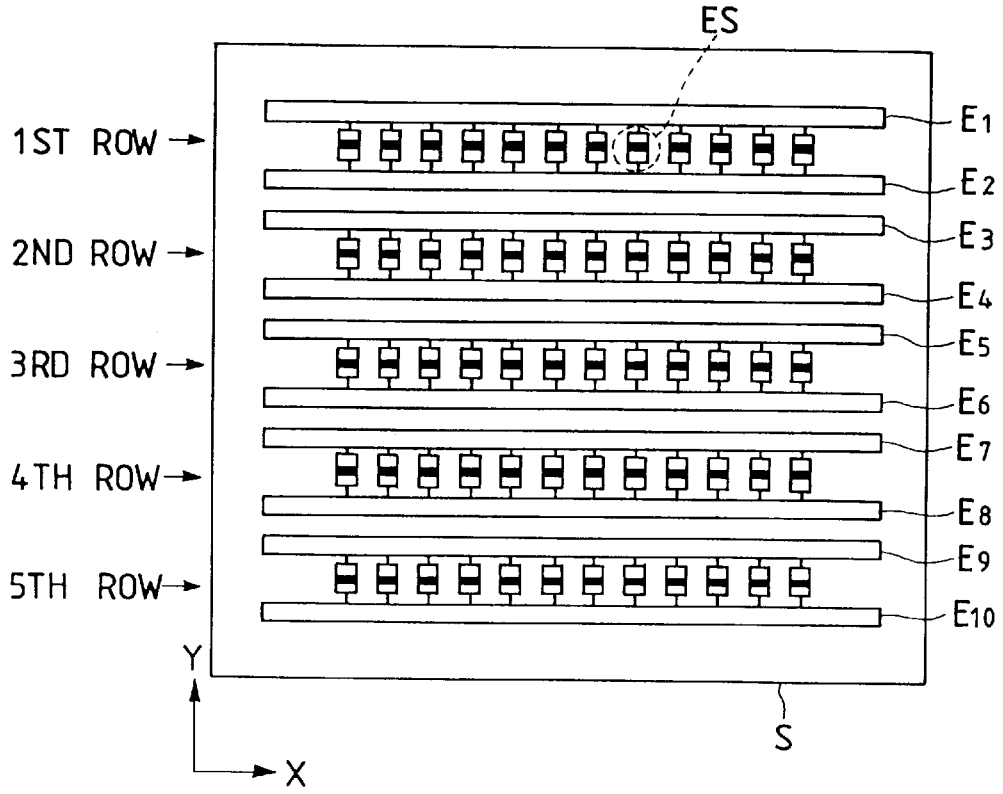
FIG. 49 is a schematic partial plan view of one of the electron sources having a ladder-like arrangement of Example 15.
Figure 50:
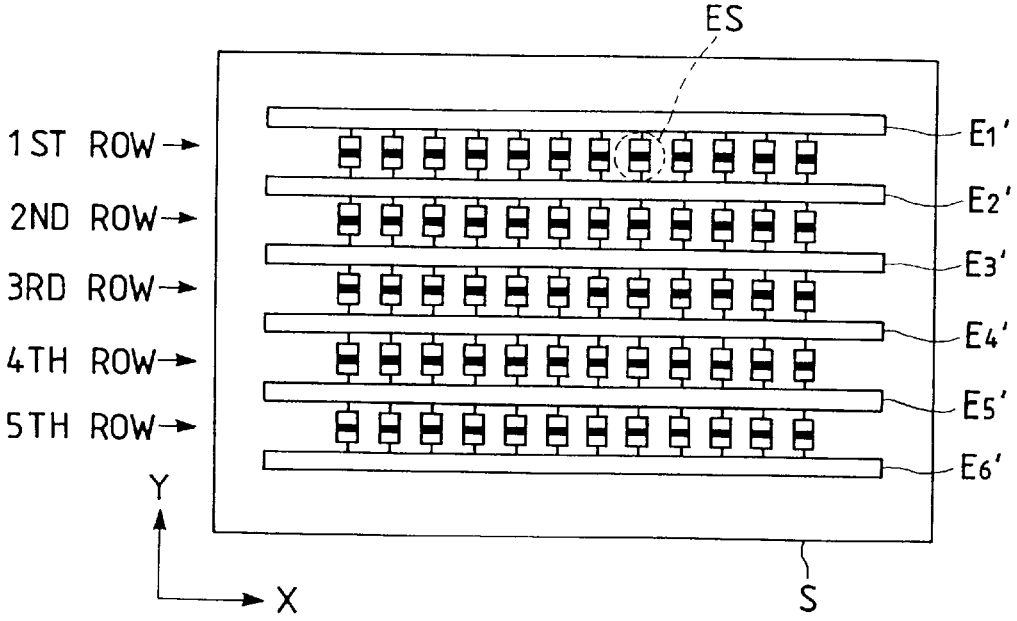
FIG. 50 is a schematic partial plan view of other one of the electron sources having a ladder-like arrangement of Example 15.

FIGS. 49 and 50 schematically illustrate two possible arrangements of surface conduction electron-emitting devices on a substrate to realized an electron source.

Referring firstly to FIG. 49, S denotes an insulating substrate typically made of glass and ES surrounded by a dotted circle denotes a surface conduction electron-emitting device arranged on the substrate S. The electron source comprises wire electrodes El through E10 for wiring the surface conduction electron-emitting devices of the corresponding rows. The surface conduction electron-emitting devices were arranged in rows along the X-direction (hereinafter referred to as device rows). The surface conduction electron-emitting devices of each row are connected in parallel by a pair of common wire electrodes running along the rows. (For example, the first row is wired by the wire electrodes E1 and E2 arranged along the lateral sides.)

In the electron source having the above described configuration, each of the device rows can be driven independently by applying an appropriate drive voltage to the related wire electrodes. More specifically, a voltage exceeding the threshold voltage level for electron emission is applied to the device rows to be driven to emit electrons, whereas a voltage not exceeding the threshold voltage level for electron emission (e.g., 0V) is applied to the remaining device rows. (A voltage exceeding the threshold voltage level and used for the purpose of the invention is expressed by drive voltage VE[V] hereinafter.)

FIG. 50 illustrates the other possible arrangement of surface conduction electron-emitting devices for the electron source. In FIG. 50, S denotes an insulating substrate typically made of glass and ES surrounded by a dotted circle denotes a surface conduction electron-emitting device arranged on the substrate S. The electron source comprises wire electrodes E'1 through E'6 for wiring the surface conduction electron-emitting devices of the corresponding rows. The surface conduction electron-emitting devices were arranged in rows along the X-direction (hereinafter referred to as device rows). The surface conduction electron-emitting devices of each row are connected in parallel by a pair of common wire electrodes running along the rows. Note that a single common wire electrode is arranged between any two adjacent device rows to serve for the both rows as a wire electrode. For instance, common wire electrode E'2 serves for both the first device row and the second device row. This arrangement of wire electrodes is advantageous in that, if compared with the arrangement of FIG. 49, the space separating any two adjacent rows of surface conduction electron-emitting devices can be significantly reduced in Y-direction.

Each of the device rows can be driven independently by applying an appropriate drive voltage to the selected wire electrodes. More specifically, a voltage VE[V] exceeding the threshold voltage level for electron emission is applied to the device rows to be driven to emit electrons, whereas a voltage not exceeding the threshold voltage level for electron emission, e.g. 0[V], is applied to the remaining device rows. For instance, only the devices of the third row can be driven to operate by applying 0[V] to the wire electrodes E'1 through E'3 and VE[V] to the wire electrodes E'4 through E'6. Consequently, VE−0=VE[V] is applied to the devices of the third row, whereas 0[V], 0−0=0[V] or VE−VE=0[V], is applied to all the devices of the remaining rows. Likewise, the devices of the second and the fifth rows can be driven to operate simultaneously by applying 0[V] to the wire electrodes E'1, E'2 and E'6 and VE[V] to the wire electrodes E'3, E'4 and E'5. In this way, the devices of any device row of this electron source can be driven selectively.

While each device row has twelve (12) surface conduction electron-emitting devices arranged along the X-direction in the electron sources of FIGS. 49 and 50, the number of devices to be arranged in a device row is not limited thereto and a greater number of devices may alternatively be arranged. Additionally, while there are five (5) device rows in the electron source, the number of device rows is not limited thereto and a greater number of device rows may alternatively be arranged.

Now, a panel type CRT incorporating an electron source of the above described type will be described.

Figure 51:
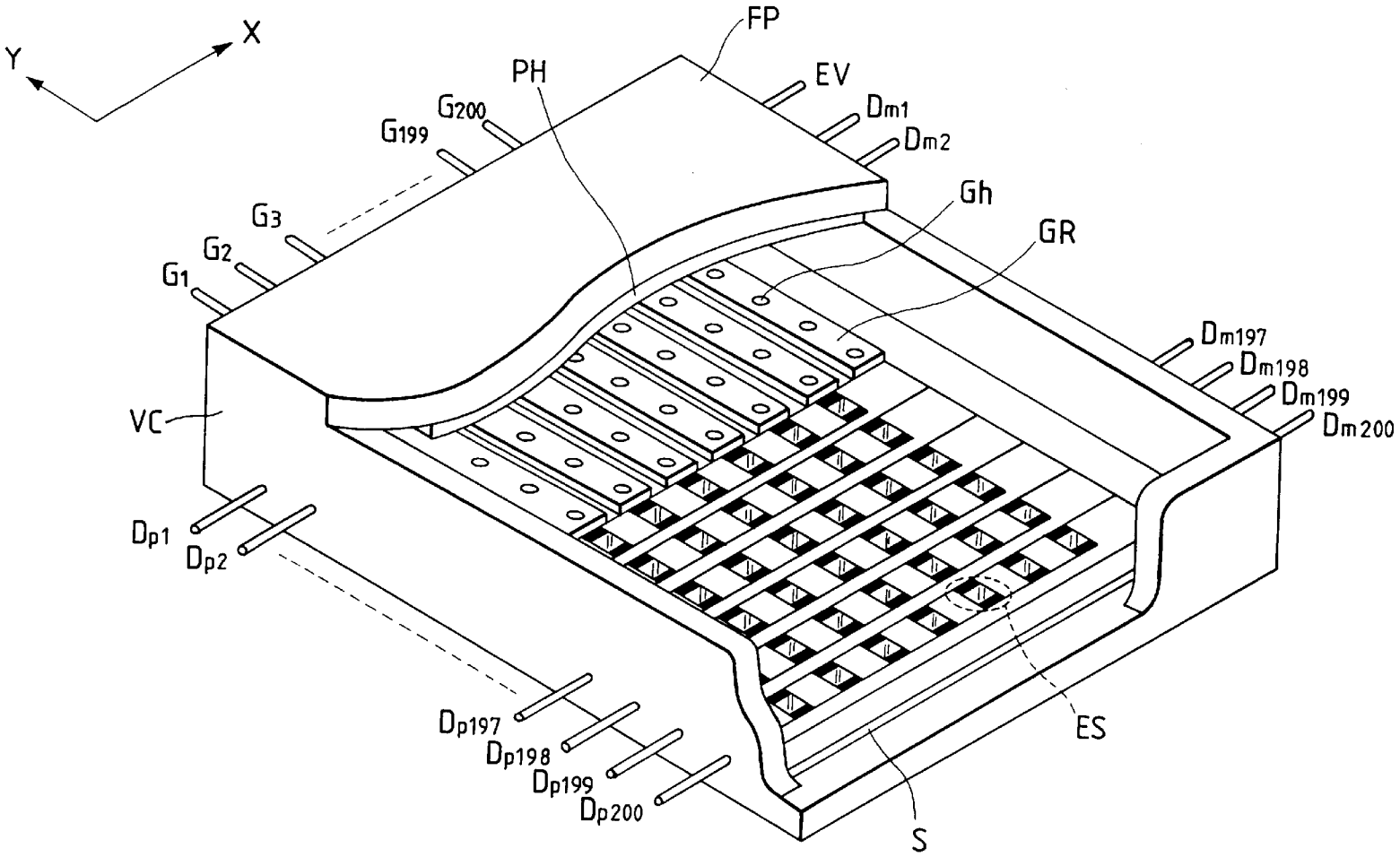
FIG. 51 is a partially cut away schematic perspective view of the display panel comprising one of the electron source having a ladder-like arrangement of Example 15.

FIG. 51 is a schematic perspective view of a panel type CRT incorporating an electron source as illustrated in FIG. 49. In FIG. 51, VC denote a glass vacuum container provided with a face plate for displaying images as a component thereof. A transparent electrode made of ITO is arranged on the inner surface of the face plate and red, green and blue fluorescent members are applied onto the transparent electrode in the form of a mosaic or stripes without interfering with each other. To simplify the illustration, the transparent electrodes and the fluorescent members are collectively indicated by reference symbol PH in FIG. 51. Black stripes known in the field of CRT may be arranged to fill the blank areas of the transparent electrode that are not occupied by the fluorescent stripes. Similarly, a metal back layer of any known type may be arranged on the fluorescent members. The transparent electrode is electrically connected to the outside of the vacuum container by way of a terminal Hv so that an voltage may be applied thereto in order to accelerate electron beams.

In FIG. 51, S denotes the substrate of the electron source rigidly fitted to the bottom of the vacuum container VC, on which a number of surface conduction electron-emitting devices are arranged in a manner as described above by referring to FIG. 49. In this example, a total of 200 device rows are arranged, each comprising 200 devices. Thus, the wire electrodes of the device rows are electrically connected to respective external terminals Dp1 through Dp200 and intersecting respective external terminals Dm1 through Dm200 arranged on the lateral panels of the apparatus so that electric drive signals may be applied thereto from outside of the vacuum enclosure.

The surface conduction electron-emitting devices of this example differ from those of Example 1 in the manufacturing steps from the energization forming process on. Therefore, these steps will be described for the current example hereinafter.

The inside of the vacuum container VC (FIG. 51) was evacuated through an exhaust pipe (not shown) by means of a vacuum pump. When a sufficient degree of vacuum was reached, a voltage was applied to the surface conduction electron-emitting devices by way of the external terminals Dp1 through Dp200 and Dm1 through Dm200 for carrying out an energization forming operation. FIG. 3B shows the wave form of the pulse voltage used for the energization forming operation. In this example, T1 was equal to 2 ms and T2 was equal to 10 ms. The operation was conducted in vacuum of a degree of about $1\times10^{-6}$ Torr.

Thereafter, acetone was introduced into the vacuum container VC until it showed a partial pressure of $1\times10^{-4}$ Torr and an activation process was carried out, applying a voltage to the surface conduction electron-emitting devices ES by way of the external terminals Dp1 through Dp200 and Dm1 through Dm200. After the activation process, the acetone was removed from the inside to produce finished surface conduction electron-emitting devices.

The electron-emitting region of each device was constituted by dispersed fine particles containing palladium as a principal ingredient. The average diameter of the fine particles was 30 angstroms. Thereafter, the ion pump used for evacuation was switched to an oil-free pump to produce an ultra-high vacuum condition and the electron source was baked at 120° C. for a sufficient period of time. After the baking operation the inside of the container was held to a degree of vacuum of $1\times10^{-7}$ Torr.

Then, the exhaust pipe was heated and molten by means of a gas burner to hermetically seal the vacuum container VC.

Finally, the electron source was subjected to a getter process, using a high frequency heating technique, in order to maintain the high degree of vacuum after the container was sealed.

In the image forming apparatus of this example, stripe-shaped grid electrodes GR are arranged in the middle between the substrate S and the face plate FP. There are provided a total of 200 grid electrodes GR arranged in a direction perpendicular to that of the device rows (or in the Y-direction) and each grid electrode has a given number of openings Gh for allowing electron beams to pass therethrough. More specifically, a circular opening Gh is provided for each surface conduction electron-emitting device. The grid electrodes are electrically connected to the outside of the vacuum container via respective electric terminals GI through G200 for the apparatus of this example. Note that the shape and the locations of the grid electrodes are not limited to those illustrated in FIG. 51 so long as they can appropriate modulate electron beams emitted from the surface conduction electron-emitting devices. For instance, they may be arranged close to the surface conduction electron-emitting devices.

The above described display panel comprises surface conduction electron-emitting devices arranged in 200 device rows and 200 grid electrodes to form an X-Y matrix of 200×200. With such an arrangement, an image can be displayed on the screen on a line by line basis by applying a modulation signal to the grid electrodes for a single line of an image in synchronism with the operation of driving (scanning) the surface conduction electron-emitting devices on a row by row basis to control the irradiation of electron beams onto the fluorescent film.

Figure 52:
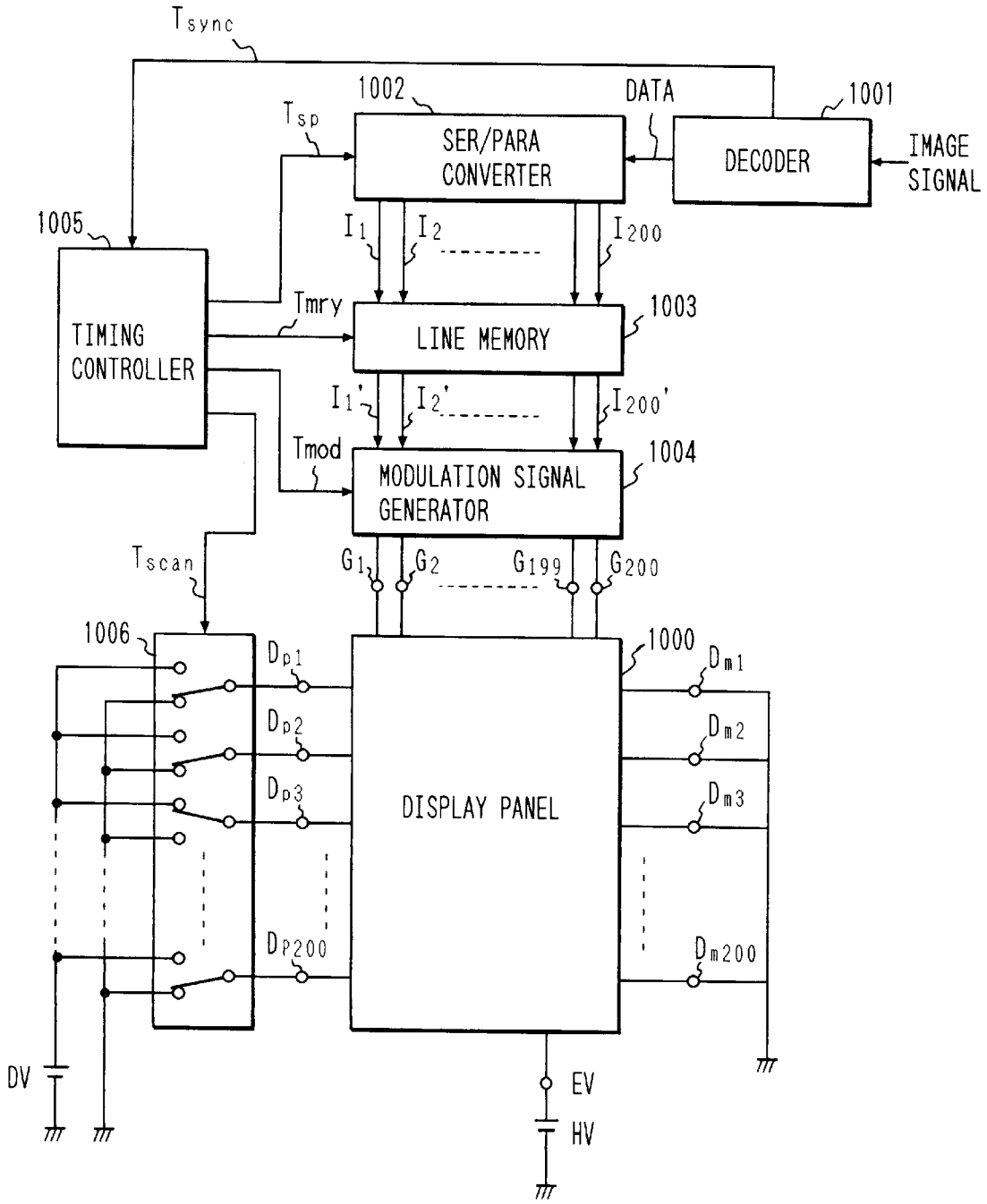
FIG. 52 is a block diagram of the drive circuit of one of the image forming apparatuses for displaying images according to NTSC system television signals and comprising one of the electron sources having a ladder-like arrangement of Example 15.

FIG. 52 is a block diagram of an electric circuit to be used for driving the display panel of FIG. 51. In FIG. 52, the circuit comprises the display panel 1000 of FIG. 24, a decode circuit 1001 for decoding composite image signals transmitted from outside, a serial/parallel conversion circuit 1002, a line memory 1003, a modulation signal generation circuit 1004, a timing control circuit 1005 and a scan signal generating circuit 1006. The electric terminals of the display panel 1000 are connected to the related circuits. Specifically, the terminal EV is connected to a voltage source HV for generating an acceleration voltage of 10 [kV] and the terminals G1 through G200 are connected to the modulation signal generation circuit 1004 while the terminals Dp1 through Dp200 are connected to the scan signal generation circuit 1006 and the terminals Dm1 through Dm200 are grounded.

Now, how each component of the circuit operates will be described. The decode circuit 1001 is a circuit for decoding incoming composite image signals such as NTSC television signals and separating brightness signals and synchronizing signals from the received composite signals. The former are sent to the serial/parallel conversion circuit 1002 as data signals and the latter are forwarded to the timing control circuit 1005 as Tsync signals. In other words, the decode circuit 1001 rearranges the values of brightness of the primary colors of RGB corresponding to the arrangement of color pixels of the display panel 1000 and serially transmits them to the serial/parallel conversion circuit 1002. It also extracts vertical and horizontal synchronizing signals and transmits them to the timing control circuits 1005. The timing control circuit 1005 generates various timing control signals in order to coordinate the operational timings of different components by referring to said synchronizing signal Tsync. More specifically, it transmits Tsp signals to the serial/parallel conversion circuit 1002, Tmry signals to the line memory 1003, Tmod signals to the modulation signal generation circuit 1004 and Tscan signals to the scan signal generation circuit 1005.

The serial/parallel conversion circuit 1002 samples brightness signals Data it receives from the decode circuit 1001 on the basis of timing signals Tsp and transmits them as 200 parallel signals I1 through I200 to the line memory 1003. When the serial/parallel conversion circuit 1002 completes an operation of serial/parallel conversion on a set of data for a single line of an image, the timing control circuit 1005 a write timing control signal Tmry to the line memory 1003. Upon receiving the signal Tmry, it stores the contents of the signals I1 through I200 and transmits them to the modulation signal generation circuit 1004 as signals I'1 through I'200 and holds them until it receives the next timing control signal Tmry.

The modulation signal generation circuit 1004 generates modulation signals to be applied to the grid electrodes of the display panel 1000 on the basis of the data on the brightness of a single line of an image it receives from the line memory 1003. The generated modulation signals are simultaneously applied to the modulation signal terminals G1 through G200 in correspondence to a timing control signal Tmod generated by the timing control circuit 1005. While modulation signals typically operate in a voltage modulation mode where the voltage to be applied to a device is modulated according to the data on the brightness of an image, they may alternatively operate in a pulse width modulation mode where the length of the pulse voltage to be applied to a device is modulated according to the data on the brightness of an image.

The scan signal generation circuit 1006 generates voltage pulses for driving the device columns of the surface conduction electron-emitting devices of the display panel 1000. It operates to turn on and off the switching circuits it comprises according to timing control signals Tscan generated by the timing control circuit 1005 to apply either a drive voltage VE[V] generated by a constant voltage source DV and exceeding the threshold level for the surface conduction electron-emitting devices or the ground potential level (or 0[V]) to each of the terminals Dp1 through Dp200.

Figure 53:
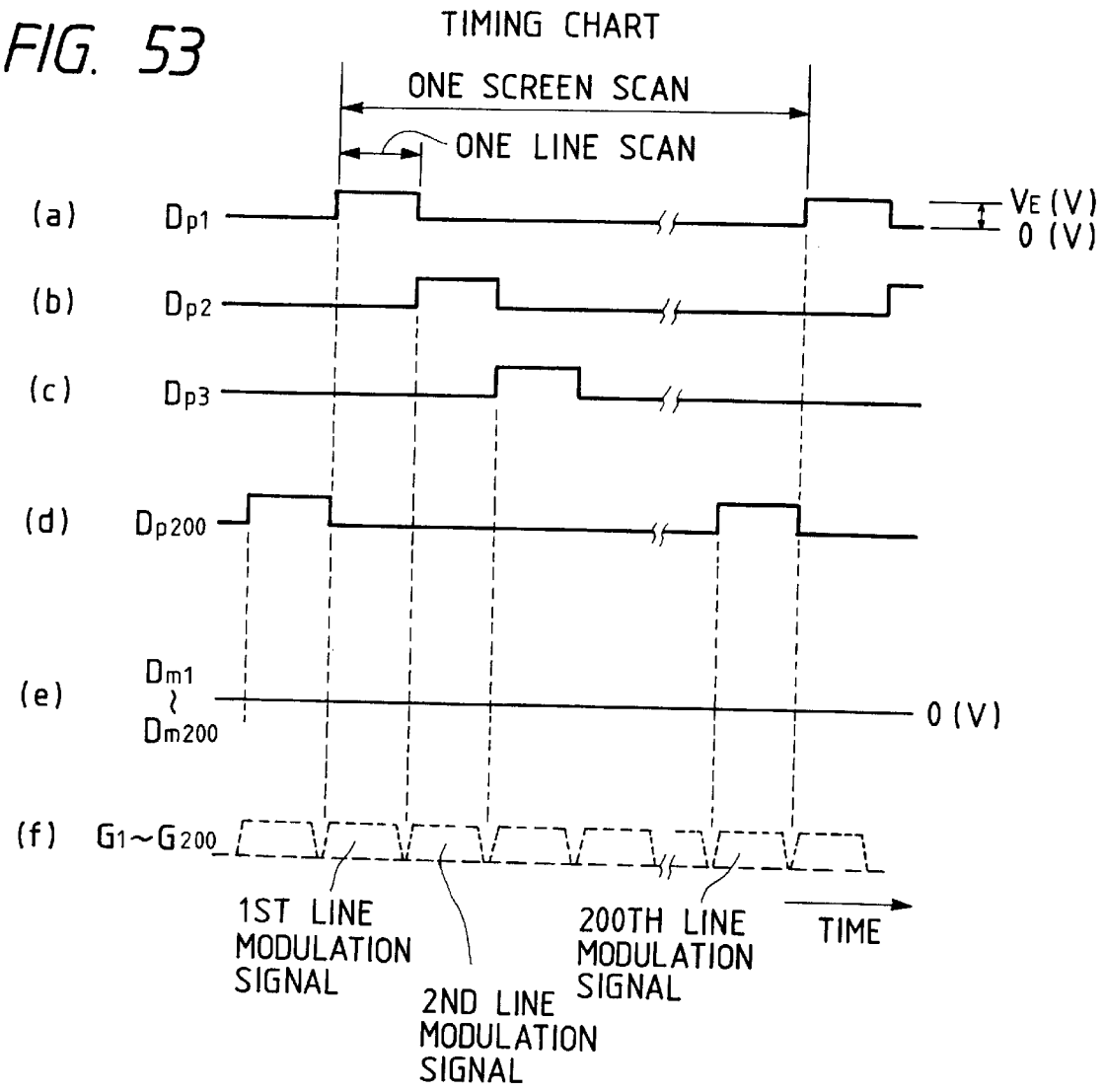
FIG. 53 is a timing chart illustrating how the image forming apparatus of FIG. 52 is driven to operate.

As a result of coordinated operations of the above described circuits, drive signals are applied to the display panel 1000 with the timings as illustrated in the graphs of FIG. 53. In FIG. 53, graphs (a) through (d) show part of signals to be applied to the terminals Dp1 through Dp200 of the display panel from the scan signal generation circuit 1006. It is seen that a voltage pulse having an amplitude of VE[V] is applied sequentially to Dp1, Dp2, Dp3, . . . within a period of time for display a single line of an image. On the other hand, since the terminals Dm1 through Dm200 are constantly grounded and held to 0[V], the device columns are sequentially driven by the voltage pulse to emit electron beams from the first column.

In synchronism of this operation, the modulation signal generation circuit 1004 applies modulation signals to the terminals G1 through G200 for each line of an image with the timing as shown by the dotted line in graph (f) of FIG. 53. Modulation signals are sequentially selected in synchronism with the selection of scan signals until an entire image is displayed. By continuously repeating the above operation, moving images are displayed on the display screen for television.

A flat panel type CRT comprising an electron source of FIG. 49 has been described above. Now, a panel type CRT comprising an electron source of FIG. 50 will be described below by referring to FIG. 54.

Figure 54:
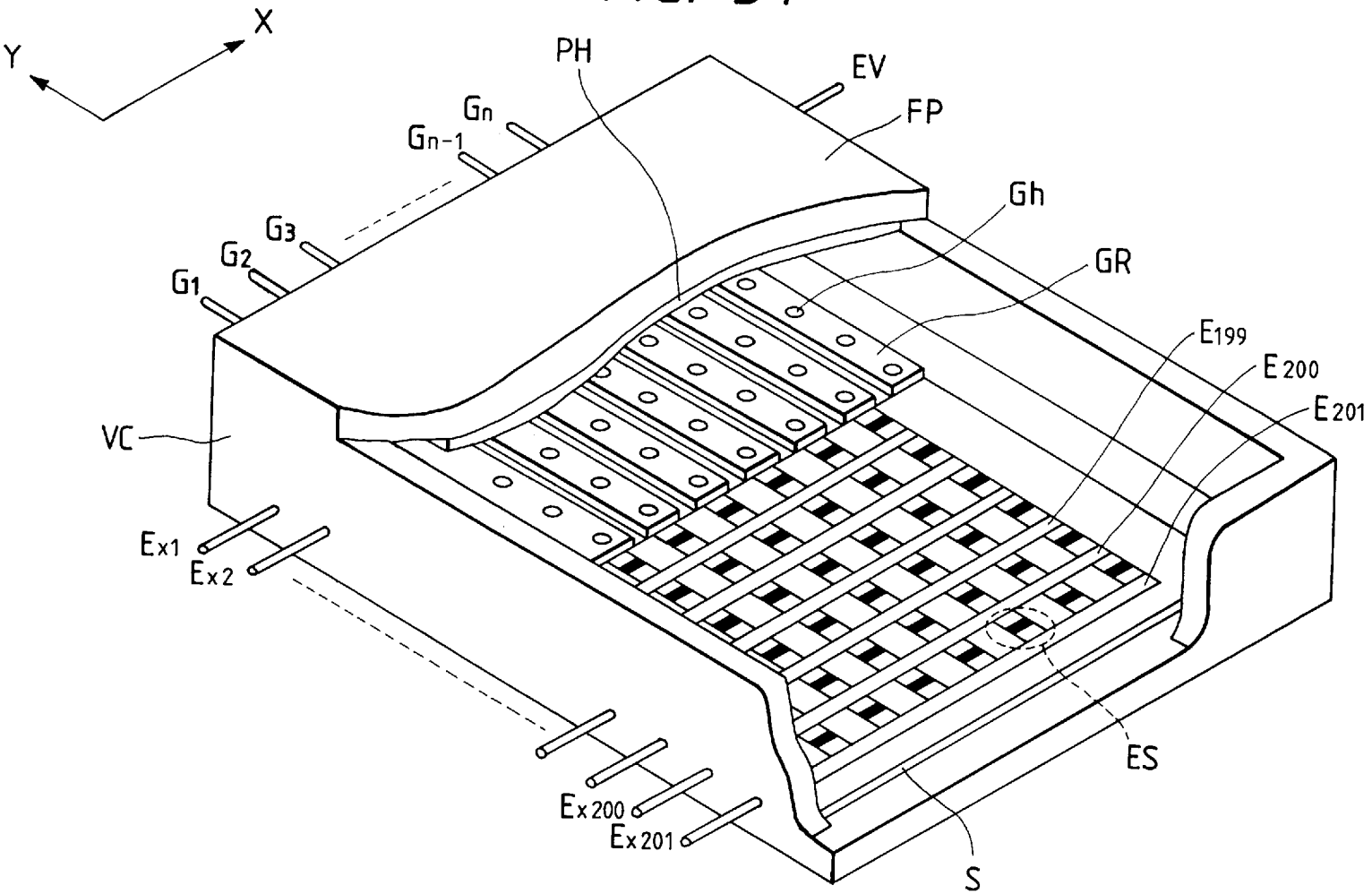
FIG. 54 is a partially cut away schematic perspective view of the display panel comprising other one of the electron sources also having a ladder-like arrangement of Example 15.
Figure 60:
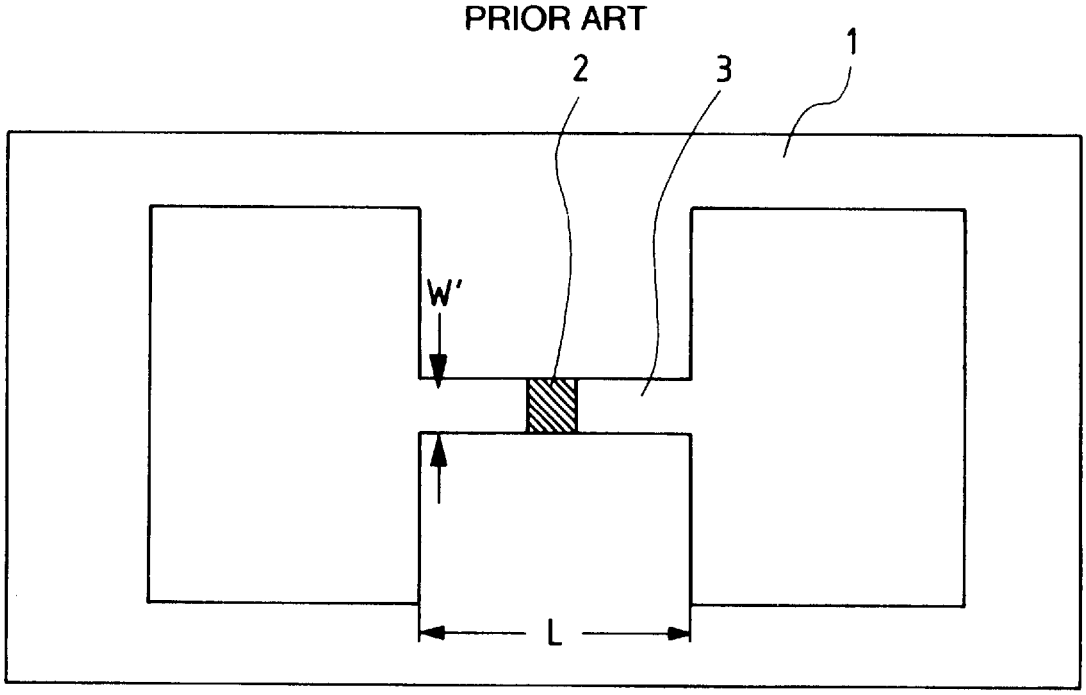
FIG. 60 PRIOR ART
FIG. 60 is a schematic view of a conventional surface conduction electron-emitting device, showing its basic structure.

The panel type CRT of FIG. 54 is realized by replacing the electron source of the CRT of FIG. 51 with the one illustrated in FIG. 60, which comprises an X-Y matrix of 200 columns of electron-emitting devices and 200 grid electrodes. Note that the 200 columns of surface conduction electron-emitting devices are respectively connected to 201 wiring electrodes E1 through E201 and, therefore, the vacuum container is provided with a total of 201 electrode terminals Ex1 through Ex201.

Since the electron source of FIG. 54 differs from that of FIG. 51 in terms of wirings, the manufacturing steps from the energization forming process on for the former also differs from those for the latter.

The steps from the energization forming step on for the electron source of FIG. 54 will be described below.

The inside of the vacuum container VC (FIG. 54) was evacuated through an exhaust pipe (not shown) by means of a vacuum pump. When a sufficient degree of vacuum was reached, a voltage was applied to the surface conduction electron-emitting devices ES by way of the external terminals Ex1 through Ex201 for carrying out an energization forming operation. FIG. 3B shows the wave form of the pulse voltage used for the energization forming operation. In this example, T1 was equal to 1 ms and T2 was equal to 10 ms. The operation was conducted in vacuum of a degree of about $1\times10^{-5}$ Torr.

Thereafter, acetone was introduced into the vacuum container VC until it showed a partial pressure of $1\times10^{-4}$ Torr and an activation process was carried out, applying a voltage to the surface conduction electron-emitting devices ES by way of the external terminals Dp1 through Dp200 and Dm1 through Dm200. After the activation process, the acetone was removed from the inside to produce finished surface conduction electron-emitting devices.

The electron-emitting region of each device was constituted by dispersed fine particles containing palladium as a principal ingredient. The average diameter of the fine particles was 35 angstroms. Thereafter, the ion pump used for evacuation was switched to an oil-free pump to produce an ultra-high vacuum condition and the electron source was baked at 120° C. for a sufficient period of time. After the baking operation the inside of the container was held a degree of vacuum of $1\times10^{-7}$ Torr.

Then, the exhaust pipe was heated and molten by means of a gas burner to hermetically seal the vacuum container VC.

Finally, the electron source was subjected to a getter process, using a high frequency heating technique, in order to maintain the high degree of vacuum after the container was sealed.

Figure 55:
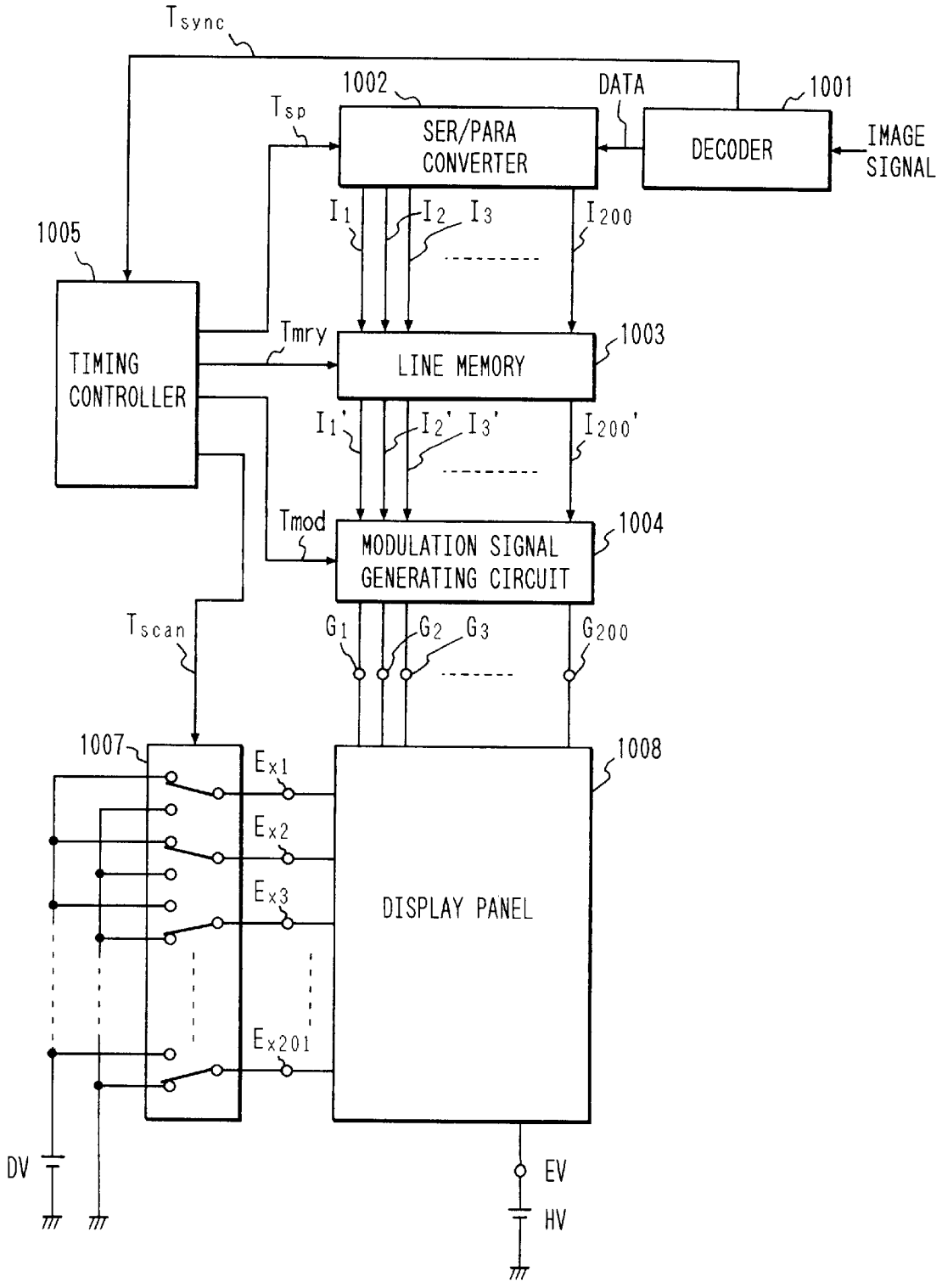
FIG. 55 is a block diagram of the drive circuit of other one of the image forming apparatuses for displaying images according to NTSC system television signals and comprising other one of the electron sources having a ladder-like arrangement of Example 15.
Figure 56:
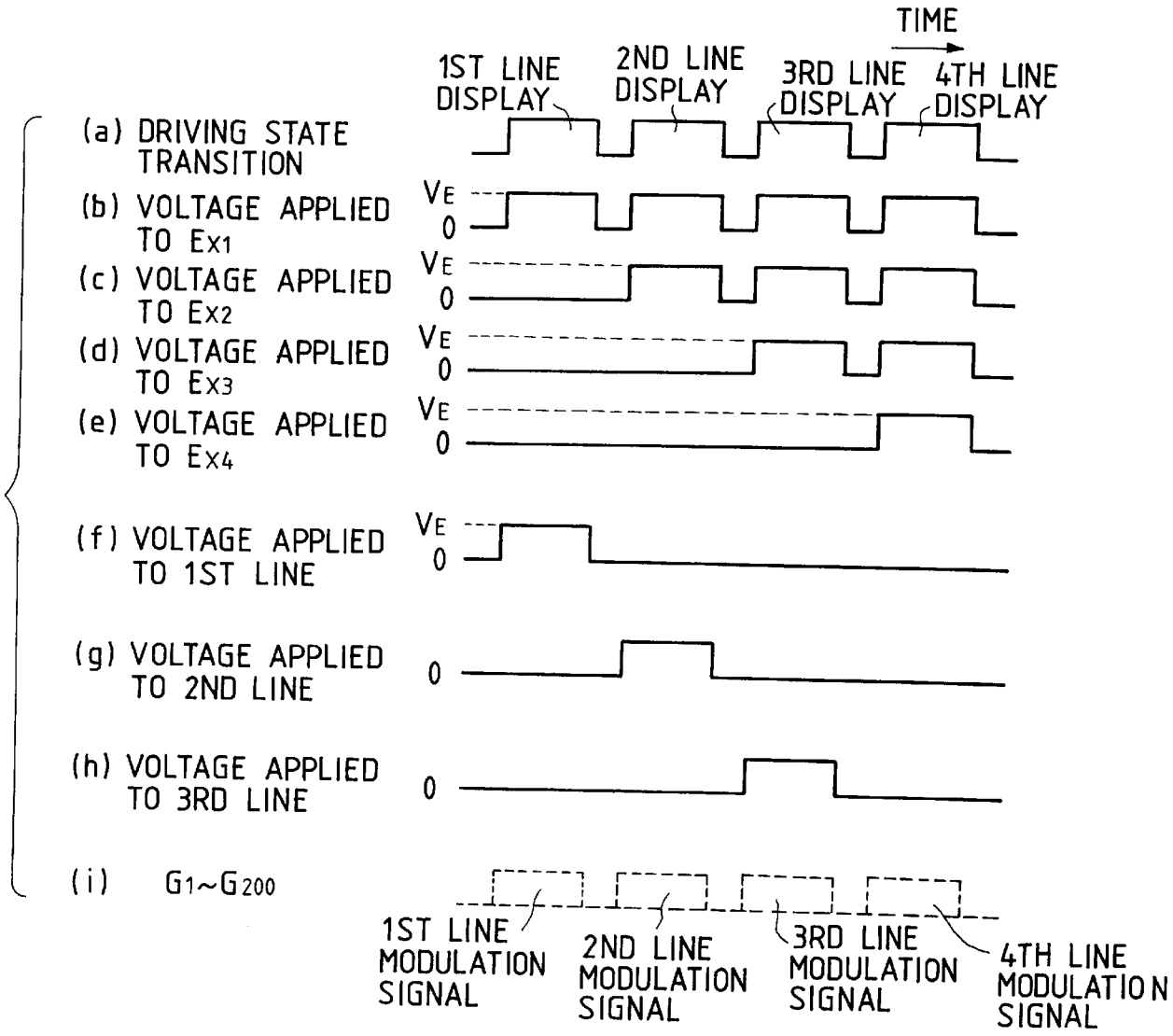
FIG. 56 is a timing chart illustrating how the image forming apparatus of FIG. 55 is driven to operate.

FIG. 55 shows a block diagram of a drive circuit for driving the display panel 1008. This circuit has a configuration basically same as that of FIG. 52 except the scan signal generation circuit 1007. The scan signal generation circuit 1007 applies either a drive voltage VE[V] generated by a constant voltage source DV and exceeding the threshold level for the surface conduction electron-emitting devices or the ground potential level (0[V]) to each of the terminals of the display panel. FIG. 56 shows charts of the timings with which certain signals are applied to the display panel. The display panel operates to display an image with the timing as illustrated in graph (a) of FIG. 56 as drive signals shown in graphs (b) through (e) of FIG. 56 are applied to the electrode terminals Ex1 through Ex4 from the scan signal generation circuit 1007 and, consequently, voltages as shown in graphs (f) through (h) of FIG. 56 are sequentially applied to the corresponding columns of surface conduction electron-emitting devices to drive the latter. In synchronism with this operation, modulation signals are generated by the modulation signal generation circuit 1004 with the timing as shown in graph (i) of FIG. 56 to display images on the display screen.

An image-forming apparatus of the type realized in this example operates very stably, showing full color images with excellent gradation and contrast.

As described above in detail, since a surface conduction electron-emitting device according to the invention is provided with a electroconductive thin film having an area that poorly cover the step portion of one of the device electrodes located close to the substrate, fissures can be produced preferentially in that area in the energization forming operation to produce an electron-emitting region. Therefore, the electron-emitting region is located very close to the device electrode and the electron beam emitted from the electron-emitting region is easily affected by the electric potential of the device electrode to become highly convergent before it gets to the target. Additionally, if the device electrode close to the electron-emitting region is held to a relatively low voltage, the convergence of the electron beam emitted from the electron-emitting region can be further improved.

Thus, if the device electrodes are separated from each other by a large distance, the electron-emitting region can always be formed along the related device electrode and therefore can be controlled in terms of location and profile so that it may not swerved like those of conventional electron-emitting devices. In other words, an surface conduction electron-emitting device according to the invention operates excellently in terms of convergence of electron beam like a conventional electron-emitting device having a narrow gap between the device electrodes even if the device electrodes of the device are separated from each other by a large distance.

Since an area that poorly cover the step portion of the related device electrode is formed in the electroconductive thin film in order to preferentially generate fissures there, the power required for the energization forming operation can be significantly reduced and the electron-emitting region operates excellently for electron emission if compared with a conventional electron-emitting device.

Additionally, the electron beam emitted from the electron-emitting region of the device can be controlled very well by arranging a control electrode on or close to the related device electrode. If the control electrode is arranged on the substrate, the deviation in the course of the electron beam caused by an electrically charged up condition of the substrate can be effectively corrected.

In a preferably mode of carrying out a method of manufacturing a surface conduction electron-emitting device according to the invention, a solution containing the component elements of electroconductive thin film is sprayed through a nozzle to produce an electroconductive thin film on the substrate. Such an arrangement is particularly safe and suited to produce a large display screen. The operation of spraying the solution and producing an area in the electroconductive thin film that poorly cover the step portion of the related device electrode can be effectively and efficiently carried out if the nozzle is electrically charged and the device electrodes are differentiated in terms of their electric potentials so that fissures may be preferentially generated in the area of poor step coverage. Thus, an electron-emitting region is always formed along the related device electrode regardless of the profile of the device electrode and that of the electroconductive thin film. Additionally, the electroconductive thin film is made to firmly adhere to the substrate to produce a highly reliable electron-emitting device if the spraying technique is used.

Therefore, a large number of surface conduction electron-emitting devices according to the invention can be manufactured uniformly particularly in terms of the electron-emitting regions and, therefore, such devices operate stably and uniformly for electron emission.

Thus, an electron source realized by arranging a large number of surface conduction electron-emitting devices according to the invention, operates also stably and uniformly. Since the power required for the energization forming operation for each device is small, the operation can be conducted with a relatively low voltage to further improve the performance of the devices.

The electron-emitting region of each electron-emitting device according to the invention can be controlled accurately in terms of location and profile if the device electrodes are separated from each other by several to several hundred micrometers. So, the problem of a swerved electron-emitting region is eliminated to improve the manufacturing yield.

If a nozzle is used to spray a solution containing the component elements of the electroconductive thin film, an electron source comprising a large number of surface conduction electron-emitting devices can be prepared in a relatively simple manner and therefore at reduced cost without rotating a large substrate for carrying the surface conduction electron-emitting devices.

Thus, according to the invention, an electron source that emits highly convergent electron beams and hence operate stably can be manufactured at low cost.

Finally, an image forming apparatus according to the invention uses highly convergent electron beams on an image forming member and therefore, a high precision display apparatus with good separation between adjacent pixels and free from blurs in case of color display can be provided. In addition, a large display apparatus giving bright, high quality images can be provided due to the high uniformity and efficiency.

What is claimed is:

1. An electron-emitting device comprising an electroconductive thin film including a fissure disposed between a pair of electrodes arranged on a substrate, wherein said fissure is located closer to one of the pair of electrodes than to the other and is formed close to the step portion formed by one of the pair of electrodes and the substrate.

2. An electron-emitting device according to claim 1, wherein the step portion formed by one of the electrodes and the substrate has a height different from that of the step portion formed by the other of the electrodes and the substrate.

3. An electron-emitting device according to claim 2, wherein the heights of the step portions device are defined by the thicknesses of the electrodes themselves.

4. An electron-emitting device according to claim 2, wherein the heights of the step portions are defined by the thicknesses of the electrodes and the thickness of a control member arranged on one of the electrodes.

5. An electron-emitting device according to claim 2, wherein the higher step portion has a height at least five times greater than the thickness of the electroconductive film.

6. An electron-emitting device according to claim 1, wherein the step portion formed by one of the electrodes and the substrate has a height different from that of the step portion formed by the other electrode and the substrate and the fissure is arranged close to the higher step portion.

7. An electron-emitting device according to claim 6, wherein the heights of the step portions device are defined by the thicknesses of the electrodes themselves.

8. An electron-emitting device according to claim 6, wherein the heights of the step portions are defined by the thicknesses of the electrodes and the thickness of a control member arranged on one of the electrodes.

9. An electron-emitting device according to claim 6, wherein the higher step portion has a height at least five times greater than the thickness of the electroconductive film.

10. An electron-emitting device according to claim 1, wherein the electroconductive thin film extends from the top of one of the electrodes to a position between the other of the electrodes and the substrate to cover the substrate between and connect the electrodes.

11. An electron-emitting device according to claim 10, wherein the heights of the step portions are defined by the thicknesses of the electrodes themselves.

12. An electron-emitting device according to claim 10, wherein the heights of the step portions are defined by the thicknesses of the electrodes and the thickness of a control member arranged on one of the electrodes.

13. An electron-emitting device according to claim 10, wherein the higher step portion has a height at least five times greater than the thickness of the electroconductive film.

14. An electron-emitting device according to claim 10, wherein the fissure is arranged close to the step portion of the electrode onto the top of which the electroconductive thin film extends.

15. An electron-emitting device according to claim 14, wherein the heights of the step portions device are defined by the thicknesses of the electrodes themselves.

16. An electron-emitting device according to claim 14, wherein the heights of the step portions are defined by the thicknesses of the electrodes and the thickness of a control member arranged on one of the electrodes.

17. An electron-emitting device according to claim 14, wherein the higher step portion has a height at least five times greater than the thickness of the electroconductive film.

18. An electron-emitting device according to any of claims 1 through 17, wherein the fissure is arranged within 1 $\mu$m from the electrode having the step portion close to which the fissure is formed toward the other electrode.

19. An electron-emitting device according to any of claims 1 through 17, wherein the electrode having the step portion close to which the fissure is formed is held to an electric potential lower than that of the other of the electrodes.

20. An electron-emitting device according to claim 1, wherein it further comprises a control electrode.

21. An electron-emitting device according to claim 20, wherein the step portion formed by one of the electrodes and the substrate has a height different from that of the step portion formed by the other of the electrodes and the substrate.

22. An electron-emitting device according to claim 21, wherein the heights of the step portions are defined by the thicknesses of the electrodes themselves.

23. An electron-emitting device according to claim 21, wherein the heights of the step portions are defined by the thicknesses of the electrodes and the thickness of a control member arranged on one of the electrodes.

24. An electron-emitting device according to claim 21, wherein the higher step portion has a height at least five times greater than the thickness of the electroconductive film.

25. An electron-emitting device according to claim 20, wherein the step portion formed by one of the electrodes and the substrate has a height different from that of the step portion formed by the other of the electrodes and the substrate and the fissure is arranged close to the higher step portion.

26. An electron-emitting device according to claim 25, wherein the heights of the step portions are defined by the thicknesses of the electrodes themselves.

27. An electron-emitting device according to claim 25, wherein the heights of the step portions are defined by the thicknesses of the electrodes and the thickness of a control member arranged on one of the electrodes.

28. An electron-emitting device according to claim 25, wherein the higher step portion has a height at least five times greater than the thickness of the electroconductive film.

29. An electron-emitting device according to claim 20, wherein the electroconductive thin film extends from the top of one of the electrodes to a position between the other of the electrodes and the substrate to cover the substrate between and connect the electrodes.

30. An electron-emitting device according to claim 29, wherein the heights of the step portions are defined by the thicknesses of the electrodes themselves.

31. An electron-emitting device according to claim 29, wherein the heights of the step portions are defined by the thicknesses of the electrodes and the thickness of a control member arranged on one of the electrodes.

32. An electron-emitting device according to claim 29, wherein the higher step portion has a height at least five times greater than the thickness of the electroconductive film.

33. An electron-emitting device according to claim 29, wherein the fissure is arranged close to the step portion of the electrode onto the top of which the electroconductive thin film extends.

34. An electron-emitting device according to claim 33, wherein the heights of the step portions are defined by the thicknesses of the electrodes themselves.

35. An electron-emitting device according to claim 33, wherein the heights of the step portions are defined by the thicknesses of the electrodes and the thickness of a control member arranged on one of the electrodes.

36. An electron-emitting device according to claim 33, wherein the higher step portion has a height at least five times greater than the thickness of the electroconductive film.

37. An electron-emitting device according to claim 20, wherein the control electrode is arranged on any one of the pair of electrodes.

38. An electron-emitting device according to claim 20, wherein the control electrode is arranged on the electrode having the step portion close to which the fissure is arranged.

39. An electron-emitting device according to claim 20, wherein the control electrode is arranged at least close to the electroconductive thin film.

40. An electron-emitting device according to claim 39, wherein the control electrode is arranged on the substrate.

41. An electron-emitting device according to claim 39, wherein the control electrode is electrically connected to one of the electrodes.

42. An electron-emitting device according to any one claim selected from the group consisting of claims 20 through 40 and 41, wherein the fissure is arranged within 1 $\mu$m from the electrode having the step portion close to which the fissure is formed toward the other of the electrodes.

43. An electron-emitting device according to any one claim selected from the group consisting of claims 20 through 40 and 41, wherein the electrode having the step portion close to which the fissure is formed is the electrode held to an electric potential lower than that of the other of the electrodes.

44. An electron source comprising a plurality of electron-emitting devices arranged on a substrate, wherein each of the electron-emitting devices is as defined in claim 1.

45. An electron source according to claim 44, wherein the plurality of electron-emitting devices are arranged in device rows that are connected by wires.

46. An electron source according to claim 44, wherein the plurality of electron-emitting devices are arranged so as to form a matrix of wires.

47. An image forming apparatus comprising an electron source and an image forming member, wherein the electron source is as defined in any of claims 44 through 46.

48. An image forming apparatus according to claim 47, wherein the image forming member is a fluorescent body.

* * * * *

UNITED STATES PATENT AND TRADEMARK OFFICE

CERTIFICATE OF CORRECTION

PATENT NO. : 5,847,495
DATED : December 8, 1998
INVENTOR(S) : Masato Yamanobe et al.

It is certified that error appears in the above-identified patent and that said Letters Patent is hereby corrected as shown below:

Item [56] References Cited,
Other Publications
"Chuguova," should read -- Chugunova --.
"Molybelenum" should read -- Molybdenum --.

Column 1,
Line 20, "Advance in" should read -- Advances in Electronics and --.
Line 21, ""PHYSICAL" should read -- "Physical --.

Column 2,
Line 40, "tens of several" should read -- several tens of --.
Line 41, "televisons" should read -- television --.
Line 47, "is separated from other" should read -- are separated from each other --.
Line 64, "tens of several" should read -- several tens of --.

Column 3,
Line 16, "nor" should read -- nor do --.
Lines 23 and 48, "tens of several should read -- several tens of --.
Line 47, "is" should read -- area --.

Column 6,
Line 61, "other one" should read -- another --.
Line 66, "source" should read -- sources --.

Column 7,
Lines 9, 12 and 15, "other one" should read -- another --.

Column 8,
Line 2, "conventinal" should read -- conventional --.
Line 38, "siginificant" should read -- significant --.
Line 62, "device, of electron source" should read -- devices, of electron sources --.

Column 9,
Line 44, "hundreds of" should read -- several hundred --.
Line 45, "several" should be deleted.
Line 46, "hundreds of several" should read -- several -- hundred --.

UNITED STATES PATENT AND TRADEMARK OFFICE

CERTIFICATE OF CORRECTION

PATENT NO. : 5,847,495
DATED : December 8, 1998
INVENTOR(S) : Masato Yamanobe et al.

It is certified that error appears in the above-identified patent and that said Letters Patent is hereby corrected as shown below:

Column 10,
Line 51, "covers" should read -- cover --.
Line 66, "hundreds of several" should read -- several hundred --.

Column 11,
Line 61, "tens of several" should read -- several tens of --.

Column 13,
Line 6, "and have" should read -- that has --.
Line 16, "of" should read -- or --.
Line 18, "the" should read -- of the --.

Column 14,
Line 9, "time," should read -- times, --.

Column 16,
Line 17, "same" should read -- the same --.
Line 60, "electrode" should read -- eletrodes --.
Line 65, "appear identical as" should read -- as --.

Column 17,
Line 35, "device" should read -- devices --.

Column 18,
Line 47, "same" should read -- the same as --.

Column 19,
Line 19, "an" should read -- a --.

Column 20,
Line 60, "same" should read -- the same --.

Column 21,
Line 15, "denotes" should read -- denote --.

Column 22,
Line 48, "emit" should read -- emits --.
Line 53, "electron" should read -- electrons --.

UNITED STATES PATENT AND TRADEMARK OFFICE

CERTIFICATE OF CORRECTION

PATENT NO. : 5,847,495
DATED : December 8, 1998
INVENTOR(S) : Masato Yamanobe et al.

It is certified that error appears in the above-identified patent and that said Letters Patent is hereby corrected as shown below:

Column 23,
Line 44, "same" should read -- the same --.

Column 24,
Line 8, "The tab connected to" should be deleted.
Lines 9-10 should be deleted.
Line 24, "Dy2," should read -- Dy2,..., --.
Line 35, "wired" should read -- wires --.
Line 58, "same" should read -- the same --.

Column 25,
Line 21, "same" should read -- the same as --.
Line 25, "emitted" should read -- omitted --.
Line 63, "wired" should read -- wires --.

Column 26,
Line 19, "same" should read -- the same --.
Line 49, "same" should read -- the same as --.
Line 53, "emitted" should read -- omitted --.

Column 29,
Line 30, "have" should read -- has --.
Line 49, "emit" should read -- emits --.
Line 50, "a" should read -- when a --.
Line 60, "so far" should read -- as long --.

Column 30,
Line 57, "by" should read -- in --.

Column 31,
Line 8, "an" should read -- a --.

Column 32,
Line 30, "denotes" should read -- denote --.
Line 63, "organize" should read -- organic --.

Column 33,
Line 52, "respective" should read -- respectively --.

UNITED STATES PATENT AND TRADEMARK OFFICE

CERTIFICATE OF CORRECTION

PATENT NO. : 5,847,495
DATED : December 8, 1998
INVENTOR(S) : Masato Yamanobe et al.

It is certified that error appears in the above-identified patent and that said Letters Patent is hereby corrected as shown below:

Column 35,
Line 66, "the" should be deleted.

Column 36,
Line 14, "same" (both occurrences) should read -- the same --.

Column 38,
Line 26, Ti" should read -- T1 --.
Line 62, "assumingly" should read -- presumably --.

Column 40,
Line 6, "ing" should read -- ing to --.
Line 26, "graphic" should read -- graphics --.
Line 31, "other" should read -- in other --.
Line 36, "operations" should read -- operations, -- ; and close up right margin.
Line 37, Close up left margin.

Column 41,
Line 26, "sent" should read -- being sent --.
Line 45, "such" should read -- in such --.

Column 42,
Line 31, "a" should read -- when a --.
Line 64, "same" (both occurrences) should read -- the same --.
Line 66, "same" should read -- the same --.

Column 43,
Line 17, "organize" should read -- organic --.
Line 33, "was" should read -- were --.
Line 34, "while" should read -- and --.
Line 39, "$2x10^{6}$" should read -- $1x10^{-6}$ --.

Column 44,
Line 24, "same" should read -- the same --.

UNITED STATES PATENT AND TRADEMARK OFFICE

CERTIFICATE OF CORRECTION

PATENT NO. : 5,847,495
DATED : December 8, 1998
INVENTOR(S) : Masato Yamanobe et al.

It is certified that error appears in the above-identified patent and that said Letters Patent is hereby corrected as shown below:

Column 45,
Line 4, "denotes" should read -- denote --.
Line 10, "shows" should read -- show --.
Line 36, "organize" should read -- organic --.

Column 46,
Line 19, "respective" should read -- respectively --.
Line 66, "substrates" should read -- substrate --.

Column 47,
Line 24, "prouce" should read -- produce --.
Line 27, "systemtem" should read -- system --.

Column 48,
Line 45, "$10^6$" should read -- $10^{-6}$ --.
Line 53, "respective" should read -- respectively --.

Column 49,
Line 19, "the both" should read -- both of the --.
Line 35, "same" (both occurrences) should read -- the same --.

Column 51,
Line 5, "be" should be deleted.
Line 34, "was" should read -- which was --.

Column 52,
Lines 14 and 55, "the both" should read -- both of the --.
Line 37, "$\psi$" should read -- $\Omega$ --.

Column 53,
Line 18, "$10^7$" should read -- $10^{-7}$ --.
Line 27, "respective" should read -- respectively --.

Column 54,
Lines 16 and 17, "same" should read -- the same --.

UNITED STATES PATENT AND TRADEMARK OFFICE

CERTIFICATE OF CORRECTION

PATENT NO. : 5,847,495
DATED : December 8, 1998
INVENTOR(S) : Masato Yamanobe et al.

It is certified that error appears in the above-identified patent and that said Letters Patent is hereby corrected as shown below:

Column 56,
Line 48, "a pulse voltage same" should read -- the same pulse voltage --.
Line 66, "on" should be deleted.

Column 57,
Line 41, "The both" should read -- Both of the --
Line 61, "organize" should read -- organic --.

Column 58,
Line 1, "tiling" should read -- tilting --; and "300" should read -- 30° --.
Line 8, "organized" should read -- organic --.

Column 59,
Line 21, "same" should read -- the same --.

Column 60,
Line 37, "Step-d" should read -- Step-c --.

Column 61,
Lines 25 and 26, "same" should read -- the same --.

Column 63,
Line 33, "an" should read -- a --.
Line 61, "imageforming should read -- image-forming --.
Line 64, "envelop" should read -- envelope --.

Column 65,
Line 3, "the both" should read -- both of the --.
Line 42, "denote" should read -- denotes --.
Line 57, "an" should read -- a --.

Column 66,
Line 59, "appropriate" should read -- appropriately --.

UNITED STATES PATENT AND TRADEMARK OFFICE

CERTIFICATE OF CORRECTION

PATENT NO. : 5,847,495
DATED : December 8, 1998
INVENTOR(S) : Masato Yamanobe et al.

It is certified that error appears in the above-identified patent and that said Letters Patent is hereby corrected as shown below:

Column 67,
Line 35, "circuits" should read -- circuit --.
Line 45, "Data" should read -- data --.
Line 51, "a" should read -- sends a --.

Column 68,
Line 23, "display" should read -- displaying --.
Line 28, "of" should read -- with --.

Column 69,
Line 27, "the" should read -- for the --
Line 53, "cover" should read -- covers --.

Column 70,
Line 3, "not" should read -- not be --.
Line 4, "an" should read -- a --.
Lines 11 and 33, "cover" should read -- covers --.

Column 71,
Line 5, "operate" should read -- operates --.

Signed and Sealed this

Thirteenth day of November, 2001

*Attest:*

Nicholas P. Godici

NICHOLAS P. GODICI
*Acting Director of the United States Patent and Trademark Office*

*Attesting Officer*